US006482580B2

(12) United States Patent
Morita

(10) Patent No.: US 6,482,580 B2
(45) Date of Patent: Nov. 19, 2002

(54) PHOTOTHERMOGRAPHIC IMAGING MATERIAL

(75) Inventor: Kiyokazu Morita, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/971,341

(22) Filed: Oct. 4, 2001

(65) Prior Publication Data

US 2002/0068246 A1 Jun. 6, 2002

(30) Foreign Application Priority Data

Oct. 10, 2000 (JP) ..... 2000/308991

(51) Int. Cl.[7] ..... G03C 1/498; G03C 1/76; G03C 1/91; G03C 11/06

(52) U.S. Cl. ..... 430/496; 430/523; 430/531; 430/619; 430/950; 430/961

(58) Field of Search ..... 430/619, 961, 430/950, 523, 531, 496

(56) References Cited

U.S. PATENT DOCUMENTS 5,252,448 A * 10/1993 Nishio et al. ..... 430/523
5,873,018 A * 2/1999 Aoto et al. ..... 430/126
6,020,117 A * 2/2000 Bauer et al. ..... 430/961

* cited by examiner

*Primary Examiner*—Richard L. Schilling
(74) *Attorney, Agent, or Firm*—Bierman, Muserlian and Lucas

(57) ABSTRACT

A silver salt photothermographic material is disclosed, comprising a support provided thereon at least one light-sensitive layer containing an organic silver salt, light-sensitive silver halide grains and a reducing agent, wherein the surface of at least one side of the photothermographic material exhibits a coefficients of dynamic friction of 0.1 to 0.4 when being in contact with a stainless steel plate heated at a temperature of 100° C. The photothermographic material also contains solid lubricant particles.

24 Claims, 1 Drawing Sheet

PHOTOTHERMOGRAPHIC IMAGING MATERIAL

FIELD OF THE INVENTION

The present invention relates to silver salt photothermographic imaging materials, and in particular to thermally processable photothermographic materials exhibiting enhanced photographic performance and improved abrasion resistance and transportability.

BACKGROUND OF THE INVENTION

In the field of graphic arts and medical treatment, there have been concerns in processing of photographic film with respect to effluent produced from wet-processing of image forming materials, and recently, reduction of the processing effluent is strongly demanded in terms of environmental protection and space saving. There has been desired a photothermographic dry imaging material for photographic use, capable of forming distinct black images exhibiting high sharpness, enabling efficient exposure by means of a laser imager or a laser image setter.

Known as such a technique are silver salt photothermographic dry imaging materials forming photographic images through thermal processing, as described in U.S. Pat. Nos. 3,152,904 and 3,487,075, and D. H. Klosterboer, "Thermally Processed Silver Systems" in IMAGING PROCESSES and MATERIALS, Neblette's Eighth Edition, edited by J. M. Sturge, V. Walworth, and A. Shepp (1969) page 279.

Such a photothermographic material generally comprises a support such as a plastic resin support provided thereon with an emulsion layer in combination with other component layer(s) such as an interlayer, a protective layer, a backing layer, an antihalation layer or an antistatic layer. When a photothermographic material is wound up, re-wound or transported in the process of coating, drying or converting, the photothermographic material is often adversely affected by contact of the photothermographic material sheet with various apparatuses or mutual contact of photothermographic material sheets, such as contact of the light-sensitive layer-side surface with the backing layer-side surface. Examples thereof include abrasion marks or marks produced in slippage on the surface of the photothermographic material and deterioration of the photothermographic material, caused when the photothermographic material is transported in a processing apparatus.

In regard thereto, U.S. Pat. No. 6,021,117 discloses the use of an alkylsilane compound having 8 or more carbon atoms. However, it was proved that there were problems in that the use of such a compound adversely affected photographic performance, deteriorating image color and the desired slipping property was not achieved. Further, in response to recent trends of increases of transport speed or processing speed in a processing apparatus, improvements in slipping property are required.

SUMMARY OF THE INVENTION

In view of the foregoing problems, it is an object of the present invention to provide a silver salt photothermographic material improved in abrasion mark caused in processing, without adversely affecting photographic performance.

It is another object of the invention to provide a photothermographic material exhibiting enhanced slipping property, without adversely affecting coatability.

The above object of the invention can be accomplished by the following constitution:

1. A photothermographic material comprising a support provided thereon at least one light-sensitive layer containing an organic silver salt, light-sensitive silver halide grains and a reducing agent, wherein the surface of at least one side of the photothermographic material exhibits a coefficient of dynamic friction of 0.1 to 0.4 when being in contact with a stainless steel plate maintained at a temperature of 100° C.

Furthermore, preferred embodiments of the invention are as follows:

2. A photothermographic material comprising a support provided thereon at least one light-sensitive layer containing an organic silver salt, light-sensitive silver halide grains and a reducing agent, wherein any one of the layer(s) provided on the support contains solid lubricant particles;
3. The photothermographic material described in 2 above, wherein the solid lubricant particles are comprised of boron nitride;
4. A photothermographic material comprising a support provided thereon at least one light-sensitive layer containing an organic silver salt, light-sensitive silver halide grains and a reducing agent, wherein any one of the layer(s) provided on the support contains solid lubricant particles and a hydroxy group-reactive compound;
5. A photothermographic material comprising a support provided thereon at least one light-sensitive layer containing an organic silver salt, light-sensitive silver halide grains and a reducing agent, wherein any one of the layer(s) provided on the support contains solid lubricant particles and a fluorinated nonionic surfactant;
6. The photothermographic material described in any of 1 through 5, wherein the light-sensitive layer contains at least a dye represented by the following formula (1):

formula (1)

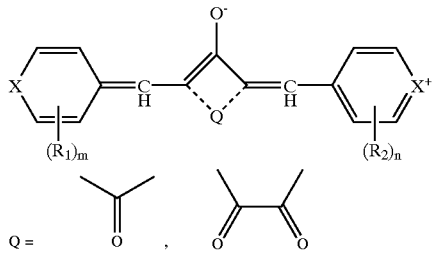

wherein X is a sulfur or oxygen atom; $R_1$ and $R_2$ are each a univalent substituent group; and m and n are each 0, 1, 2, 3 or 4;

7. The photothermographic material described in any one of 1 through 6, wherein the light-sensitive layer or a light-insensitive layer contains a silver-saving agent.
8. The photothermographic material described in any one of 1 through 6, wherein the light-sensitive layer or a light-insensitive layer contains at least two compounds generating a labile species capable of oxidizing silver or capable of deactivating the reducing agent, thereby preventing reduction of silver ions of the organic silver salt to silver upon exposure to ultraviolet ray or visible light;
9. A black-and-white silver salt photothermographic material comprising at least two light-sensitive layers;

10. An image recording method of a silver salt photothermographic material, wherein when recording an image on the photothermographic dry imaging material described in any of 1 through 6, exposure is conducted using a laser light scanning exposure machine of double beam scanning laser light;
11. An image recording method of a silver salt photothermographic material, wherein when recording an image on the photothermographic dry imaging material described in any of 1 through 6, exposure is conducted using a laser light scanning exposure machine of longitudinal multiple laser scanning light.
12. The photothermographic material described in any one of 1 through 6, wherein the photothermographic material meets the requirement of 190° $<h_{ab}<$260° , in which $h_{ab}$ is a hue angle (as defined in JIS-Z 8729).
13. The photothermographic material described in any one of 1 through 6, wherein the light-sensitive layer is formed by coating a coating solution of the light-sensitive layer containing at least 30% by weight of water.

DETAILED DESCRIPTION OF THE INVENTION

Figure 1:
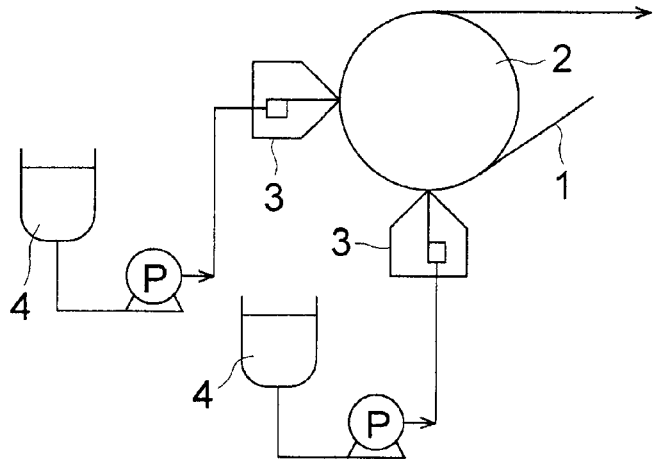
FIG. 1 illustrates a coating apparatus used in the invention.

In the invention, the coefficient of dynamic friction between the photothermographic material and a stainless steel plate maintained at 100° C. is within a range of 0.1 to 0.4. Thus, the surface of at least one side of the photothermographic material exhibits a coefficient of dynamic friction of 0.1 to 0.4 when being in contact with a stainless steel plate heated at 100° C. The dynamic friction is commonly known in the art and the coefficient of dynamic friction (hereinafter, also denoted as dynamic friction coefficient), in general, is defined as the ratio of the frictional force, parallel to the surface of contact, that opposes the motion of a body which is sliding or rolling over another, to the force, normal to the surface of contact, with which the bodies press against each other. The coefficient of dynamic friction can be readily determined in accordance with JIS K 7125 1999, corresponding to ISO 8295 1995.

Solid lubricants used in the invention are mainly classified into organic and inorganic ones and inorganic ones are specifically preferred. Inorganic lubricants are classified into lamellar solid, soft metal and solid having low shearing strength. Examples of lamellar solid include dichalcogenides (e.g., $MOS_2$, $WS_2$, $WSe_2$, etc.), graphite, boron nitride, $CdCl_2$, $PbCl_2$ and phthalocyanine. Examples of soft metals include Au, Ag, Pb, In, and Ba. Examples of solids having low shearing strength include Cd-, Co- or Zn-oxide, Bi- and Cd-sulfide, Ca-, Li- or Ba-fluoride. Of these, lamellar solids are preferred, and boron nitride (BN) is specifically preferred. Boron nitrides are classified into cubic boron nitride (hereinafter, also denoted as cEN) and hexagonal boron nitride (hereinafter, also denoted as hBN). cBN exhibits high hardness and high thermal conductivity. On the other hand, hBN exhibits enhanced lubricative property. Both nitrides are characterized by superior chemical stability and thermal resistance, and being hardly condensable. The combined use of cBN and hBN leads to abrasion resistance due to high hardness and high thermal conductivity of cBN, and abrasion resistance and the lubricative property due to lubricative property of hBN. Solid lubricants used in the invention preferably have a particle size of 1 to 10 $\mu$m, and more preferably 2 to 5 $\mu$m in terms of producing a haze-free. Such solid lubricants, commercially available include, for example, DENKA BORON NITRIDE SP-2 and HG-P (available from DENKA Co., Ltd.).

The organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (e.g., salts of gallic acid, oxalic acid, behenic acid, stearic acid, palmitic acid, lauric acid, etc.); carboxyalkylthiourea salts (e.g., 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (e.g., aldehydes such as formaldehyde, acetaldehyde, butylaldehyde), hydroxy-substituted acids (e.g., salicylic acid, benzoic acid, 3,5-dihydroxybenzoic acid, 5,5-thiodisalicylic acid, silver salts or complexes of thiones (e.g., 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidic acid and/or stearic acid are specifically preferred. A mixture of two or more kinds of organic silver salts is preferably used, enhancing developability and forming silver images exhibiting relatively high density and high contrast. For example, preparation by adding a silver ion solution to a mixture of two or more kinds of organic acids is preferable.

The organic silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present.

Organic silver salt grains may be of almost any shape but are preferably tabular grains. Tabular organic silver salt grains are specifically preferred, exhibiting an aspect ratio of 3 or more and a needle form ratio of not less than 1.1 and less than 10.0 of a needle form ratio measured from the major face direction, thereby lessen anisotropy in shape of substantially parallel, two faces having the largest area (so-called major faces). The more preferred needle form ratio is not less than 1.1 and less than 5.0.

The expression "comprises tabular organic silver salt grains exhibiting an aspect ratio of 3 or more " means that at least 50% by number of the total organic silver salt grains is accounted for by such tabular grains having an aspect ratio of 3 or more. The organic silver salt grains having an aspect ratio of 3 or more accounts for more preferably at least 60% by number, still more preferably at least 70% by number, and specifically preferably at least 80% by number. The tabular organic silver salt particle having an aspect ratio of 3 or more refers to an organic salt grain exhibiting a ratio of grain diameter to grain thickness, a so-called aspect ratio (also denoted as AR) of 3 or more, which is defined as below:

$$AR = \text{diameter}(\mu m)/\text{thickness}(\mu m)$$

wherein when an organic silver salt grain is approximated to be a rectangular parallelepiped, the diameter is the maximum edge length (also denoted as MX LNG) and the thickness is the minimum edge length (also denoted as MN LNG).

The aspect ratio of the tabular organic silver salt grain is preferably within the range of 3 to 20, and more preferably 3 to 10. In the case of an aspect ratio of less than 3, the organic salt particles easily form closest packing and in the case of the aspect ratio being excessively high, organic silver salt grains are easily superposed and dispersed in a coating layer in the form of being brought into contact with each other, easily causing light scattering and leading to deterioration in transparency of the photothermographic material.

The grain diameter was determined in the following manner. An organic silver salt dispersion was diluted, dispersed on the grid provided with a carbon support membrane, and then photographed at a direct magnification of 5,000 times using a transmission type electron microscope (TEM, 2000 FX type, available from Nihon Denshi Co., Ltd.). The thus obtained negative electron micrographic images were read as a digital image by a scanner to determine the diameter (circular equivalent diameter) using appropriate software. At least 300 grains were so measured to determine an average diameter.

The grain thickness is determined using a transmission type electron microscope in the following manner. First, a light sensitive layer, coated onto a support, is pasted onto a suitable holder employing an adhesive and is cut perpendicular to the support surface employing a diamond knife to prepare an ultra-thin slice, at a thickness of 0.1 to 0.2 $\mu$m. The thus prepared ultra-thin slice is supported on a copper mesh, and is placed onto a carbon membrane, which has been made to be hydrophilic by means of a glow discharge. Then, while cooling the resulting slice to not more than −130° C., the image in a bright visual field is observed at a magnification of 5,000 to 40,000 employing a transmission electron microscope (hereinafter referred to as TEM), and then images are quickly recorded employing an image plate, a CCD camera, etc. In such a case, it is recommended to suitably select a portion of said slice, which has neither been torn nor distorted in the visual field for observation.

The carbon membrane, which is supported by an organic film such as an extremely thin collodion, Formvar, etc., is preferably employed, and a film composed of only carbon, which is obtained by forming the film on a rock salt substrate and then dissolving away the substrate or by removing the foregoing organic film, employing an organic solvent or ion etching, is more preferably employed. The acceleration voltage of said TEM is preferably 80 to 400 kV, and is most preferably 80 to 200 kV.

Details of other means such as electron microscopic technology and sample preparation techniques can be referred to in "Igaku•Seibutsugaku Denshikenbikyo Kansatsuho (Medical and Biological Electron Microscopy", edited by Nippon Denshikenbikyo Gakkai, Kanto-Shibu, (Maruzen), and "Denshikenbikyo Seibutsu Shiryo Sakuseiho (Preparation Method of Biological Samples for Electron Microscopy)", edited by Nippon Denshikenbikyo Gakkai, Kanto-Shibu, (Maruzen).

The TEM image, recorded in an appropriate medium, is decomposed to at least 1024×1024 pixels or preferably at least 2048×2048 pixels, and is then subjected to image processing employing a computer. In order to carry out image processing, an analogue image recorded on a film strip is converted into a digital image employing a scanner etc, and the resulting image is preferably subjected to shading correction, contrast-edge enhancement, etc., based on specific requirements. Thereafter, a histogram is prepared and the portions corresponding to organic silver are extracted employing binary processing. At least 300 grains of the organic silver salt were manually measured with respect to the thus extracted thickness employing appropriate software.

The average of the needle ratio of the tabular organic silver salt grains is determined according to the procedures described below.

First, a light sensitive layer, comprising tabular organic silver salt grains, is allowed to swell by employing an organic solvent which is capable of dissolving the binder of said light sensitive layer, and said layer is then peeled from the support. The operation is repeated five times, in which the peeled layer is subjected to ultrasonic cleaning with the above-mentioned solvent, and centrifugal separation, and the supernatant is removed. Further, the above-mentioned process is carried out under a photographic safelight.

Subsequently, dilution is carried out employing MEK (methyl ethyl ketone) so that the concentration of the organic silver solid portion becomes 0.01 percent. After carrying out ultrasonic dispersion, the resulting is dropped onto a polyethylene terephthalate film which has been made to be hydrophilic employing a glow discharge, and is subsequently dried.

The film, on which said grains are placed, is subjected to oblique evaporation of 3 nm thickness Pt-C by an electron beam from a 30° angle to the film surface employing a vacuum evaporation unit, and thereafter, is preferably employed for observation.

The prepared sample is observed through a secondary electron image, obtained by employing a field emission scanning electron microscope (hereinafter referred to as PE-SEM) under a magnification of 5,000 to 20,000 at an acceleration voltage of 2 to 4 kV, and the resulting image is stored on suitable recording media.

For the above-mentioned processing, it is convenient to use a device which is capable of directly recording the memory data as digital information, which is obtained by AD converting image signals from the electron microscope body. However, analogue images recorded onto Polaroid film etc. can be converted to digital images employing a scanner etc., and the resulting images may be employed upon carrying out shading correction, contrast enhancement as well as edge enhancement, etc. if desired.

One image recorded in a suitable medium is decomposed to at least 1024×1024 pixels and is preferably decomposed to 2048×2048 pixels. Said decomposed image is preferably subjected to image processing employing a computer.

Procedures of the above-mentioned image processing are as follows. First, a histogram is prepared and portions corresponding to tabular organic silver salt grains having an aspect ratio of 3 or more are extracted employing binary processing. Inevitable coagulated grains are cut employing a suitable algorithm or a manual operation and are subjected to boarder extract. Thereafter, both maximum length (MX LNG) and minimum width (WIDTH) between two parallel lines are measured for at least 1000 grains, and the needle ratio of each grain is obtained employing the formula described below. The maximum length (MX LNG) is the maximum value of the straight length between two points within a grain. The minimum width between two parallel lines is the minimum distance of two parallel lines drawn circumscribing the grain.

Needle ratio=(*MX LNG*)/(WIDTH)

Thereafter, the number average of the needle ratio is calculated for all measured particles. When measurements are carried out employing the above-mentioned procedures, it is desirable that in advance, employing a standard sample, the length correction (scale correction) per pixel as well as two-dimensional distortion correction of the measurement system is adequately carried out. As the standard sample, Uniform Latex Particles (DULP) marketed by Dow Chemical Co. in the USA are suitable. Polystyrene particles having a variation coefficient of less than 10 percent for a diameter of 0.1 to 0.3 $\mu$m are preferred. Specifically, a type having a particle diameter of 0.212 $\mu$m as well as a standard deviation of 0.0029 $\mu$m is commercially available.

Details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

Methods to prepare organic silver salt grains having the above-mentioned shape are not particularly restricted. The optimization of various conditions such as maintaining the mixing state during the formation of an organic acid alkali metal salt soap and/or the mixing state during the addition of silver nitrate to said soap. After tabular organic silver salt grains employed in the present invention are preliminarily dispersed together with binders, surface active agents, etc., if desired, the resulting mixture is preferably dispersed and pulverized by a media homogenizer, a high pressure homogenizer, or the like. During said preliminary dispersion, ordinary stirrers such as an anchor type, a propeller type, etc., a high speed rotation centrifugal radial type stirrer (Dissolver), as a high speed shearing stirrer (homomixer) may be employed.

Furthermore, employed as said media homogenizers may be rolling mills such as a ball mill, a satellite ball mill, a vibrating ball mill, medium agitation mills such as a bead mill, atriter, and others such as a basket mill. Employed as high pressure homogenizers may be various types such as a type in which collision occurs against a wall or a plug, a type in which liquid is divided into a plurality of portions and said portions are subjected to collision with each other, a type in which liquid is forced to pass through a narrow orifice, etc. Examples of ceramics employed as the ceramic beads include $Al_2O_3$, $BaTiO_3$, $SrTiO_3$, MgO, ZrO, BeO, $Cr_2O_3$, $SiO_3$, $SiO_2$—$Al_2O_3$, $Cr_2O_3$—MgO, MgO—CaO, MoO—C, MgO—$Al_2O_3$ (spinel), SiC, $TiO_2$, $K_2O$, $Na_2O$, BaO, PbO, $B_2O_3$, $BeAl_2O_4$, $Y_3Al_5O_{12}$, $ZrO_2$—$Y_2O_3$ (cubic zirconia), 3BeO—$Al_2O_3$—6$SiO_2$ (artificial emerald), C (artificial diamond), $SiO_2$—n$H_2O$, silicone nitride, yttrium-stabilized-zirconia, zirconia-reinforced-alumina. Yttrium-stabilized-zirconia and zirconia-reinforced-alumina are preferably employed in view that little impurity is generated by friction among the beads or the classifier during classifying them. The ceramics containing zirconia are called zirconia as an abbreviation.

In devices employed for dispersing the tabular organic silver salt grains employed in the present invention, preferably employed as the members which are in contact with the organic silver salt grains are ceramics such as zirconia, alumina, silicone nitride, boron nitride, or diamond. Of these, zirconia is the one most preferably employed.

While carrying out of the above-mentioned dispersion, the binder is preferably added so as to achieve a concentration of 0.1 to 10 wt % with reference to the weight of the organic silver salt, and the temperature is preferably maintained at no less than 45° C. from the preliminary dispersion to the main dispersion process. An example of the preferable operation conditions of a homogenizer, when employing high-pressure homogenizer as the dispersing machine, is twice or more operations at 300 to 1,000 kgf/cm$^2$. In the case when a media-dispersing machine is employed, a circumferential speed of 6 to 13 m/sec. is preferable. In the case when zirconia is employed as a part of the beads or of the machine, it is ground and mixed into the dispersion during the mixing process. This is specifically advantageous in view of photographic characteristics. Fragments of zirconia may be supplementally added to the dispersion or preliminarily added during preliminary dispersing. A high concentration zirconia liquid can be obtained, for example, by circulating methylethylketone in a bead mill filled with zirconia beads. The obtained zirconia liquid may be added in the adequate amount at adequate stages. The content of the zirconia in a light sensitive emulsion containing light sensitive silver halide and an organic silver salt is preferably 0.01 to 0.5 mg, and more preferably 0.01 to 0.3 mg per g of silver. The zirconia is preferably in the form of fine particles having a diameter of not more than 0.02 $\mu$m.

In one preferred embodiment of this invention, light sensitive silver halide used in this invention is subjected to chemical sensitization which is performed using an organic sensitizer containing a chalcogen atom in the absence of an oxidizing agent during the manufacturing process of the photothermographic material, the silver halide being mixed with the organic silver salt, dispersed, dewatered and dried. One feature of the light sensitive emulsion used in the invention is that when the cross section, vertical to the support of the photothermographic material is observed through an electron microscope, organic silver salt particles exhibiting a grain projected area of less than 0.025 $\mu^2$ account for at least 70% of the total grain projected area and organic silver salt particles exhibiting a grain projected area of not less than 0.2 $\mu$2 account for not more than 10% of the total grain projected area. In such a case, coagulation of the organic silver salt grains is minimized in the light sensitive emulsion, resulting in a homogeneous distribution thereof.

The conditions for preparing the light sensitive emulsion having such a feature are not specifically limited but include, for example, mixing at the time of forming an alkali metal soap of an organic acid and/or mixing at the time of adding silver nitrate to the soap being maintained in a favorable state, optimization of the ratio of the soap to the silver nitrate, the use of a media dispersing machine or a high pressure homogenizer for dispersing pulverization, wherein dispersion is conducted preferably in a binder content of 0.1 to 10% by weight, based on the organic silver salt, the dispersion including the preliminary dispersion is carried out preferably at a temperature of not higher than 45° C., and a dissolver, as a stirrer is preferably operated at a circumferential speed of at least 2.0 m/sec.

The projected area of organic silver salts grain having a specified projection area and the desired proportion thereof, based on the total grain projection area can be determined by the method using a transmission type electron microscope (TEM) in a similar manner, as described in the determination of the average thickness of tabular grains having an aspect ratio of 3 or more. In this case, coagulated grains are regarded as a single grain when determining the grain area (AREA). At least 1000 grains, and preferably at least 2000 grains are measured to determine the area and classified into three groups, i.e., A: less than 0.025 $\mu m^2$, B: not less than 0.025 $\mu m^2$ and less than 0.2 $\mu m^2$ and C: more than 0.2 $\mu m^2$. In this invention, it is preferable that the total projected area of grains falling within the range of "A" accounts for at least 70% of the projected area of the total grains and the total projected area of grains falling within the range of "C" accounts for not more than 10% of the projected area of total grain.

As mentioned earlier, details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

The organic silver salt grains used in this invention are preferably monodisperse. The degree of monodispersion is preferably 1 to 30% and monodisperse particles in this range lead to the desired high density images. The degree of monodispersion is defined as below:

Degree of grain dispersity=(standard deviation of particle size)/(average particle size)×100 (%).

The average particle size of organic silver salt is preferably 0.01 to 0.8 $\mu$m, and more preferably 0.05 to 0.5 $\mu$m. The particle size refers to the diameter of a circle having an area equivalent to the projected area of the particle (i.e., circular equivalent diameter).

To prevent hazing of the photothermographic material, the total amount of silver halide and organic silver salt is preferably 0.5 to 2.2 g in equivalent converted to silver per $m^2$, thereby leading to high contrast images.

The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completing the grain formation, the resulting silver halide grain emulsion is subjected to desalting to remove soluble salts by commonly known washing methods such as a noodle washing method, a flocculation method, a ultrafiltration method, or electrodialysis to obtain desired emulsion grains.

In order to minimize cloudiness after image formation and to obtain excellent image quality, the less the average grain size, the more preferred, and the average grain size is preferably not more than 0.2 $\mu$m, more preferably between 0.01 and 0.17 $\mu$m, and still more preferably between 0.02 and 0.14 m. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains. The monodisperse grains as described herein refer to grains having a coefficient of variation of grain size obtained by the formula described below of not more than 7%; more preferably not more than 5%, still more preferably not more than 3%, and most preferably not more than 1%.

Coefficient of variation of grain size=standard deviation of grain diameter/average grain diameter×100(%)

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. The low molecular weight gelatin can be obtained by subjecting an aqueous gelatin conventionally used and having an average molecular weight of ca. 100,000 to enzymatic hydrolysis, acid or alkali hydrolysis, thermal degradation at atmospheric pressure or under high pressure, or ultrasonic degradation.

The concentration of dispersion medium used in the nucleation stage is preferably not more than 5% by weight, and more preferably 0.05 to 3.0% by weight.

In the preparation of silver halide grains, it is preferred to use a compound represent by the following formula, specifically in the nucleation stage:

$$YO(CH_2CH_2O)m(C(CH_3)CH_2O)_p(CH_2CH_2O)nY$$

where Y is a hydrogen atom, —$SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100. Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A No. 44-9497. The polyethylene oxide compound represented by the foregoing formula also functions as a defoaming agent during nucleation. The compound represented by the foregoing formula is used preferably in an amount of not more than 1%, and more preferably 0.01 to 0.1% by weight, based on silver.

The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by weight. It is also preferred to make the compound represented by formula [5] present over a period of at least 50% (more preferably, at least 70%)of the nucleation stage.

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5N, and more preferably 0.01 to 2.5N. The flow rate of aqueous silver salt solution is preferably $1.5\times10^{-3}$ to $3.0\times10^{-1}$ mol/min per lit. of the solution, and more preferably $3.0\times10^{-3}$ to $8.0\times10^{-2}$ mol/min. per lit. of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0.

Silver halide may be incorporated into an image forming layer by any means, in which silver halide is arranged so as to be as close to reducible silver source as possible. It is general that silver halide, which has been prepared in advance, added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto.

Silver halide can also be prepared by reacting a halogen containing compound with an organic silver salt through conversion of the organic silver salt. Thus, a silver halide-forming component is allowed to act onto a pre-formed organic silver salt solution or dispersion or a sheet material containing an organic silver salt to convert a part of the organic silver salt to photosensitive silver halide.

The silver halide-forming components include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof include inorganic halide compound such as a metal halide and ammonium halide; onium halides, such as trimethylphenylammonium bromide, cetylethyldimethylammonium bromide, and trimethylbenzylammonium bromide; halogenated hydrocarbons, such as iodoform, bromoform, carbon tetrachloride and 2-brom-2-methylpropane; N-halogenated compounds, such as N-bromosucciimde, N-bromophthalimide, and N-bromoacetoamide; and other halogen containing compounds, such as triphenylmethyl chloride, triphenylmethyl bromide, 2-bromoacetic acid, 2-bromoethanol and dichlorobenzophenone. As described above, silver halide can be formed by converting a part or all of an organic silver salt to silver halide through reaction of the organic silver salt and a halide ion. The silver halide separately prepared may be used in combination with silver halide prepared by conversion of at least apart of an organic silver salt. The silver halide which is separately prepared or prepared through conversion of an organic silver salt is used preferably in an amount of 0.001 to 0.7 mol, and more preferably 0.03 to 0.5 mol per mol of organic silver salt.

Silver halide used in the invention preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

Exemplary examples of transition metal-coordinated complexes are shown below:

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[IrCl_6]^{4-}$
8: $[IrCl_6]^{3-}$
9: $[Ru(NO)Cl_5]^{2-}$

10: $[RuBr_4(H_2O)]^{2-}$
11: $[Ru(NO)(H_2O)Cl_4]^-$
12: $[RhCl_5(H_2O)]^{2-}$
13: $[Re(NO)Cl_5]^{2-}$
14: $[Re(NO)(CN)_5]^{2-}$
15: $[Re(NO)Cl(CN)_4]^{2-}$
16: $[Rh(NO)_2Cl_4]^-$
17: $[Rh(NO)(H_2O)Cl_4]^-$
18: $[Ru(NO)(CN)_5]^{2-}$
19: $[Fe(CN)_6]^{3-}$
20: $[Rh(NS)Cl_5]^{2-}$
21: $[Os(NO)Cl_5]^{2-}$
22: $[Cr(NO)Cl_5]^{2-}$
23: $[Re(NO)Cl_5]^-$
24: $[Os(NS)Cl_4(TeCN)]^{2-}$
25: $[Ru(NS)Cl_5]^{2-}$
26: $[Re(NS)Cl_4(SeCN)]^{2-}$
27: $[Os(NS)Cl(SCN)_4]^{2-}$
28: $[Ir(NO)Cl_5]^{2-}$;

and with regard to cobalt or iron compounds, hexacyano cobalt or iron complexes are preferably used and exemplary examples thereof are shown below:

29: $[Fe(CN)_6]^{4-}$
30: $[Fe(CN)_6]^{3-}$
31: $[Co(CN)_6]^{3-}$.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KC1 is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

With regard to the difference in constitution between a conventional silver salt photographic material and a photothermographic imaging material, the photothermographic imaging material contains relatively large amounts of light sensitive silver halide, a carboxylic acid silver salt and a reducing agent which often cause fogging and silver printing-out (print out silver). In the photothermographic imaging material, therefore, an enhanced technique for antifogging and image-lasting is needed to maintain storage stability not only before development but also after development. In addition to commonly known aromatic heterocyclic compounds to restrain growth of fog specks and development thereof, there were used mercury compounds having a function of allowing the fog specks to oxidatively die away. However, such a mercury compound causes problems with respect to working safety and environment protection.

Next, antifoggants and image stabilizers used in the photothermographic imaging material relating to the invention will be described.

As a reducing agent used in photothermographic materials are employed reducing agents containing a proton, such as bisphenols and sulfonamidophenols. Accordingly, a compound generating a labile species which is capable of abstracting a proton to deactivate the reducing agent is preferred. More preferred is a compound as a non-colored photo-oxidizing substance, which is capable of generating a free radical as a labile species on exposure. Any compound having such a function is applicable. However, a halogen radical, which easily forms silver halide is not preferred. An organic free radical composed of plural atoms is preferred. Any compound having such a function and exhibiting no adverse effect on the photothermographic material is usable irrespective of its structure. Of such free radical generation compounds, a compound containing an aromatic, and carbocyclic or heterocyclic group is preferred, which provides stability to the generated free radical so as to be in contact with the reducing agent for a period sufficient to react with the reducing agent to deactivate it. Representative examples of such compounds include biimidazolyl compounds and iodonium compounds.

Of such imidazolyl compounds, a compound represented by the following formula [B1] is preferred:

formula [B1]

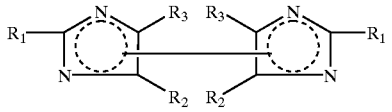

wherein $R_1$, $R_2$ and $R_3$ (,which may be the same or different) each are a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a hydrogen atom, a halogen atom, an aryloxyl (e.g., phenoxy), an alkylthio group (e.g., methylthio, butylthio), an arylthio group (e.g., phenylthio), a heterocyclic group (e.g., pyridyl, triazyl), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, a heterocyclic group, an alkenyl group and cyano group.

The biimidazolyl compounds can be synthesized in accordance with the methods described in U.S. Pat. No. 3,734,733 and British Patent 1,271,177. Preferred Examples thereof are shown below.

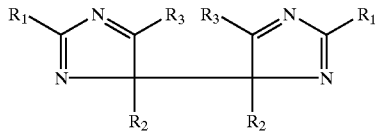

| | $R_1$ | $R_2$ | $R_3$ |
|---|---|---|---|
| BI-1 | H | CN | H |
| BI-2 | CN | H | CN |
| BI-3 | $CF_3$ | H | $CF_3$ |
| BI-4 | 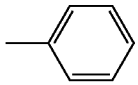 | 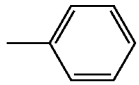 | 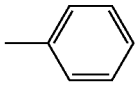 |
| BI-5 | 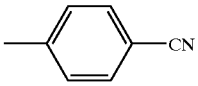 | 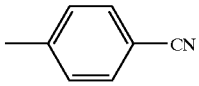 | 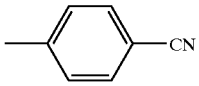 |
| BI-6 | 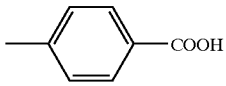 | 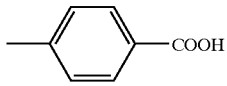 | 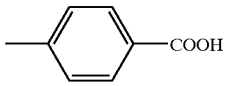 |
| BI-7 | H | —CH═$CH_2$ | H |
| BI-8 | 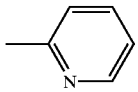 | 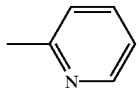 | 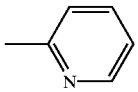 |
| BI-9 | 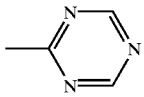 | 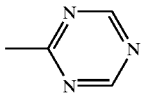 | 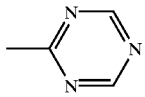 |

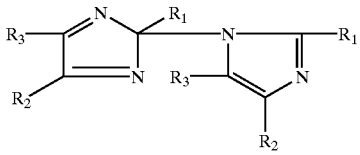

| | $R_1$ | $R_2$ | $R_3$ |
|---|---|---|---|
| BI-10 | H | 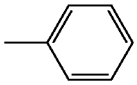 | 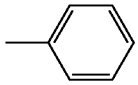 |
| BI-11 | CN | H | H |
| BI-12 | CN | 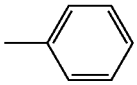 | 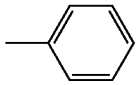 |

-continued

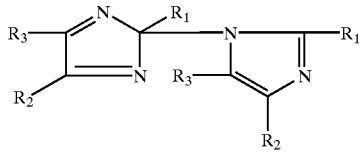

| | $R_1$ | $R_2$ | $R_3$ |
|---|---|---|---|
| BI-13 | H | 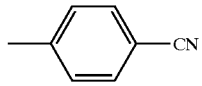 | 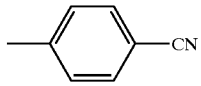 |
| BI-14 | H | $CF_3$ | H |

-continued

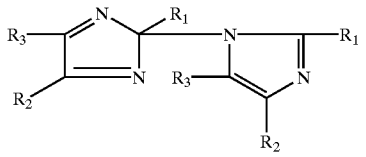

| | $R_1$ | $R_2$ | $R_3$ |
|---|---|---|---|
| BI-15 | H | 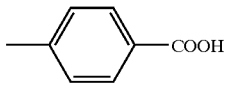 | 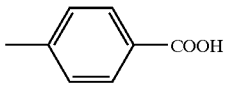 |
| BI-16 | H | 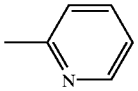 | 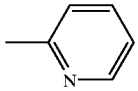 |

Similarly preferred compounds include a iodonium compound represented by the following formula [2]:

Formula [2]

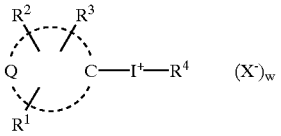

wherein Q is a group of atoms necessary to complete a 5-, 6-, or 7-membered ring, and the atoms being selected from a carbon atom, nitrogen atom, oxygen at om and sulfur atom; and $R^1$, $R^2$ and $R^3$ (,which may be the same or different) are each a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a halogen atom, an aryloxyl (e.g., phenoxy), an alkylthio group (e.g., methylthio, butylthio), an arylthio group (e.g., phenylthio), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, an alkenyl group and cyano group, provided that $R^1$, $R^2$ and $R^3$ may be bonded with each other to form a ring; $R^4$ is a carboxylate group such as acetate, benzoate or trifluoroacetate, or $O^-$; W is 0 or 1, provided that when $R^3$ is a sulfo group or a carboxy group, W is 0 and $R^4$ is $O^-$; $X^-$ is an anionic counter ion, including $CH_3CO_2$—, $CH_3SO_3$— and $PF_6^-$.

Of these is specifically preferred a compound represented by the following formula [3]:

formula [3]

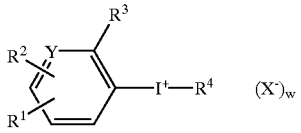

wherein R1, $R^2$, $R^3$, $R^4$, $X^-$ and W are each the same as defined in formula [2]; Y is a carbon (i.e., —CH═) to form a benzene ring or a nitrogen atom (—N═) to form a pyridine ring.

The iodonium compounds described above can be synthesized in accordance with the methods described in Org. Syn., 1961 and Fieser, "Advanced Organic Chemistry" (Reinhold, N.Y., 1961).

Exemplary examples of the compounds represented by formula [2] or [3] are shown below.

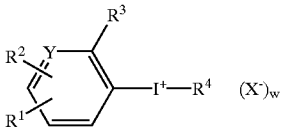

| Compound | $R^1$ | $R^2$ | $R^3$ | $R^4$ | W | X | Y |
|---|---|---|---|---|---|---|---|
| I-1 | H | H | H | $OCOCH_3$ | 1 | $OCOCH_3$ | C |
| I-2 | H | H | H | $OCOCF_3$ | 1 | $OCOCF_3$ | C |
| I-3 | H | $CH_3$ | H | $OCOCH_3$ | 1 | $OCOCH_3$ | C |
| I-4 | H | $CH_3$ | $CO_2H$ | $O^-$ | 0 | — | C |
| I-5 | H | H | $CO_2H$ | $O^-$ | 0 | — | C |
| I-6 | H | CN | $CO_2H$ | $O^-$ | 0 | — | C |
| I-7 | $OCH_3$ | $CH_3$ | H | $OCOCH_3$ | 1 | $OCOCH_3$ | C |
| I-8 | $CH_3$ | $CH_3$ | $CH_3$ | $OCOCH_3$ | 1 | $OCOCH_3$ | C |
| I-9 | $CH_3$ | $CH_3$ | H | $OCOCH_3$ | 1 | $OCOCH_3$ | C |
| I-12 | $CH_3$ | $CH_3$ | $CO_2H$ | $O^-$ | 0 | — | C |
| I-13 | H | H | $SO_3H$ | $O^-$ | 0 | — | C |
| I-14 | H | CN | $CO_2H$ | $O^-$ | 0 | — | C |
| I-15 | $OCH_3$ | Cl | H | $OCOCH_3$ | 1 | $OCOCH_3$ | C |
| I-16 | $CO_2H$ | H | H | $OCOCH_3$ | 1 | $OCOCH_3$ | C |
| I-17 | $OCH_3$ | Cl | $CH_3$ | $OCOCH_3$ | 1 | $OCOCH_3$ | C |
| I-18 | H | H | H | $OCOCH_2CH_3$ | 1 | $OCOCH_2CH_3$ | C |
| I-19 | H | $CH_2OH$ | H | $OCOCH_3$ | 1 | $OCOCH_3$ | C |
| I-20 | Cl | $CH_2OH$ | $CO_2H$ | $O^-$ | 0 | — | C |
| I-21 | Cl | $CH_3$ | $SO_3H$ | $O^-$ | 0 | — | C |
| I-22 | $CH_3$ | CN | $CO_2H$ | $O^-$ | 0 | — | C |
| I-23 | $CF_3$ | Cl | H | $OCOCH_3$ | 1 | $OCOCH_3$ | C |
| I-24 | $CO_2H$ | H | H | $OCOCH_3$ | 1 | $OCOCH_3$ | C |
| I-25 | $OCCH_3$ | H | $C_6H_5$ | $OCOCH_3$ | 1 | $OCOCH_3$ | C |

-continued

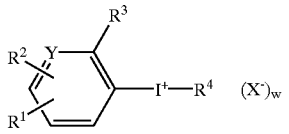

| Compound | $R^1$ | $R^2$ | $R^3$ | $R^4$ | W | X | Y |
|---|---|---|---|---|---|---|---|
| I-26 | $C_6H_5$ | H | H | $OCOCH_3$ | 1 | $OCOCH_2CH_3$ | C |
| I-27 | $C_4H_4CO_2H$ | H | H | $OCOCH_3$ | 1 | $OCOCH_3$ | C |
| I-28 | H | $CH_2OH$ | $CO_2H$ | $O^-$ | 0 | — | C |
| I-29 | $SO_2CH_3$ | H | H | $OCOCH_3$ | 1 | $OCOCH_3$ | C |
| I-30 | Cl | CN | $CO_2H$ | $O^-$ | 0 | — | C |
| I-31 | $CF_3$ | $OCH_3$ | H | $OCOCH_3$ | 1 | $OCOCH_3$ | C |
| I-32 | $CO_2H$ | $CO_2H$ | H | $OCOCH_3$ | 1 | $OCOCH_3$ | C |
| I-33 | H | H | H | $OCOCH_3$ | 1 | $OCOCH_3$ | N |
| I-34 | H | H | H | $OCOCF_3$ | 1 | $OCOCF_3$ | N |
| I-35 | H | COOH | COOH | $O^-$ | 1 | $OCOCH_3$ | N |
| I-36 | H | CN | COOH | $O^-$ | 0 | — | N |
| I-37 | 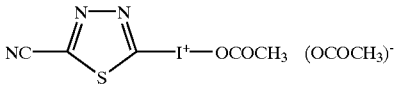 | | | | | | |
| I-38 | 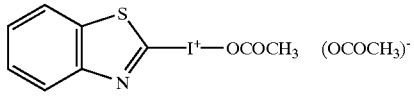 | | | | | | |

The compound releasing a labile species other than a halogen atom, such as represented by formula [2] or [3] is incorporated preferably in an amount of 0.001 to 0.1 mol/$^2$, and more preferably 0.005 to 0.05 mol/m$^2$. The compound may be incorporated into any component layer of the photothermographic material relating to the invention and is preferably incorporated in the vicinity of a reducing agent.

As a compound capable of deactivating a reducing agent to inhibit reduction of an organic silver salt to silver by the reducing agent are preferred compounds releasing a labile species other than a halogen atom. However, these compounds may be used in combination with a compound capable of releasing a halogen atom as a labile species.

Examples of the compound releasing an active halogen atom include a compound represented by the following formula [4]:

formula [4]

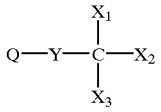

wherein Q is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(=O)—, —SO— or —$SO_2$—. The aryl group represented by Q may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group. The heterocyclic group represented by Q is a 3- to 10-membered, saturated or unsaturated heterocyclic group containing at least one of N, O and S, which may be a monocyclic or condensed with another ring to a condensed ring.

The heterocyclic group is preferably a 5- or 6-membered unsaturated heterocyclic group, which may be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed. Exemplary examples of heterocyclic rings included in the heterocyclic group include imidazole, pyrazole, pyridine, pyrimidine, pyrazine, pyridazine, triazole, triazines, indole, indazole, purine, thiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these are preferred imidazole, pyridine, pyrimidine, pyrazine, pyridazine, triazole, triazines, thiadiazole, oxadiazole, quinoline, phthalazine, naphthylizine, quinoxaline, quinazoline, cinnoline, tetrazole, thiazole, oxazole, benzimidazole, and tetrazaindene; more preferably imidazole, pyrimidine, pyridine, pyrazine, pyridazine, triazole, triazines, thiadiazole, quinoline, phthalazine, naphthyridine, quinoxaline, quinazoline, cinnoline, tetrazole, thiazole, benzimidazole, and benzthiazole; and still more preferably pyridine, thiazole, quinoline and benzthiazole.

The aryl group or heterocyclic group represented by Q may be substituted by a substituent, in addition to —Y—C($X_1$)($X_2$)($X_3$). Preferred examples of the substituent include an alkyl group, an alkenyl group, an aryl group, an alkoxyl group, an aryloxyl group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, phosphoramido group, a halogen atom, cyano group, sulfo group, carboxy group, nitro group and heterocyclic group. Of these are preferred an alkyl group, an aryl group, an alkoxyl group, an aryloxyl group, an acyl group, an acylamino group, an aryloxyl group, acyl group, an acylamino group, an alkoxycarbonyl group, an aryloxycarbonylamino group, a sulfonylamino group, a sulfamoyl group, a carbamoyl group, a ureido group, phosphoramido group, a halogen atom, cyano group, nitro group, and a heterocyclic group; and more preferably an alkyl group, an aryl group, an alkoxyl group, an aryloxyl group, an acyl group, an acylamino group, a sulfonylamino group, a sulfamoyl group, a carbamoyl group, a halogen group, cyano group, nitro group and a heterocyclic group; and still more preferably an alkyl group, an aryl group and a halogen atom. $X_1$, $X_2$ and $X_3$ are preferably a halogen atom, a haloalkyl group, an acyl group, an alkoxycarbonyl group, an aryloxycarbonyl group, a carbamoyl group, a sulfamoyl group, a sulfonyl group, and a heterocyclic group, more preferably a halogen atom, a haloalkyl group, an acyl group, an alkoxycarbonyl group, an aryloxycarbonyl group, and a sulfonyl group; and still more preferably a halogen atom and trihalomethyl group; and most preferably a halogen atom. Of halogen atoms are preferably chlorine atom, bromine and iodine atom, and more preferably chlorine atom and bromine atom, and still more preferably bromine atom. Y is —C(=O)—, —SO—, and —$SO_2$—, and preferably —$SO_2$—.

Preferred examples of the compound represented by formula [4] are shown below.

4-1

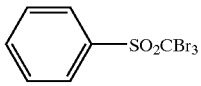

4-2

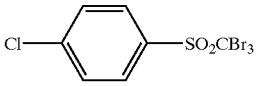

4-3

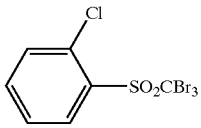

4-4

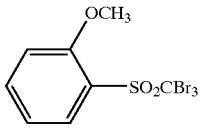

4-5

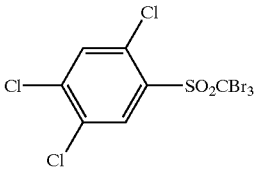

4-6

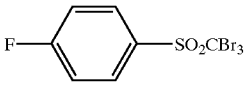

-continued 4-7

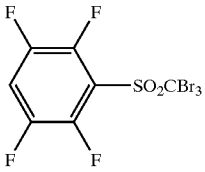

4-8

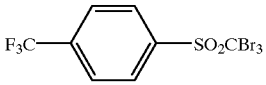

4-9

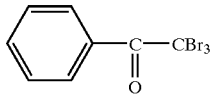

4-10

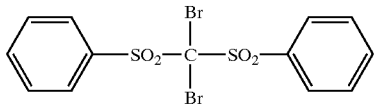

4-11

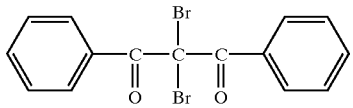

4-12

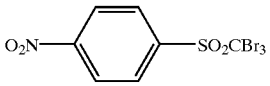

4-13

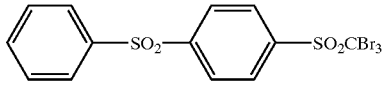

4-14

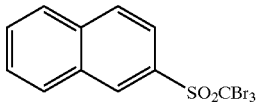

4-15

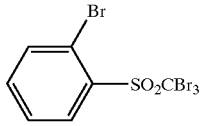

4-16

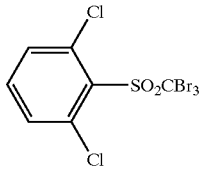

4-17

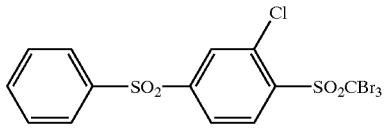

4-18

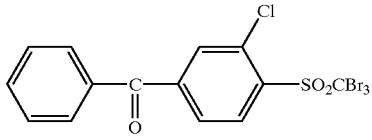

-continued
4-19
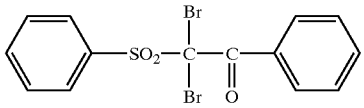
4-20
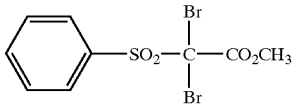
4-21
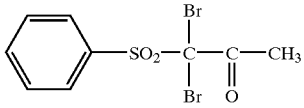
4-22
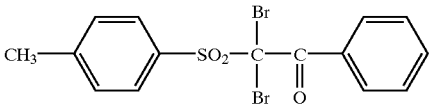
4-23
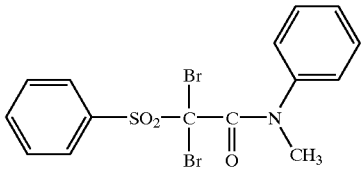
4-24
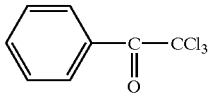
4-25
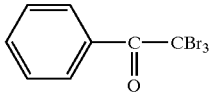
4-26
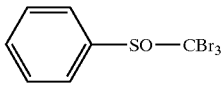
4-27
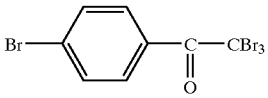
4-28
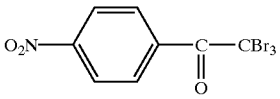
4-29
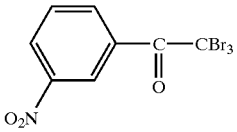
4-30
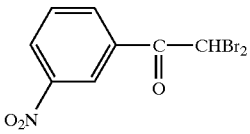
-continued
4-31
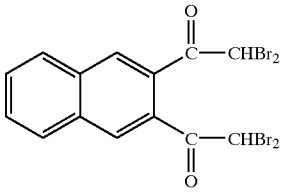
4-32
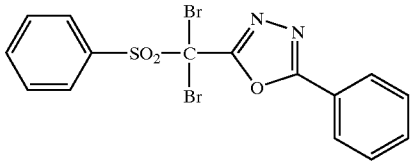
4-33
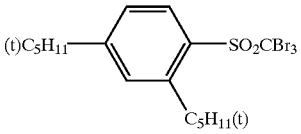
4-34
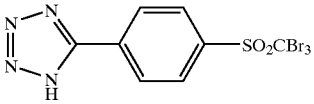
4-35
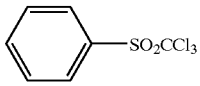
4-36
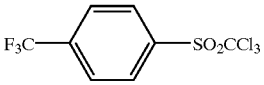
4-37
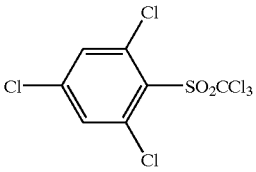
4-38
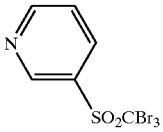
4-39
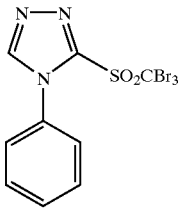
4-40
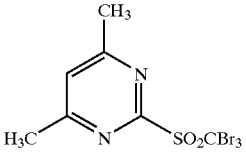

-continued
4-41
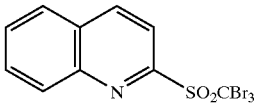
4-42
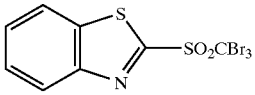
4-43
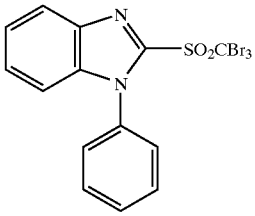
4-44
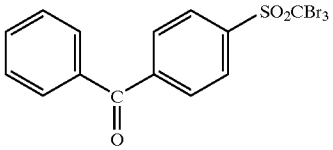
4-45
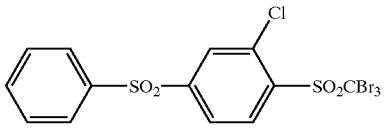
4-46
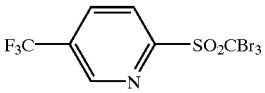
4-47
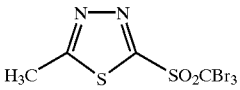
4-48
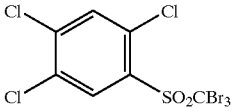
4-49
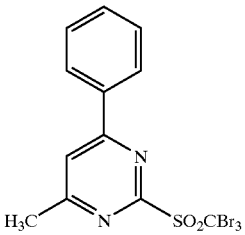
4-50
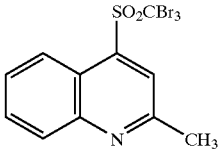
4-51
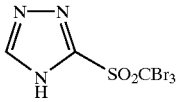
-continued
4-52
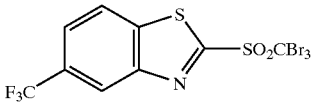
4-53
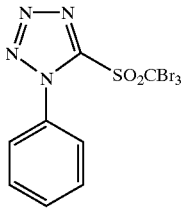
4-54
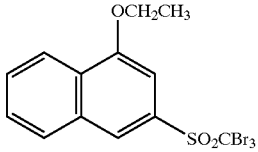
4-55
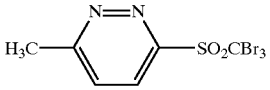
4-56
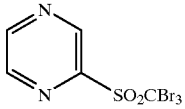
4-57
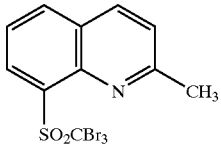
4-58
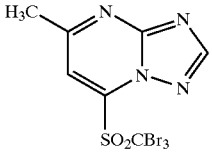
4-59
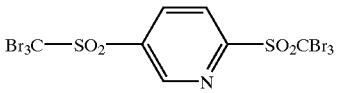
4-60
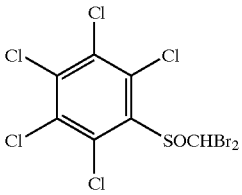
4-61
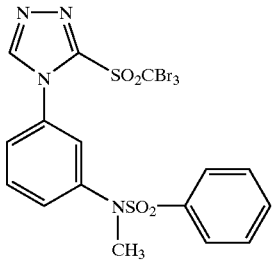

-continued 4-62

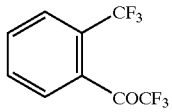

4-63

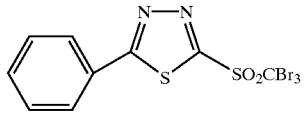

4-64

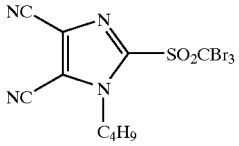

The amount of this compound to be incorporated is preferably within the range in which an increase of printed-out silver caused by formation of silver halide becomes substantially no problem, more preferably not more than 150% by weight and still more preferably not more than 100% by weight, based on the compound releasing no active halogen atom.

Further, in addition to the foregoing compounds, compounds commonly known as an antifoggant may be incorporated in the photothermographic imaging material used in the invention. In such a case, the compounds may be those which form a labile species similarly to the foregoing compounds or those which are different in antifogging mechanism. Examples thereof include compounds described in U.S. Pat. Nos. 3,589,903, 4,546,075 and 4,452,885; JP-A No. 59-57234; U.S. Pat. Nos. 3,874,946 and 4,756,999; and JP-A Nos. 9-288328 and 9-90550. Further, other antifoggants include, for example, compounds described in U.S. Pat. No. 5,028,523 and European Patent Nos. 600,587, 605,981 and 631,176.

Reducing agents are incorporated into the photothermographic material of the present invention. Examples of suitable reducing agents are described in U.S. Pat. Nos. 3,770,448, 3,773,512, and 3,593,863, and Research Disclosure Items 17029 and 29963, and an optimum reducing agent can be used by the selection from those commonly known in the art. In cases where fatty acid silver salts are used as an organic silver salt, polyphenols in which at least two phenyl groups are linked through an alkylene group or a sulfur atom and specifically, bisphenols in which two phenyl groups which are substituted, at the position adjacent to the hydroxy group-substituted position, with at least an alkyl group (e.g., methyl, ethyl, propyl, t-butyl, cyclohexyl, etc.) or an acyl group (e.g., acetyl, propionyl, etc.) are linked through an alkylene group or a sulfur atom. For example, the compound represented by the following formula(A) is preferred:

formula (A)

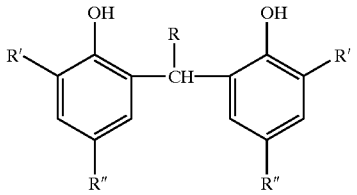

wherein R represents a hydrogen atom or an alkyl group having from 1 to 10 carbon atoms (for example, isopropyl, —$C_4H_9$, 2,4,4-trimethylpentyl), and R' and R" each represent an alkyl group having from 1 to 5 carbon atoms (for example, methyl, ethyl, t-butyl).

In addition to the foregoing compounds, examples of the reducing agents include polyphenol compounds described in U.S. Pat. No. 3.589,903 and 4,021,249; British Patent No. 1,486,148; JP-A Nos. 51-51933, 50-36110, 50-116023 and 52-84727; JP-B No. 51-35727 (hereinafter, the term, JP-B means a published Japanese Patent); bisnaphthols described in U.S. Pat. No. 3,672,904, such as 2,2'-dihydroxy-1,1'-binaphthyl and 6,6'-dibromo-2,2'-dihydoxy-1,1'-binaphthyl; sulfonamidophenols and sulfonamidonaphthols described in U.S. Pat. No. 3,801,321, such as 4-benzenesulfonamidophenol, 2-benzenesulfonamidophenol, 2,6-dichloro-4-benzenesulfonamidophenol and 4-benzenesulfonamidonaphthol.

The amount of a reducing agent to be used, such as the compound represented by formula (A) is preferably $1\times10^{-2}$ to 10 mol and more preferably $1.5\times10^{-2}$ to 1.5 mol per mol silver.

The amount of the reducing agent used in the photothermographic imaging material is variable depending on the kind of an organic silver salt or reducing agent and is usually 0.05 to 10 mol, and preferably 0.1 to 3 mol per mol of organic silver salt. Two or more reducing agents may be used in combination, in an amount within the foregoing range. Addition of the reducing agent to a light sensitive emulsion comprising a light sensitive silver halide, organic silver salt grains and a solvent immediately before coating the emulsion is often preferred, thereby minimizing variation in photographic performance during standing.

Silver halide grains used in the invention can be subjected to chemical sensitization. In accordance with methods described in Japanese Patent Application Nos. 2000-57004 and 2000-61942, for example, a chemical sensitization center (chemical sensitization speck) can be formed using compounds capable of releasing chalcogen such as sulfur or noble metal compounds capable of releasing a noble metal ion such as a gold ion. In the invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Specifically preferred of these is at least a compound having a structure in which a chalcogen atom is attacked to a carbon or phosphorus atom through a double bond. The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 30° C.

In photothermographic imaging materials used in the invention, it is preferred to use a light sensitive emulsion, in which light sensitive silver halide has been subjected to chemical sensitization using a chalcogen atom-containing organic sensitizer at a temperature of 30° C. or higher, concurrently in the presence of an oxidizing agent capable of oxidizing silver specks formed on the silver halide grains, then, mixed with an organic silver salt, dehydrated and dried.

Chemical sensitization using the foregoing organic sensitizer is also preferably conducted in the presence of a spectral sensitizing dye or a heteroatom-containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

As described earlier, silver halide grains can be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3. Silver halide to be subjected to chemical sensitization may be one which has been prepared in the presence of an organic silver salt, one which has been formed under the condition in the absence of the organic silver salt, or a mixture thereof.

Light sensitive silver halide grains used in the invention are preferably subjected to spectral sensitization by allowing a spectral sensitizing dye to adsorb to the grains. Examples of the spectral sensitizing dye include cyanine, merocyanine, complex cyanine, complex merocyanine, holo-polar cyanine, styryl, hemicyanine, oxonol and hemioxonol dyes, as described in JP-A Nos. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

Specifically, preferred sensitizing dyes are dyes represented by the following formulas (S1) through (S4):

Formula (S1)

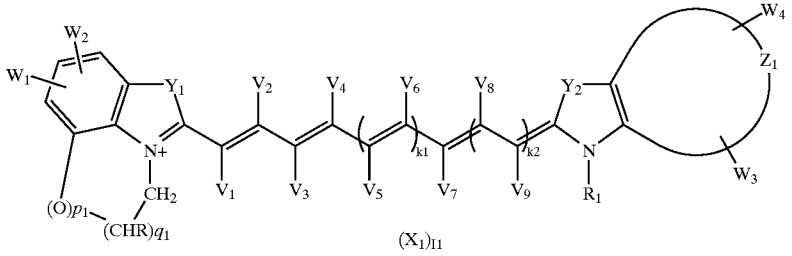

-continued

Formula (S2)

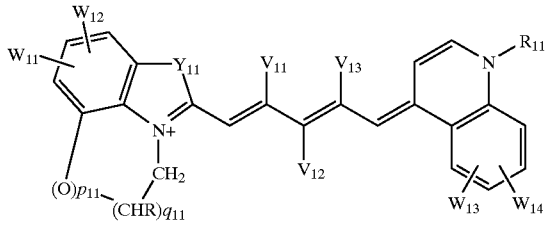

$(X_{11})_{l11}$

Formula (S3)

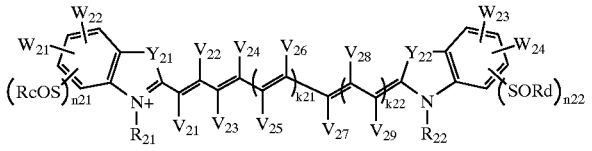

$(X_{21})_{l21}$

Formula (S4)

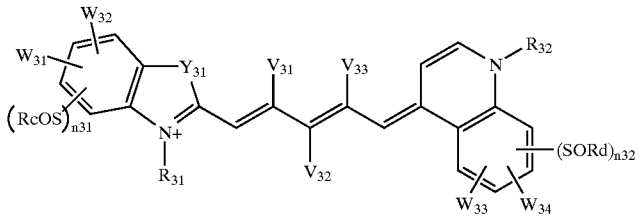

$(X_{31})_{l31}$

In formulas (S1) through (S4), $Y_1$, $Y_2$, $Y_{11}$, $Y_{21}$, $Y_{22}$ and $Y_{31}$ each are independently an oxygen atom, a sulfur atom, a selenium atom, —C(Ra)(Rb)— group or —CH═CH— group, in which Ra and Rb each are a hydrogen atom, an alkyl group (preferably having 1 to 5 carbon atoms) or a non-metallic atom group necessary to form an aliphatic spiro ring; $Z_1$ is a non-metallic atom group necessary to form a 5- or 6-membered ring; $R_1$, $R_{11}$, $R_{21}$, $R_{22}$, $R_{31}$ and $R_{32}$ each are an aliphatic group or a non-metallic atom group necessary to form a condensed ring between $R_1$ and $W_3$ or between $R_{11}$ and $W_{14}$; Rc and Rd each are independently an unsubstituted lower alkyl group, a cycloalkyl group, an aralkyl group, an aryl group or a heterocyclic group; $W_1$, $W_2$, $W_3$, $W_4$, $W_{11}$, $W_{12}$, $W_{13}$, W14, $W_{21}$, $W_{22}$, $W_{23}$, $W_{24}$, $W_{31}$, $W_{32}$, $W_{33}$ and $W_{34}$ each are independently a hydrogen atom, a substituent or a non-metallic atom group necessary to form a condensed ring by bonding between $W_1$ and $W_2$, $W_{11}$, and $W_{12}$, $W_{21}$ and $W_{22}$, $W_{23}$ and $W_{24}$, $W_{31}$ and $W_{32}$, or $W_{33}$ and $W_{34}$; $V_1$ to $V_9$, $V_{11}$ to $V_{13}$, $V_{21}$ to $V_{29}$, and $V_{31}$ to $V_{33}$ each are independently a hydrogen atom, a halogen atom, an amino group, an alkylthio group, an arylthio group, a lower alkyl group, a lower alkoxyl group, an aryl group, an aryloxyl group, a heterocyclic group or a non-metallic atom group necessary to form a 5- to 7-membered ring by bonding between $V_1$ and $V_3$, $V_2$ and $V_4$, $V_3$ and $V_5$, $V_2$ and $V_6$, $V_5$ and $V_7$, V6 and $V_8$, $V_7$ and $V_9$, $V_{11}$, and V13, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, or $V_{31}$ and $V_{33}$; $X_{21}$ and $X_{31}$, provided that at least one of $V_1$ to $V_9$ and at least one of $V_{11}$ to $V_{13}$ are a group other than a hydrogen atom; $X_1$, $X_{11}$, $X_{21}$ and $X_{31}$ each are an ion necessary to compensate for an intramolecular charge; l1, l11, l21 and l31 each an ion necessary to compensate for an intramolecular charge; k1, k2, k31 and k32 each are 0 or 1; n21, n22, n31 and n32 each are 0, 1 or 2;, provided that n1 and n22, and n31 and n32 are not 0 at the same time; p1 and p11 are each 0 or 1; q1 and q11 each are 1 or 2, provided that the sum of p1 and q1 and the sum of p11 and q11 each are respectively not more than 2.

Of formulas (S1) and (S2), a compound represented by the following formula (S1—1) or (S2-1) is more preferred:

Formula (S1-1)

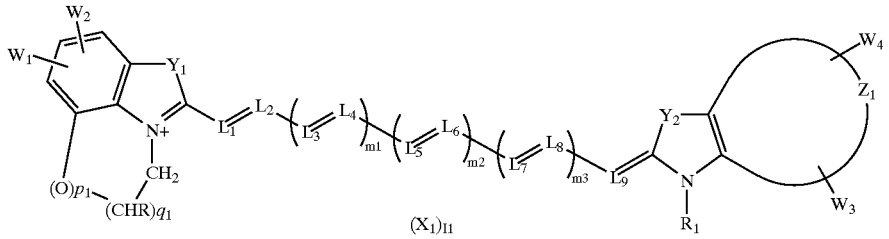

$(X_1)_{l1}$

-continued

Formula (S2-1)

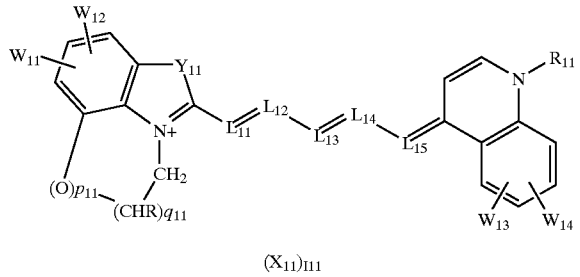

wherein $Y_1$, $Y_2$ and $Y_1l$ each are independently an oxygen atom, a sulfur atom, a selenium atom, —C(Ra)(Rb)— group or —CH=CH— group, in which Ra and Rb each are a hydrogen atom, a lower alkyl group or an atomic group necessary to form an aliphatic spiro ring when Ra and Rb are linked with each other; $Z_1$ is an atomic group necessary to form a 5- or 6-membered ring; R is a hydrogen atom, a lower alkyl, a cycloalkyl group, an aralkyl group, a lower alkoxy group, an aryl group, a hydroxy group or a halogen atom; $W_1$, $W_2$, $W_3$, $W_4$, $W_{11}$, $W_{12}$, $W_{13}$ and $W_{14}$ each are independently a hydrogen atom, a substituent or a non-metallic atom group necessary to form a condensed ring by bonding between $W_1$ and $W_2$ or $W_{11}$ and $W_{12}$; $R_1$ and $R_{11}$ are each an aliphatic group or a non-metallic atom group necessary to form a condensed ring by bonding between $R_1$ and $W_3$ or $R_{11}$, and $W_{14}$; $L_1$ to $L_9$, and $L_{11}$ to $L_{15}$ each are independently a methine group; $X_1$ and $X_{11}$ each are an ion necessary to compensate for an intramolecular charge; l1 and l11 each an ion necessary to compensate for an intramolecular charge; m1 to m3 each are 0 or 1; p1 and p11 are each 0 or 1; q1 and q11 each are 1 or 2, provided that the sum of p1 and q1 and the sum of p11 and q11 are respectively not more than 2.

Substituents will be further described. Thus, substituents of the compounds represented by formulas (S1), (S2), (S1-1), (S2-1), (S3), and (S4) will be explained below.

The 5- or 6-membered condensed rings completed by an atomic group represented by $Z_1$ include a condensed cyclohexene ring, a condensed benzene ring, a condensed thiophene ring, a condensed pyridine ring, and a condensed naphthalene ring. Exemplary examples thereof include a benzoxazole ring, tetrahydrobenzoxazole ring, naphthooxazole ring, benzonephthooxazole ring, benzothiazole ring, tetrahydrobenzothiazole ring, naphthothiazole ring, benzonaphthothiazole ring; thienothiazole ring, thianaphthenothiazole ring, pyridothiazole ring, benzoselenazole ring, tetrahydrobenzoselenazole ring, naphthoselenazole ring, benzonaphthoselenazole ring, quinoline ring, 3,3-dialkylindolenine and 3,3-dialkylpyridopyrroline. Any substituent such as one represented by $W_1$ to $W_4$ described later can be substituted on the ring described above.

Examples of the aliphatic group represented by $R_1$, $R_{11}$, $R_{21}$, $R_{22}$, $R_{31}$, and $R_{32}$ include a branched or straight-chained alkyl group having 1 to 10 carbon atoms (e.g., methyl, ethyl, propyl, butyl, pentyl, 1-pentyl, 2-ethyl-hexyl, octyl, decyl), an alkenyl group having 3 to 10 carbon atoms (e.g., 2-propenyl, 3-butenyl, 1-methyl-3-propenyl, 3-pentenyl, 1-methyl-3-butenyl, 4-hexenyl), and an aralkyl group having 7 to 10 carbon atoms (e.g., benzyl, phenethyl). These groups may further be substituted with a substituent, including groups such as a lower alkyl group (preferably having 1 to 5 carbon atoms, e.g., methyl, ethyl, propyl), a halogen atom (e.g., fluorine atom, chlorine atom, or bromine atom), a vinyl group, an aryl group (e.g., phenyl, p-tolyl, p-bromophenyl), trifluoromethyl, an alkoxyl group (e.g., methoxy, ethoxy, methoxyethoxy), an aryloxyl group (e.g., phenoxy, p-tolyloxy), cyano, a sulfonyl group (e.g., methanesulfonyl, trifluoromethansulfonyl), p-toluenesulfonyl), an alkoxycarbonyl group (e.g., ethoxycarbonyl, butoxycarbonyl), an amino group (e.g., amino, biscarboxymethylamino), an aryl group (e.g., phenyl, carboxyphenyl), a heterocyclic group (e.g., tetrahydrofurfuryl, 2-pyrrolidinone-1-yl), an acyl group (e.g., acetyl, benzoyl), an ureido group (e.g., ureido, 3-methylureido, 3-phenylureido), a thioureido group (e.g., thioureido, 3-methylthioureido), an alkylthio group (e.g., methylthio, ethylthio), an arylthio group (e.g., phenylthio), a heterocyclic-thio group (e.g., 2-thienythio, 3-thienylthio, 2-imidazolylthio), a carbonyloxy group (e.g., acetyloxy, propanoyloxy, benzoyloxy), an acylamino group (e.g., acetylamino, benzoylamino); and hydrophilic groups, such as a sulfo group, a carboxy group, a phosphono group, a sulfate group, hydroxy, mercapto, sulfino group, a carbamoyl group (e.g., carbamoyl, n-methylcarbamoyl, N,N-tetramethylene-carbamoyl), a sulfamoyl group (e.g., sulfamoyl, N,N-3-oxapentamethylenaminosulfonyl), a sulfonamido group (e.g., methanesulfonamido, butanesulfoneamido), a sulfonylamino-carbonyl group(e.g., methanesulfonylamino-carbonyl, ethanesulfonylaminocarbonyl), an acylaminosulfonyl group (e.g., acetoamidosulfonyl, methoxyacetoamidosulfonyl), an acylaminocarbonyl group (e.g., acetoamidocarbonyl, methoxyacetoamidocarbonyl), and a sulfinylaminocarbonyl group (e.g., methasulfinylaminocarbonyl, ethanesulfinylaminocarbonyl). Examples of aliphatic groups substituted by a hydrophilic group include carboxymethyl, carboxypentyl, 3-sulfatobutyl, 3-sulfopropyl, 2-hydroxy-3-sulfopropyl, 4-sulfobutyl, 5-sulfopentyl, 3-sulfopentyl, 3-sulfinobutyl, 3-phosphonopropyl, hydroxyethyl, N-methanesulfonylcarbamoylmethyl, 2-carboxy-2-propenyl, o-sulfobenzyl, p-sulfobenzyl and p-carboxybenzyl.

The lower alkyl group represented by R include a straight-chained or branched one having 1 to 5 carbon atoms, such as methyl, ethyl, propyl, pentyl and isopropyl. The cycloalkyl group includes, e.g., cyclopropyl, cyclobutyl and cyclopentyl. The aralkyl group includes, e.g., benzyl, phenethyl, p-methoxyphenylmethyl and o-acetylaminophenylethyl; the lower alkoxyl group includes one having 1 to 4 carbon atoms, including methoxy, ethoxy, propoxy and 1-propoxy; the aryl group includes substituted or unsubstituted one, such as phenyl, 2-naphthyl, 1-naphthyl, o-tolyl, o-methoxyphenyl, m-chlorophenyl, m-bromophenyl, p-tolyl and p-ethoxyphenyl. These groups may be substituted by a substituent group, such as a phenyl group, a halogen atom (e.g., fluorine atom, chlorine atom, bromine atom, iodine atom), an alkoxy group or hydroxy.

The lower alkyl group represented by Ra or Rb are the same as defined in R.

The lower alkyl group represented by Rc, and Rd includes a straight-chained or branched one having 1 to 5 carbon atoms, such as methyl, ethyl, propyl, pentyl and isopropyl. The cycloalkyl group includes, e.g., cyclopropyl, cyclobutyl and cyclopentyl. The aralkyl group includes, e.g., benzyl, phenethyl, p-methoxyphenylmethyl and o-acetylaminophenyl-ethyl; the aryl group includes substituted or unsubstituted one, such as phenyl, 2-naphthyl, 1-naphthyl, o-tolyl, o-methoxyphenyl, m-chlorophenyl, m-bromophenyl, p-tolyl and p-ethoxyphenyl; and the heterocyclic group includes substituted or unsubstituted one, such as 2-furyl, 5-methyl-2-furyl, 2-thienyl, 2-imidazolyl, 2-methyl-1-imidazolyl, 4-phenyl-2-thiazolyl, 5-hydroxy-2-benzothiazolyl, 2-pyridyl and 1-pyrrolyl. These groups, as described above, may be substituted by a substituent group, such as a phenyl group, a halogen atom, an alkoxy group or hydroxy.

Examples of the substituents represented by $W_1$ to $W_4$, $W_{11}$ to $W_{14}$, $W_{21}$ to $W_{24}$, $W_{31}$ to $W_{34}$, $W_{41}$ to $W_{44}$ and $W_{51}$ to $W_{54}$ include an alkyl group (e.g., methyl, ethyl, butyl, I-butyl), an aryl group (including monocyclic and polycyclic ones such as phenyl and naphthyl), a heterocyclic group (e.g., thienyl, furyl, pyridyl, carbazolyl, pyrrolyl, indolyl), a halogen atom (e.g., fluorine atom, chlorine atom, bromine atom, iodine atom), a vinyl group, trifluoromethyl, an alkoxyl group (e.g., methoxy, ethoxy, methoxyethoxy), an aryloxyl group (e.g., phenoxy, p-tolyloxy), a sulfonyl group (e.g., methanesulfonyl, p-toluenesulfonyl), an alkoxycarbonyl group (e.g., ethoxycarbonyl, ethoxycarbonyl), an amino group (e.g., amino, biscarboxymethylamino), an acyl group (e.g., acetyl, benzoyl), an ureido group (e.g., ureido, 3-methylureido), a thioureido group (e.g., thioureido, 3-methylthioureido), an alkylthio group (e.g., methylthio, ethylthio), an alkenyl thio group, an arylthio group (e.g., phenylthio), hydroxy and styryl.

These groups may be substituted by the same substituents as described in the aliphatic group represented by $R_1$. Examples of substituted alkyl group include 2-methoxyethyl, 2-hydroxyethyl, 3-ethoxycarbonylpropyl, 2-carbamoylethyl, 2-methanesulfonylethyl, 3-methanesulfonylaminopropyl, benzyl, phenethyl, carboxymethyl, carboxymethyl, allyl, and 2-furylethyl. Examples of substituted aryl groups include p-carboxyphenyl, p-N,N-dimethylaminophenyl, p-morpholinophenyl, p-methoxyphenyl, 3,4-dimethoxyphenyl, 3,4-methylene-dioxyphenyl, 3-chlorophenyl, and p-nitrophenyl. Further, examples of substituted heterocyclic group include 5-chloro-2-pyridyl, 2-ethoxycarbonyl-2-pyridyl and 5-carbamoyl-2-pyridyl. $W_1$ and $W_2$, $W_3$ and $W_4$, $W_{11}$ and $W_{12}$, $W_{13}$ and $W_{14}$, $W_{21}$ and $W_{22}$, $W_{23}$ and $W_{24}$, $W_{31}$ and $W_{32}$, $W_{33}$ and $W_{34}$ each pair may combine to form a condensed ring, such as 5- or 6-membered saturated or unsaturated condensed carbon rings, which are further substituted by substituents as described in the aliphatic group.

Among the groups represented by $V_1$ to $V_9$, $V_{11}$ to $V_{13}$, $V_{21}$ to $V_{29}$, and $V_{31}$ to $V_{33}$, the halogen atom includes, e.g., a fluorine atom, chlorine atom, bromine atom and iodine atom; the amino group includes, e.g., amino, dimethylamino, diphenylamino, and methylphenylamino; the alkylthio group includes substituted and substituted ones, such as phenylthio or m-fluorophenylthio; the lower alkyl group includes straight-chained or branched one having five or less carbon atoms, such as methyl, ethyl, propyl, butyl, pentyl or isopropyl; the lower alkoxyl group includes one having four or less carbon atoms, such as methoxy, ethoxy, propoxy, or iso-propoxy; the aryl group includes substituted and unsubstituted ones, such as phenyl, 2-naphthyl, 1-naphthyl, o-tolyl, o-methoxyphenyl, m-chlorophenyl, m-bromophenyl, p-tolyl, and p-ethoxy phenyl; the aryloxyl group includes substituted and unsubstituted ones, such as phenoxy, p-tolyloxy, and m-carboxyphenyloxy; and the heterocyclic group includes substituted or unsubstituted ones, such as 2-furyl, 5-methyl-2-furyl2-thienyl, 2-imidazolyl, 2-methyl-1-imidazolyl, 4-phenyl-2-thiazolyl, 5-hydroxy-2-benzothiazolyl, 2-pyridyl, and 1-pyrrolyl. These groups may further be substituted by a substituent group, such as a phenyl group, a halogen atom, alkoxyl group, or hydroxy. $V_1$ and $V_3$, $V_2$ and $V_4$, $V_3$ and $V_5$, $V_4$ and $V_6$, $V_5$ and $V_7$, $V_6$ and $V_8$, $V_7$ and $V_9$, $V_{11}$, and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, and $V_{31}$ and $V_{33}$ each pair may combine to form a 5- to 7-membered ring, such as a cyclopentene ring, cyclohexene ring, cycloheptene ring, and decalin ring, each of which may further be substituted by a lower alkyl group, lower alkoxyl group or aryl group, as described in R.

The methylene group represented by $L_1$ to $L_9$, $L_1$l to $L_{15}$ each are a substituted or unsubstituted methylene group. Examples of the substituent thereof include fluorine and chlorine atoms, a substituted or unsubstituted lower alkyl group(e.g., methyl, ethyl, I-propyl, benzyl), and a substituted or unsubstituted alkoxyl group (e.g., methoxy, ethoxy), a substituted or unsubstituted aryloxyl group (e.g., phenoxy, naphthoxy), a substituted or unsubstituted aryl group (e.g., phenyl, naphthyl, p-tolyl, o-carboxyphenyl), $N(U_1)$ $(U_2)$, —SRg, a substituted or unsubstituted heterocyclic group [e.g., 2-thienyl, 2-furyl, N,N'-bis(methoxyethyl)-barbituric acid], in which Rg is a lower alkyl group (preferably having 1 to 5 carbon atoms), an aryl group or a heterocyclic group and examples of —SRg include methylthio, ethylthio, benzylthio, phenylthio and tolylthio groups; $U_1$ and $U_2$ are each a substituted or unsubstituted lower alkyl group or aryl group, provided that $V_1$ and $V_2$ may combine to form a 5- or 6-membered nitrogen containing heterocyclic ring (e.g., pyrazole ring, pyrrol ring, pyrrolidine ring, morpholine ring, piperidine ring, pyridine, pyrimidine ring, etc.). Methylene groups which are adjacent or distant by one may combine to form a 5- or 6-membered ring.

In cases where the compound represented by formula (1), (1-1), (2-1), (3) or (4) is substituted with a cationic- or anionic-charged group, a counter ion is formed by an anionic or cationic equivalent to compensate an intramolecular charge. As an ion necessary to compensate the intramolecular charge, which is represented by $X_1$, $X_{11}$, $X_{21}$, or $X_{31}$, examples of cations include a proton, an organic ammonium ion (e.g., triethylammonium, triethanolammonium) and inorganic cations (e.g., lithium, sodium and potassium cations); and examples of acid anions include halide ions (e.g., chloride ion, bromide ion, iodide ion), p-toluenesulfonate ion, perchlorate ion, tetrafluoroborate ion, sulfate ion, methylsulfate ion, ethylsulfate ion, methanesulfonate ion, trifluoromethanesulfonate ion).

The infrared sensitizing dye according to the invention is preferably a dye characterized in that a three ring-condensed heterocyclic nucleus is formed by bonding between a nitrogen atom contained in a benzothiazole ring and a carbon atom at a peri-position; or that the dye is a long chain polymethine dye, in which a sulfonyl group is substituted on the benzene ring of the benzothiazole ring.

The infrared sensitizing dyes and spectral sensitizing dyes described above can be readily synthesized according to the methods described in F. M. Hammer, The Chemistry of Heterocyclic Compounds vol.18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed onto silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization. A supersensitizing compound, such as a dye which does not exhibit spectral sensitization or substance which does not substantially absorb visible light may be incorporated, in combination with a sensitizing dye, into the emulsion containing silver halide grains and organic silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (6) is preferred as a supersensitizer:

Ar—SM formula (6)

wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar [7]

wherein Ar is the same as defined in the mercapto compound represented by the formula described earlier.

The aromatic heterocyclic rings described above may be substituted with a halogen atom (e.g., Cl, Br, I), a hydroxy group, an amino group, a carboxy group, an alkyl group (having one or more carbon atoms, and preferablyl to 4 carbon atoms) or an alkoxy group (having one or more carbon atoms, and preferablyl to 4 carbon atoms).

In addition to the foregoing supersensitizers, a compound described in Japanese Patent Application No. 2000-70296, represented by the following formula (TU) and a macrocyclic compound can also employed as a supersensitizer in the invention:

formula (TU)

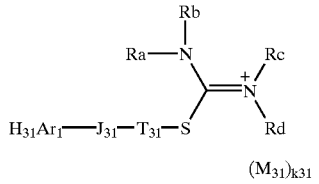

The bivalent, aliphatic hydrocarbon linkage group represented by $T_{31}$ include a straight-chain, branched cyclic alkylene group (preferably having 1 to 20 carbon atoms, more preferably 1 to 16 carbon atoms, and still more preferably 1 to 12 carbon atoms), an alkenylene group (preferably having 2 to 20 carbon atoms, more preferably 2 to 16 carbon atoms, and still more preferably 2 to 12 carbon atoms), an alkynylene group (preferably having 2 to 20 carbon atoms, more preferably 2 to 16 carbon atoms, and still more preferably 2 to 12 carbon atoms), each of which may be substituted by substituent group(s). The aliphatic hydrocarbon group represented by Ra, Rb, Rc, Rd, Re and Rf include, for example, an alkyl group (preferably having 1 to 20 carbon atoms, more preferably 1 to 16 carbon atoms and still more preferably 1 to 12 carbon atoms), an alkenyl group (preferably having 2 to 20 carbon atoms, more preferably 2 to 16 carbon atoms, and still more preferably 2 to 12 carbon atoms), an alkynyl (preferably having 2 to 20 carbon atoms, more preferably 2 to 16 carbon atoms, and still more preferably 2 to 12 carbon atoms) an aryl group (preferably having 6 to 30 carbon atoms, more preferably 6 to 20 carbon atoms, and still more preferably 6 to 12 carbon atoms, e.g., phenyl, naphthyl), and a heterocyclic group (e.g., 2-thiazolyl, 1-piperadynyl, 2-pyridyl, 3-pyridyl,2-thienyl, 2-benzimidazolyl, carbazolyl, etc.). The heterocyclic group may be a monocyclic ring or a ring condensed with other ring. These groups each may be substituted at any position. Examples of such substituent groups include an alkyl group (including a cycloalkyl group and an aralkyl group, and preferably having 1 to 20 carbon atoms, more preferably 1 to 12 carbon atoms and still more preferably 1 to 8 carbon atoms, such as methyl, ethyl, n-propyl, isopropyl, n-butyl, tert-butyl, n-heptyl, n-octyl, n-decyl, n-undecyl, n-hexadecyl, cyclopropyl, cyclopentyl, cyclohexyl, benzyl, phenethyl), an alkenyl group (preferably having 2 to 20 carbon atoms, more preferably 2 to 12 carbon atoms, and still more preferably 2 to 8 carbon atoms, e.g., vinyl, allyl, 2-butenyl, 3-pentenyl, etc.), an alkynyl (preferably having 2 to 20 carbon atoms, more preferably 2 to 12 carbon atoms and still more preferably 2 to 8 carbon atoms, e.g., propargyl, 3-pentynyl, etc.), aryl group (preferably having 6 to 30 carbon atoms, more preferably 6 to 20 carbon atoms, and still more preferably 6 to 12 carbon atoms, e.g., phenyl, p-tolyl, o-aminophenyl, naphthyl), an amino group (preferably having 0 to 20 carbon atoms, more preferably 0 10 carbon atoms, and still more preferably 0 to 6 carbon atoms, e.g., amino, methylamino, ethylamino, dimethylamino, diethylamino, diphenylamino, dibenzylamino, etc.), an imino group (preferably having 1 to 20 carbon atoms, more preferably 1 to 18 carbon atoms, and still more preferably 1 to 12 carbon atoms, e.g., methylimono, ethylimono, propylimino, phenylimino), an alkoxy group (preferably having 1 to 20 carbon atoms, more preferably 1 to 12 carbon atoms, and still more preferably 1 to 8 carbon atoms, e.g., methoxy, ethoxy, butoxy, etc.), an aryloxy group (preferably having 6 to 20 carbon atoms, more preferably 6 to 16 carbon atoms and still more preferably 6 to 12 carbon atoms, e.g., phenyloxy, 2-naphthyloxy, etc.), an acyl group (preferably having 1 to 20 carbon atoms, more preferably 1 to 16 carbon atoms, and still more preferably 1 to 12 carbon atoms, e.g., acetyl, formyl, pivaloyl, benzoyl, etc.), an alkoxycarbonyl group (preferably having 2 to 20 carbon atoms, more preferably 2 to 16 carbon atoms, and still more preferably 2 to 12 carbon atoms, e.g., methoxycarbonyl, ethoxycarbonyl, etc.), an aryloxycarbonyl group (preferably having 7 to 20 carbon atoms, more preferably 7 to 16 carbon atoms, and still more preferably 7 to 10 carbon atoms, e.g., phenyloxycarbonyl, etc.), an acyloxy group (preferably having 1 to 20 carbon atoms, more preferably 1 to 16 carbon atoms and still more preferably 1 to 10 carbon atoms, e.g., acetoxy, benzoyloxy, etc.), an acylamino group (preferably having 1 to 20 carbon atoms, more preferably 1 to 16 carbon atoms, and still more preferably 1 to 10 carbon atoms, e.g., acetylamino, benzoylamino, etc.), an alkoxycarbonylamino group (preferably having 2 to 20 carbon atoms, more preferably 2 to 16 carbon atoms, and still more preferably 2 to 12 carbon atoms, e.g., methoxycarbonylamino, etc.), an aryloxycarbonylamino group (preferably having 7 to 20 carbon atoms, more preferably 7 to 16 carbon atoms, and still more preferably 7 to 12 carbon atoms, e.g., phenyloxycarbonylamino, etc.), a sulfonylamino group (preferably having 1 to 20 carbon atoms, more preferably 1 to 16 carbon atoms, and still more preferably 1 to 12 carbon atoms, e.g., methanesulfonylamino, benzenesulfonylamino, etc.), a sulfamoyl group (preferably having 0 to 20 carbon atoms, more preferably 0 to 16 carbon atoms, and still more preferably 0 to 12 carbon atoms, e.g.,sulfamoyl, methylsulfamoyl, dimethylsulfamoyl, phenylsulfamoyl, etc.), a carbamoyl group (preferably having 1 to 20 carbon atoms, more preferably 1 to 16 carbon atoms, and still more preferably 1 to 12 carbon atoms, e.g., carbamoyl, methylcarbamoyl, diethylcarbamoyl, phenylcarbamoyl, etc.), an alkylthio group (preferably having 1 to 20 carbon atoms, more preferably 1 to 16 carbon atoms, and still more preferably 1 to 12 carbon atoms, e.g., methylthio, ethylthio, etc.), arylthio group (preferably having 6–20 carbon atoms, more preferably 6 to 16 carbon atoms and still more preferably 6 to 12 carbon atoms, e.g., phenylthio), an alkylsulfonyl or arylsulfonyl group (preferably having 1 to 20 carbon atom, more preferably 1 to 16 carbon atoms, and still more preferably 1 to 12 carbon atoms, e.g., methanesulfonyl, tosyl) an alkylsulfonyl or arylsulfinyl group (preferably having 1 to 20 carbon atoms, more preferably 1 to 16 carbon atoms, and still more preferably 1 to 12 carbon atoms, e.g., methanesulfinyl, benzenesulfinyl, etc.), an ureido group (preferably having 1 to 20 carbon atoms, more preferably 1 to 16 carbon atoms, and still more preferably 1 to 12 carbon atoms, e.g., ureido, methylureido, phenylureido, etc.), a phosphoric acid amido group (preferably having 1 to 20 carbon atoms, more preferably 1 to 16 carbon atoms, and still more preferably 1 to 12 carbon atoms, e.g., diethylphosphoric acid amido, phenylphosphoric acid amido, etc.), hydroxy group, mercapto group, a halogen atom (e.g., fluorine atom, chlorine atom, bromine atom, iodine atom), cyano group, sulfo group, sulfino group, carboxy group, phosphono group, phosphono group, nitro group, hydroxamic acid group, hydrazino group, and a heterocyclic group (e.g., imidazolyl, benzimidazolyl, thiazolyl, benzothiazolyl, carbazolyl, pyridyl, furyl, piperidyl, morphoryl. etc.).

Of these substituent groups described above, hydroxy group, mercapto group, sulfo group, sulfino group, carboxy group, phosphono group, and phosphino group include their salts. The substituent group may be further substituted. In this case, plural substituent may be the same or different. The preferred substituent groups include an alkyl group, aralkyl group, alkoxy group, aryl group, alkylthio group, acyl group, acylamino group, imino group, sulfamoyl group, sulfonyl group, sulfonylamino group, ureido group, amino group, halogen atom, nitro group, heterocyclic group, alkoxycarbonyl group, hydroxy group, sulfo group, carbamoyl group, and carboxy group. Specifically, an alkyl group, alkoxy group, aryl group, alkylthio group, acyl group, acylamino group, imino group, sulfonylamino group, ureido group, amino group, halogen atom nitro group, heterocyclic group, alkoxycarbonyl group, hydroxy group, sulfo group, carbamoyl group and carboxy group are more preferred; and an alkyl group, alkoxy group, aryl group, alkylthio group, acylamino group, imino group, ureido group, amino group, heterocyclic group, alkoxycarbonyl group, hydroxy group, sulfo group, carbamoyl group and carboxy group are still more preferred. The amidino group include a substituted one and examples of the substituent group include an alkyl group (e.g., methyl, ethyl, pyridylmethyl, benzyl, phenethyl, carboxybenzyl, aminophenylmethyl, etc.), an aryl group (e.g., phenyl, p-tolyl, naphthyl, o-aminophenyl, o-methoxyphenyl, etc.), and a heterocyclic group (e.g., 2-thiazolyl, 2-pyridyl, 3-pyridyl, 2-furyl, 3-furyl, 2-thieno, 2-imidazolyl, benzothiazolyl, carbazolyl, etc.).

Examples of a bivalent linking group containing at least one of an oxygen atom, sulfur atom and nitrogen atom, represented by $J_{31}$ include the following groups, which may be combined:

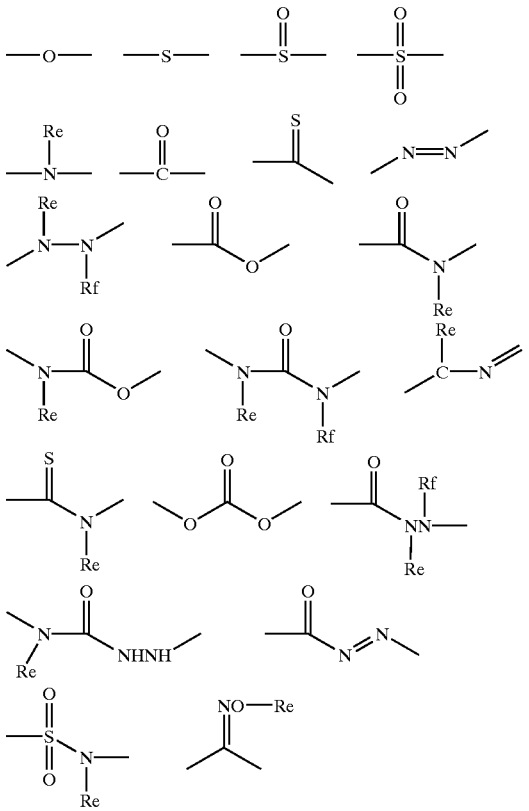

wherein Re and Rf are the same as defined in Ra through Rd.

The aromatic hydrocarbon group represented by $ArH_{31}$ is a monocyclic or condensed aryl group (preferably having 6 to 30 carbon atoms, and more preferably 6 to 20 carbon atoms). Examples thereof include phenyl and naphthyl, and phenyl is preferred. The aromatic heterocyclic group represented by $ArH_{31}$ is a 5- to 10-membered unsaturated heterocyclic group containing at least one of N, O and S, which may be monocyclic or condensed with other ring. A heterocyclic ring of the heterocyclic group is preferably a 5- or 6-membered aromatic heterocyclic ring or its benzo-condensed ring, more preferably a nitrogen-containing, 5- or 6-membered aromatic heterocyclic ring or its benzo-condensed ring, and still more preferably one or two nitrogen-containing, 5- or 6-membered aromatic heterocyclic ring or its benzo-condensed ring.

Examples of the aromatic heterocyclic group include groups derived from thiophene, furan, pyrrole, imidazole, pyrazolo, pyridine, pyrazine, pyridazine, triazole, triazine, indole, indazole, purine, thiadiazole, oxadiazole, quinoline, phthalazine, naphthylizine, quinoxaline, quinazolone, cinnoline, pteridine, acrydine, phenathroline, phenazine, tetrazole, thiazole, oxazole, benzimidazole, benzoxazole, benzthiazole, benzothiazoline, benzotriazole, tetrazaindene, and carbazole. Of these, groups derived from imidazole, pyrazolo, pyridine, pyrazine, indole, indazole, thiadiazole, oxadiazole, quinoline, phenazine, tetrazole, thiazole, oxazole, benzimidazole, benzoxazole, benzthiazole, benzothiazoline, benzotriazole, tetrazaindene, and carbazole are preferred; and groups derived from imidazole, pyridine, pyrazine, quinoline, phenazine, tetrazole, thiazole, benzoxazole, benzoimidazole, benzthiazole, benzothiazoline, benzotriazole, and carbazole are more preferred.

The aromatic hydrocarbon group and aromatic heterocyclic group represented by $ArH_{31}$ may be substituted. The substituent group is the same as the substituent groups defined in $T_{31}$. The substituent group may be further substituted, and plural substituting group may be the same or different. Further, the group represented by $ArH_{31}$ is preferably an aromatic heterocyclic group.

The aliphatic hydrocarbon group represented by Ra, Rb, Rc, Rd, Re and Rf include, for example, an alkyl group (preferably having 1 to 20 carbon atoms, more preferably 1 to 16 carbon atoms and still more preferably 1 to 12 carbon atoms), an alkenyl group (preferably having 2 to 20 carbon atoms, more preferably 2 to 16 carbon atoms, and still more preferably 2 to 12 carbon atoms), an alkynyl (preferably having 2 to 20 carbon atoms, more preferably 2 to 16 carbon atoms, and still more preferably 2 to 12 carbon atoms) an aryl group (preferably having 6 to 30 carbon atoms, more preferably 6 to 20 carbon atoms, and still more preferably 6 to 12 carbon atoms, e.g., phenyl, naphthyl), and a heterocyclic group (e.g., 2-thiazolyl, 1-piperadynyl, 2-pyridyl, 3-pyridyl,2-thienyl, 2-benzimidazolyl, carbazolyl, etc.). The heterocyclic group may be a monocyclic ring or a ring condensed with other ring. The acyl group represented by Ra, Rb, Rc, Rd, Re and Rf includes an aliphatic or aromatic one, such as acetyl, benzoyl, formyl, and pivaloyl. The nitrogen containing heterocyclic group formed by combination of Ra and Rb, Rc and Rd, Ra and Rc, or Rb and Rd includes a 3- to 10-membered, saturated or unsaturated heterocyclic ring (e.g., ring groups such as piperidine ring, piperazine ring, acridine ring, pyrrolidine ring, pyrrol ring and morpholine ring).

Examples of acid anions used as the ion necessary to neutralize an intramolecular charge, represented by $M_{31}$ include a halide ion (e.g., chloride ion, bromide ion, iodide ion, etc.), p-toluenesulfonate ion, perchlorate ion, tetrafluorobarate ion, sulfate ion, methylsulfate ion, ethylsulfate ion, methansufonic acid ion and trifluoromethanesulfonic acid ion.

The supersensitizer is incorporated into the emulsion layer containing an organic silver salt and silver halide grains, preferably in an amount of 0.001 to 1.0 mol, and more preferably 0.01 to 0.5 mol per mol of silver.

The silver-saving agent used in the invention refers to a compound capable of reducing the silver amount necessary to obtain a prescribed silver density. The action mechanism for the reducing function has been variously supposed and compounds having a function of enhancing covering power of developed silver are preferred. Herein the covering power of developed silver refers to an optical density per unit amount of silver. Examples of the preferred silver-saving agent include hydrazine derivative compounds represented by the following formula [H], vinyl compounds represented by formula (G) and quaternary onium compounds represented by formula (P):

formula [H]

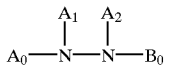

formula (G)

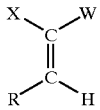

formula (P)

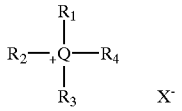

In formula [H], $A_0$ is an aliphatic group, aromatic group, heterocyclic group, each of which may be substituted, or —$G_0$-$D_0$ group; $B_o$ is a blocking group; $A_1$ and $A_2$ are both hydrogen atoms, or one of them is a hydrogen atom and the other is an acyl group, a sulfonyl group or an oxalyl group, in which Go is a —CO—, —COCO—, —CS—, —C(=$NG_1D_1$)—, —SO—, —$SO_2$— or —P(O) ($G_1D_l$)— group, in which $G_1$ is a bond, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group. $D_0$ is preferably a hydrogen atom, an alkyl group, an alkoxy group or an amino group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfo-oxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. The aromatic group, heterocyclic group or —$G_0$-$D_0$ group represented by $A_0$ each may be substituted. Specifically preferred $A_0$ is an aryl group or —$G_0$-$D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

In Formula (H), $B_o$ is a blocking group, and preferably —$G_0$-$D_0$, wherein $G_0$ is a —CO—, —COCO—, —CS—, —C(=N$G_1D_1$)—, —SO—, —$SO_2$— or —P(O) ($G_1D_l$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxy or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxaly).

More preferred hydrazine compounds are represented by the following formulas (H-1), (H-2), (H-3) and (H-4):

formula (H-1)

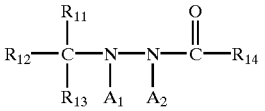

formula (H-2)

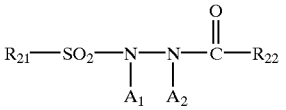

formula (H-3)

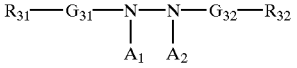

formula (H-4)

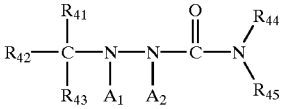

In formula (H-1), $R_{11}$, $R_{12}$ and $R_{13}$ are each a substituted or unsubstituted aryl group or substituted or unsubstituted heteroaryl group (i.e., an aromatic heterocyclic group). Examples of the aryl group represented by $R_{11}$, $R_{12}$ or $R_{13}$ include phenyl, p-methylphenyl and naphthyl and examples of the heteroaryl group include a triazole residue, imidazole residue, pyridine residue, furan residue and thiophene residue. $R_{11}$, $R_{12}$ or $R_{13}$ may combine together with each other through a linkage group. Substituents which $R_{11}$, $R_{12}$ or $R_{13}$ each may have include, for example, an alkyl group, an alkenyl group, an alkynyl group, an aryl group, a heterocyclic group, a quaternary nitrogen containing heterocyclic group (e.g., pyridionyl), hydroxy, an alkoxy group (including containing a repeating unit of ethyleneoxy or propyleneoxy), an aryloxy group, an acyloxy group, an acyl group, an alkoxycarbonyl group, an aryloxycarbonyl group, a carbamoyl group, a urethane group, carboxy, an imodo group, an amino group, a carbonamido group, a sulfonamido group, a ureido group, a thioureido group, a sulfamoylamino group, semicarbazido group, thiosemocarbaido group, hydrazine group, a quaternary ammonio group, an alkyl-, aryl- or heterocyclic-thio group, mercapto group, an alkyl- or aryl-sufonyl group, an alkyl- or aryl-sulfinyl group, sulfo group, sulfamoyl group, an acylsufamoyl group, an alkyl or aryl-sulfonylureido group, an alkyl- or aryl-sulfonylcarbamoyl group, a halogen atom, cyano, nitro, and phosphoric acid amido group. All of $R_{11}$, $R_{12}$ and $R_{13}$ are preferably phenyl groups and more preferably unsubstituted phenyl groups.

$R_{14}$ is heterocyclic-oxy group or a heteroarylthio group. Examples of the heteroaryl group represented by $R_{14}$ include a pyridyloxy group, benzimidazolyl group, benzothiazolyl group, benzimidazolyloxy group, furyloxy group, thienyloxy group, pyrazolyloxy group, and imidazolyloxy group; and examples of the the heteroarylthio group include a pyridylthio group, pyrimidylthio group, indolylthio group, benzothiazolylthio, benzoimidazolylthio group, furylthio group, thienylthio group, pyrazolylthio group, and imidazolylthio group. $R_{14}$ is preferably a pyridyloxy or thenyloxy group.

$A_1$ and $A_2$ are both hydrogen atoms, or one of them is a hydrogen atom and the other is an acyl group (e.g., acetyl, trifluoroacetyl, benzoyl, etc.), a sulfonyl (e.g., methanesulfonyl, toluenesulfonyl, etc.), or oxalyl group (e.g., ethoxalyl, etc.). $A_1$ and $A_2$ are both preferably hydrogen atoms.

In formula (H-2), $R_{21}$ is a substituted or unsubstituted alkyl group, aryl group or heteroaryl group. Examples of the alkyl group represented by $R_{21}$ include methyl, ethyl, t-butyl, 2-octyl, cyclohexyl, benzyl, and diphenylmethyl; the aryl group, the heteroaryl group and the substituent groups are the same as defined in $R_{11}$, $R_{12}$ and $R_{13}$. In cases where $R_{21}$ is substituted, the substituent groups are the same as defined in $R_{11}$, $R_{12}$ and $R_{13}$. $R_{21}$ is preferably an aryl group or a heterocyclic group, and more preferably a phenyl group.

$R_{22}$ is a hydrogen atom, an alkylamino group, an arylamino group, or heteroarylamino group. Examples thereof includemethylamino, ethylamino, propylamino, butylamino, dimethylamino, diethylamino, and ethylmethylamino. Examples of the arylamino group include an anilino group; examples of the heteroaryl group include thiazolylamino, benzimidazolylamino and benzthiazolylamino. $R_{22}$ is preferably dimethylamino or diethylamino. $A_1$ and $A_2$ are the same as defined in formula (H-1).

In formula (H-3), $R_{31}$ and $R_{32}$ are each a univalent substituent group and the univalent substituent groups represented by $R_{31}$ and $R_{32}$ are the same as defined in $R_{11}$, $R_{12}$, and $R_{13}$ of formula (H-1), preferably an alkyl group, an aryl group, a heteroaryl group, an alkoxy group and an amino group, more preferably an aryl group or an alkoxy group, and specifically preferably, at least one of $R_{31}$ and $R_{32}$ t-butoxy and another preferred structure is that when $R_{31}$ is phenyl, $R_{32}$ is t-butoxycarbonyl. $G_{31}$ and $G_{32}$ are each a —$(CO)_p$— or —C(=S)— group, a sulfonyl group, a sulfoxy group, a —P(=O)$R_{33}$— group, or an iminomethylene group, in which $R_{33}$ is an alkyl group, an alkenyl group, an alkynyl group, an aryl group, an alkoxy group, an alkenyloxy group, an alkynyloxy group, an arylamino group or an amino group, provided that when $G_{31}$ is a sulfonyl group, $G_{32}$ is not a carbonyl group. $G_{31}$ and $G_{32}$ are preferably —CO—, —COCO—, a sulfonyl group or —CS—, and more preferably —CO— or a sulfonyl group. $A_1$ and $A_2$ are the same as defined in $A_1$ and $A_2$ of formula (H-1).

In formula (H-4), $R_{41}$, $R_{42}$ and $R_{43}$ are the same as defined in $R_{11}$, $R_{12}$ and $R_{13}$. $R_{41}$, $R_{42}$ and $R_{43}$ are preferably substituted or unsubstituted phenyl group, and more preferably all of $R_{41}$, $R_{42}$ and $R_{43}$ are an unsubstituted phenyl group. $R_{44}$ and $R_{45}$ are each an unsubstituted alkyl group and examples thereof include methyl, ethyl, t-butyl, 2-octyl, cyclohexyl, benzyl, and diphenylmethyl. $R_{44}$ and $R_{45}$ are preferably ethyl. $A_1$ and $A_2$ are the same as defined in $A_1$ and $A_2$ of formula (H-1).

Exemplary examples of the compounds represented by formulas [H], and (H-1) through (H-4) are shown below.

H-1

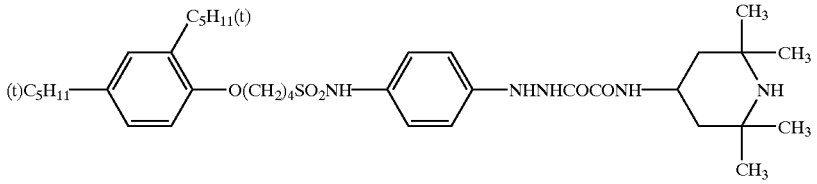

H-2

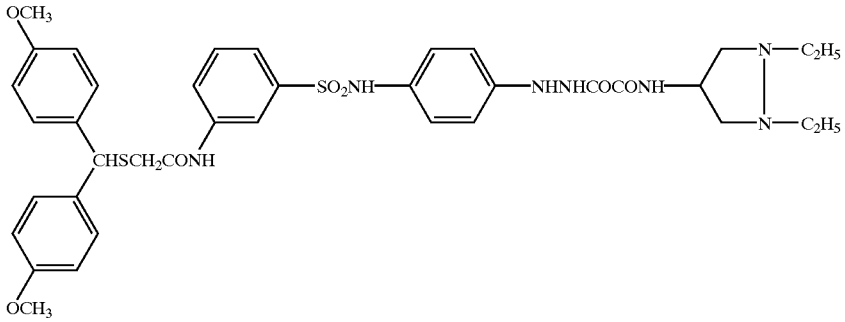

H-3

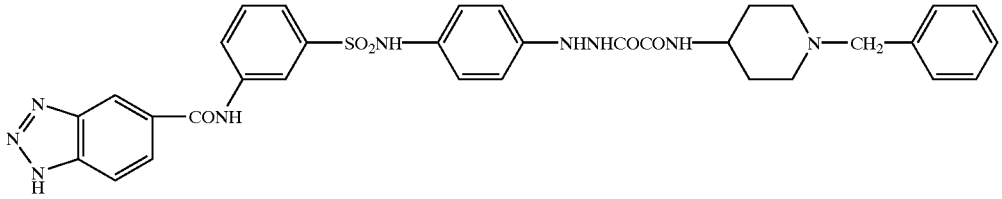

H-4

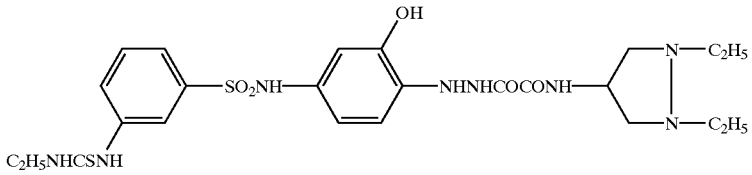

H-5

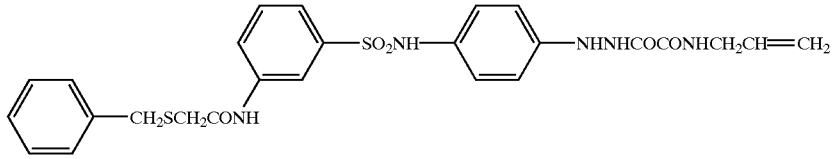

H-6

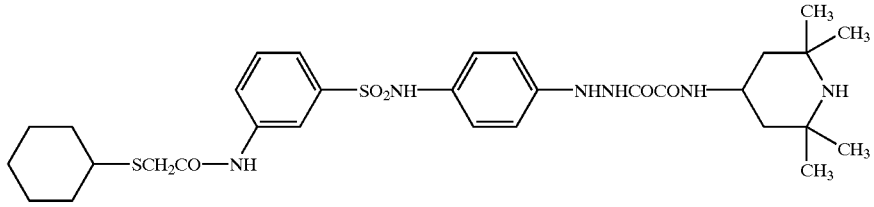

-continued
H-7
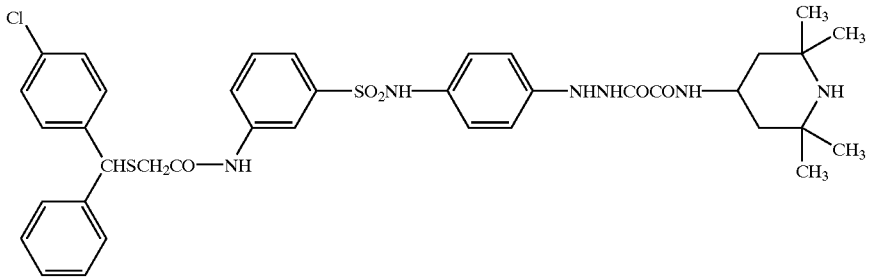
H-8
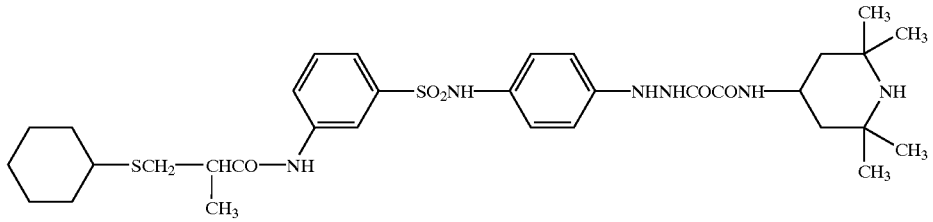
H-9
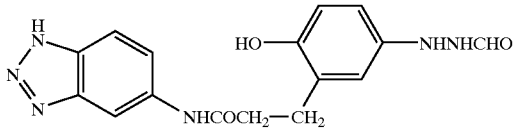
H-10
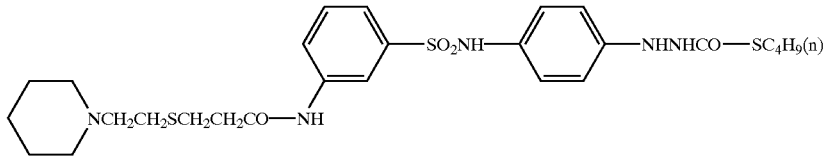
H-11
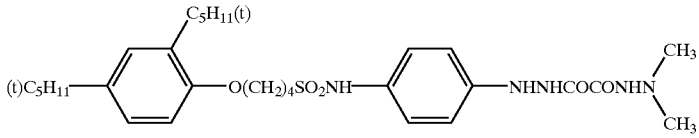
H-12
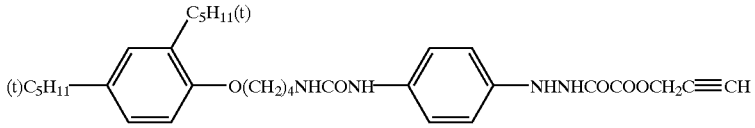
H-13
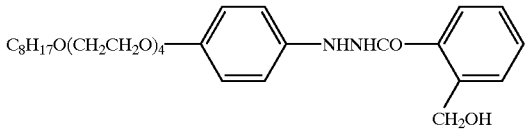
H-14
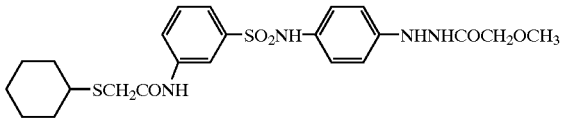
H-15
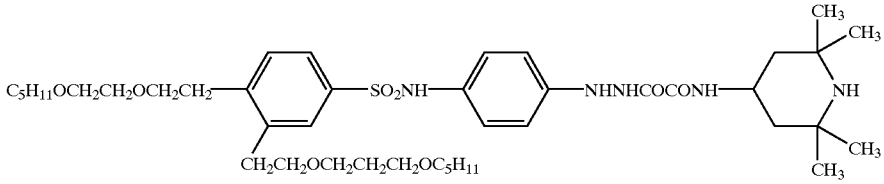

-continued
H-16
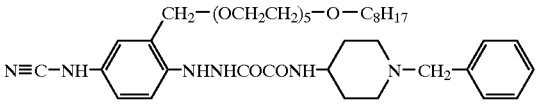
H-17
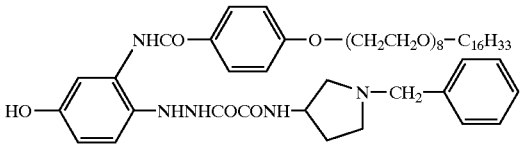
H-18
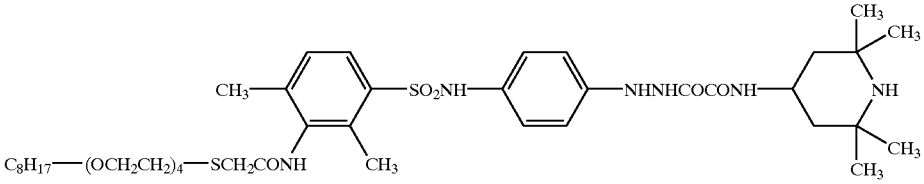
H-19
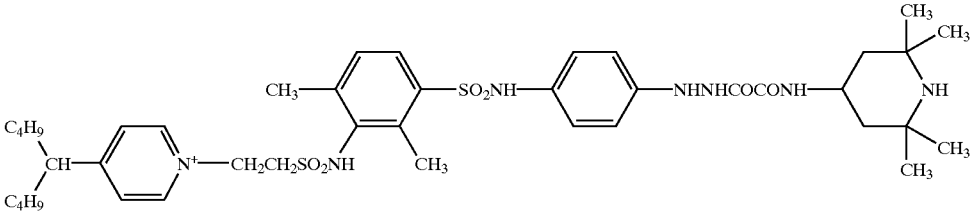
H-20
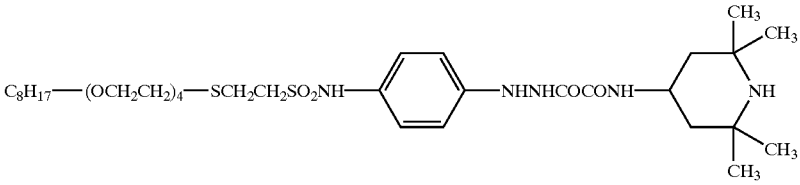
H-21
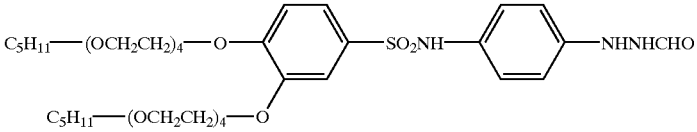
H-22
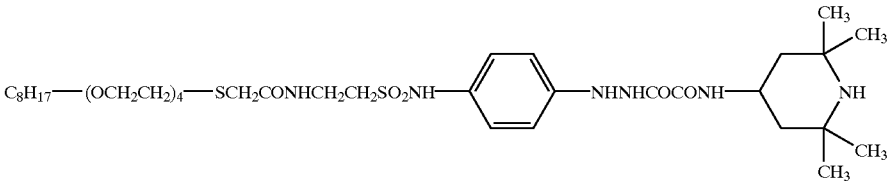
H-23
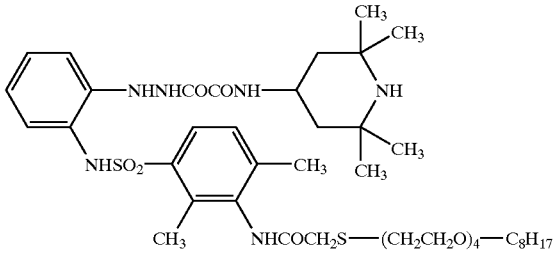
H-24
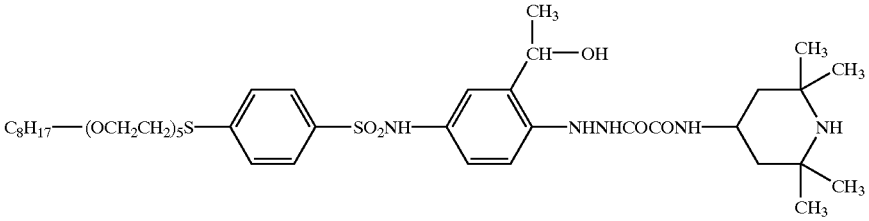

-continued
H-25
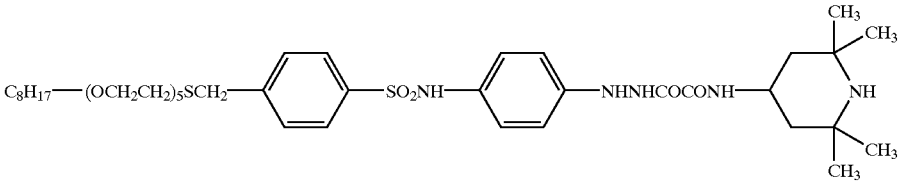
H-26
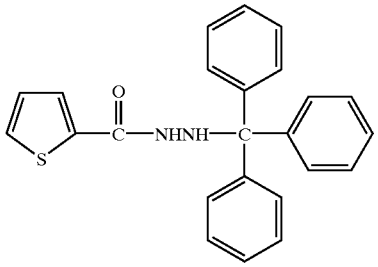
H-27
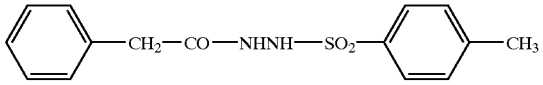
H-28
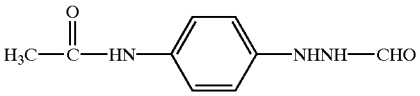
H-29
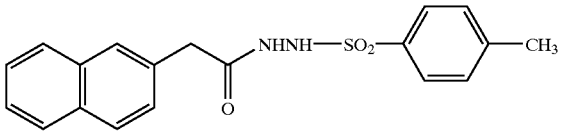
H-30
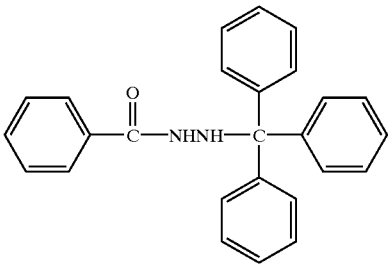
H-31
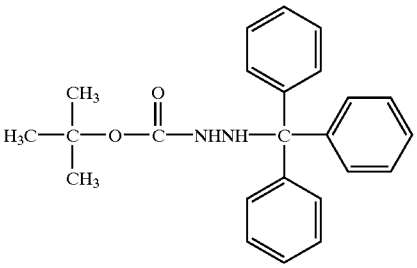
H-32
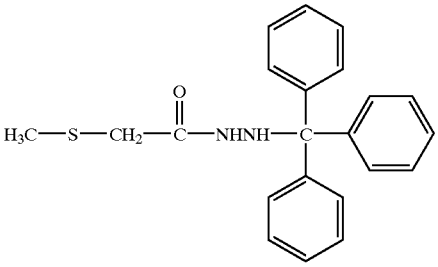
H-33
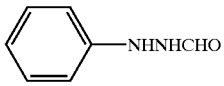
H-34
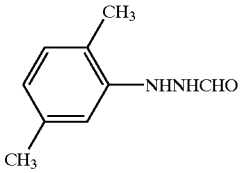
H-35
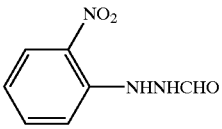
H-36
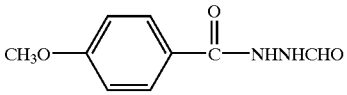
H-37
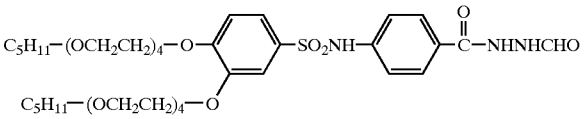

The compounds of formulas (H-1) through (H-4) can be readily synthesized in accordance with methods known in the art, as described in, for example, U.S. Pat. Nos. 5,467,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

In formula (G), X and R may be either cis-form or trans-form. The structure of its exemplary compounds is also similarly included.

In formula (G), X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the ring formed by X and W include pyrazolone, pyrazolidinone, cyclopentadione, β-ketolactone, and β-ketolactam.

In formula (G), the electron-withdrawing group represented by X refers to a substituent group exhibiting a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulformium group, a phophonium group, pyrilium group and inmonium grou, and further including a group of a heterocyclic ring formed by an ammonium group, sulfonium group, phosphonium group or immonium group. Of these group, groups exhibiting σp of 0.3 or more are specifically preferred.

Examples of the alkyl group represented by W include methyl, ethyl and trifluoromethyl; examples of the alkenyl include vinyl, halogen-substituted vinyl and cyanovinyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive σp is preferred and the group exhibiting σp of 0.3 or more is specifically preferred.

Of the groups represented by R, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

In formula (P), Q is a nitrogen atom or a phosphorus atom; $R_1$, $R_2$, $R_3$ and $R_4$ each are a hydrogen atom or a substituent, provided that $R_1$, $R_2$, $R_3$ and $R_4$ combine together with each other to form a ring; and $X^-$ is an anion.

Examples of the substituent represented by $R_1$, $R_2$, $R_3$ and $R_4$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g., piperidyl, piperazinyl, morpholinyl, pyridyl, furyl, thienyl, tetrahydrofuryl, tetrahydrothienyl, sulforanyl), and amino group. Examples of the ring formed by $R_1$, $R_2$, $R_3$ and $R_4$ include a piperidine ring, morpholine ring, piperazine ring, pyrimidine ring, pyrrole ring, imidazole ring, triazole ring and tetrazole ring. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group. Examples of the anion of $X^-$ include a halide ion, sulfate ion, nitrate ion, acetate ion and p-toluenesulfonic acid ion.

Further, quaternary onium salt compounds usable in the invention include compounds represented by formulas (Pa), (Pb) and (Pc), or formula (T):

formula (Pa)

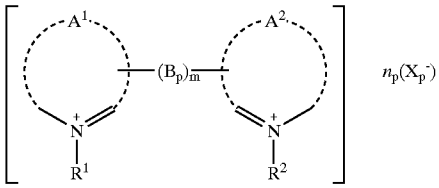

formula (Pb)

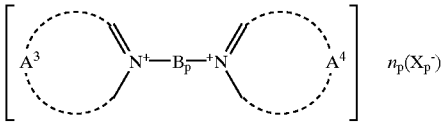

formula (Pc)

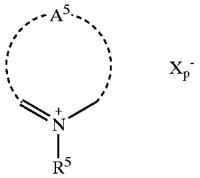

wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$ may be substituted by a substituent. Examples of the substituent include an alkyl group, an aryl group, an aralkyl group, alkenyl group, alkynyl group, a halogen atom, an acyl group, an alkoxycarbonyl group, an aryloxycarbonyl group, a sulfo group, hydroxy, an alkoxyl group, an aryloxy group, an amido group, a sulfamoyl group, a carbamoyl group, a ureido group, an amino group, a sulfonamido group, cyano, nitro, a mercapto group, an alkylthio group, and an arylthio group. Exemplary preferred $A^1$, $A^2$, $A^3$, $A^4$ and $A^5$ include a 5- or 6-membered ring (e.g., pyridine, imidazole, thiazole, oxazole, pyrazine, pyrimidine) and more preferred is a pyridine ring.

Ep is a divalent linkage group, and m is 0 or 1. Examples of the divalent linkage group include an alkylene group, arylene group, alkenylene group, —$SO_2$—, —SO—, —O—, —S—, —CO—, —N($R^6$)—, in which $R^6$ is a hydrogen atom, an alkyl group or aryl group. These groups may be included alone or in combination. Of these, Bp is preferably an alkylene group or alkenylene group.

$R^1$, $R^2$ and $R^5$ are each an alkyl group having 1 to 20 carbon atoms, and $R^1$ and $R^2$ may be the same. The alkyl group may be substituted and substituent thereof are the same as defined in $A^1$, $A^2$, $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted. $X_p^-$ is a counter ion necessary to counterbalance overall charge of the molecule, such as chloride ion, bromide ion, iodide ion, sulfate ion, nitrate ion and p-toluenesulfonate ion; $n_p$ is a counter ion necessary to counterbalance overall charge of the molecule and in the case of an intramolecular salt, $n_p$ is 0.

Formula (T)

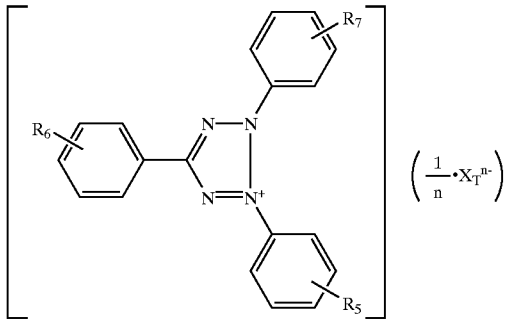

In formula (T), substituent groups $R_5$, $R_6$ and $R_7$, substituted on the phenyl group are preferably a hydrogen atom or a group exhibiting a negative Hammett's σ-value. The Hammett's σ-value represents electron-attractivity.

The σ values of the substituent on the phenyl group are disclosed in lots of reference books. For example, a report by C. Hansch in "The Journal of Medical Chemistry", vol.20, on page 304(1977), etc. can be mentioned. Groups showing particularly preferable negative σ-values include, for example, methyl group (σp=-0.17, and in the following, values in the parentheses are in terms of σp value), ethyl group(−0.15), cyclopropyl group(−0.21), n-propyl group(−0.13), iso-propyl group(−0.15), cyclobutyl group(−0.15), n-butyl group(−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the formula T according to the present invention; n is 1 or 2, and as anions represented by XT n for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, including lower alkyl benzenesulfonic acid anions such as p-toluenesulfonic acid anion, etc.; higher alkylbenzene sulfonic acid anions such as p-dodecyl benzenesulfonic acid anion, etc.; higher alkyl sulfate anions such as lauryl sulfate anion, etc.; Boric acid-type anions such as tetraphenyl borone, etc.; dialkylsulfo succinate anions such as di-2-ethylhexylsulfo succinate anion, etc.; higher fatty acid anions such as cetyl polyethenoxysulfate anion, etc.; and those in which an acid radical is attached to a polymer, such as polyacrylic acid anion, etc. can be mentioned.

The quaternary onium salt compounds described above can be readily synthesized according to the methods commonly known in the art. For example, the tetrazolium compounds described above may be referred to Chemical Review 55, page 335–483.

Binders suitable for photothermographic materials are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidine, casein, starch, polyacrylic acid, poly (methyl methacrylate), poly(methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides, these of which may be hydrophilic or hydrophobic.

Of these, polyvinyl acetals are preferred as a binder used for the light sensitive layer, and polyvinyl acetal is specifically preferred binder. Further, for a light insensitive layer such as an over-coating layer or a sublayer, specifically, a protective layer or a back coating layer are preferred cellulose esters exhibiting a relatively high softening temperature, such as triacetyl cellulose and cellulose acetate-butyrate. The foregoing binders may optionally be used in combination.

The binder is used in an amount within the range effective to function as a binder. The effective range can be readily determined by one skilled in the art. As a measure to hold an organic silver salt in the light sensitive layer, the ratio by weight of a binder to an organic silver salt is preferably 15:1 to 1:2, and more preferably 8:1 to 1:1. Thus, the amount of a binder in the light sensitive elayer is preferably 1.5 to 6 $g/m^2$, and more preferably 1.7 to 5 $g/m^2$. The amount of less than 1.5 $g/m^2$ results in an increase in unexposed areas, leading to levels unacceptable in practical use.

In cases where a coating solution to form a light sensitive layer of the photothermographic imaging material contains an aqueous-dispersed polymer latex, at least 50% by weight of a total binder content of the light sensitive layer-coating solution is preferably accounted for by the aqueous-dispersed polymer latex. Alternatively, in cases where the light sensitive layer contains a polymer latex, the polymer latex preferably accounts for at least 50% by weigh, and more preferably at least 70% by weight of a total binder content of the light sensitive layer.

Herein, the polymer latex is a water-insoluble polymeric material which is dispersed in an aqueous dispersing medium in the form of fine particles. The dispersion form thereof may be any one of a form in which a polymer is emulsified in a dispersing medium, a form of being emulsion-polymerized, being dispersed in the form of a micell and a form in which a polymer has a hydrophilic partial structure and its molecular chain is in the form of a molecular dispersion.

The mean particle size of dispersing particles is 1 to 50,000 nm, and preferably 5 to 1,000 nm. The particle size distribution thereof is not specifically limited and may be of broad size distribution or monodisperse.

The polymeric latexes used in the invention may be those having a uniform structure as well as core/shell type latexes. In this case, it is sometimes preferred that the glass transition temperature is different between the core and shell. The minimum film-forming (or tarnishing) temperature (MFT) of the polymeric latexes is preferably −30 to 90° C., and more preferably 0 to 70° C. A tarnishing aid is also called a plasticizer, which is an organic compound (conventionally, an organic solvent) capable of lowering the MFT of a polymeric latex and described in "Chemistry of Synthetic Latex" (S. Muroi, published by KOBUNSHI-KANKOKAI, 1970).

Polymers used for polymeric latexes include acryl resin, vinyl acetate resin, polyester resin, polyurethane resin, rubber type resin, vinyl chloride resin, vinylidene chloride resin, polyolefin resin and their copolymers. Polymers may be a straight-chained polymer or branched polymer, or a cross-linked polymer, including homopolymers and copolymers. The copolymer may be a random copolymer or a block copolymer. The number-averaged molecular weight of the copolymer is preferably 5,000 to 1000,000, and more preferably 10,000 to 100,000. In cases where the molecular weight is excessively small, mechanical strength of an light sensitive layer such as a light-sensitive layer is insufficient, excessively large molecular weight results in deterioration in film forming property.

The polymer latex used in the invention preferably exhibits an equlibrium moisture content at 250 C and 60% RH (relative humidity) of 0.01 to 2%, and more preferably 0.01 to 1% by weight. The definition and measurement of the equlibrium moisture content are described, for example, in "KOBUNSHIKOGAKU-KOZA 14: KOBUNSHIZAIRYO SHIKENHO" (Polymer Engineering Series 14.: Polymer Material Test Method), edited by Kobunshi Gakkai, published by Chijin Shoin.

Exemplary examples of polymer latexes used as binder include a latex of methylmethacrylate/ethylmethacrylate/methacrylic acid copolymer, a latex of methylmethacrylate/2-ethylhexylacrylate/styrene/acrylic acid copolymer, a latex of styrene/butadiene/acrylic acid copolymer, a latex of styrene/butadiene/divinylbenzene/methacrylic acid copolymer, a latex of methylmethacrylate/vinyl chloride/acrylic acid copolymer, and a latex of vinylidene chloride/ethylacrylate/acrylonitrile/methacrylic acid copolymer. These polymers may be used alone or may be blended.

Polymer latexes used in the invention may be used alone or in combination. The polymer latex preferably contains, as polymer species, 0.1 to 10% by weight of a carboxylic acid component, such as an acrylate or methacrylate component. Further, a hydrophilic polymer such as gelatin, polyvinyl alcohol, methyl cellulose, hydroxypropyl cellulose, carboxymethyl cellulose and hydroxypropylmethyl cellulose may be added within the range of not more than 50% by weight of the total binder. The hydrophilic binder is added preferably in an amount of not more than 30% by weight, based on the total binder of the light sensitive layer.

In preparation of a coating solution to form the light sensitive layer, an organic silver salt and an aqueous-dispersed polymer latex may be added in any order, i.e., either one may be added in advance or both ones may be simultaneously added, but the polymer latex is preferably added later. It is further preferred that the organic silver salt is mixed with a reducing agent prior to addition of the polymer latex. After mixing the organic silver salt and polymer latex, the coating solution is preferably maintained at a temperature of 30 to 65° C., more preferably 35 to 60° C., and still more preferably 35 to 55° C. since there are problems such that an excessively low temperature often vitiates the coat surface and an excessively high temperature results in increased fogging. To maintain such a temperature, a vessel to prepare the coating solution may be maintained a prescribed temperature. In coating a coating solution of the light sensitive layer, after mixing the organic silver salt and aqueous-dispersed polymer latex, a coating solution aged for 30 min to 24 hrs. is preferably used and a coating solution aged for 1 to 12 hrs. is more preferred. Herein, the expression "after mixing" refers to after the organic silver salt and the aqueous-dispersed polymer latex are added and additives are homogeneously dispersed.

Although it is commonly known that the use of a crosslinking agent in such a binder as described above improves layer adhesion and lessens unevenness in development, the use of the crosslinking agent is also effective in fog inhibition during storage and prevention of print-out after development.

Crosslinking agents usable in the invention include various commonly known crosslinking agents used for photographic materials, such as aldehyde type, epoxy type, vinylsulfone type, sulfone ester type, acryloyl type, carbodiimide type crosslinking agents, as described in JP-A 50-96216. Of these, compounds capable of reacting with a hydroxy group, i.e., hydroxy group-reactive compounds are preferably employed. Specifically preferred are an isocyanate type compound, epoxy compound and acid anhydride, as shown below. One of the preferred crosslinking agents is an isocyanate or thioisocyanate compound represented by the following formula:

$$X{=}C{=}N{-}L{-}(N{=}C{=}X)v \qquad \text{formula (8)}$$

wherein v is 1 or 2; L is a bivalent linkage group having an alkylene, alkenylene, arylene or alkylarylene group; and X is an oxygen atom or a sulfur atom. An arylene ring of the arylene group may be substituted. Preferred substituents include a halogen atom (e.g., bromine atom, chlorine atom), hydroxy, amino, carboxy, alkyl and alkoxy.

The isocyanate crosslinking agent is an isocyanate compound containing at least two isocyanate group and its adduct. Examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols. Exemplary examples are isocyanate compounds described in JP-A 56-5535 at pages 10–12, including: ethanediisocyanate, butanediisocyanate, hexanediisocyanate, 2,2-dimetylpentanediisocyanate, 2,2,4-trimethylpentanediisocyanate, decanediisocyanate, ω,ω'-diisocyanate-1,3-dimethylbenzol, ω,ω'-diisocyanate-1,2-dimethylcyclohexanediisocyanate, ω,ω'-diisocyanate-1,4-diethylbenzol, , ω,ω'-diisocyanate-1,5-dimethylnaphthalene, ω,ω'-diisocyanate-n-propypbiphenyl, 1,3-phenylenediisocyanate, 1-methylbenzol-2,4-diisocyanate, 1,3-dimethylbenzol-2,6-diisocyanate, naphthalene-1,4-diisocyanate, 1,1'-naphthyl-2,2'-diisocyanate, biphenyl-2,4'-diisocyanate, 3,3'-dimethylbiphenyl-4,4'-diisocyanate, diphenylmethane-4,4'-diisocyanate, 2,2'-dimethyldiphenylmethane-4,4'-diisocyanate, 3,3'-dimethoxydiphenylmethane-4,4'-diisocyanate, 4,4'-diethoxydiphenylmethane-4,4'-diisocyanate, 1-methylbenzol-2,4,6-triisocyanate, 1,3,5-trimethylbenzene-2,4,6-triisocyanate, diphenylmethane-2,4,4'-triisocyanate, triphenylmethane-4,4',4'-triisocyanate, tolylenediisocyanate, 1,5-naphthylenediisocyanate; dimmer or trimer adducts of these isocyanate compounds (e.g., adduct of 2-mole hexamethylenediisocyanate, adduct of 3 mole hexamethylenediisicyanate, adduct of 2 mole 2,4-tolylenediisocyanate, adduct of 3 mole 2,4-tolylenediisocyanate); adducts of two different isocyanates selected from these isocyanate compounds described above; and adducts of these isocyanate compounds and bivalent or trivalent polyhydric alcohol (preferably having up to 20 carbon atoms, such as ethylene glycol, propylene glycol, pinacol, and trimethylol propane), such as adduct of tolylenediisocyanate and trimethylolpropane, or adduct of hexamethylenediisocyanate and trimethylolpropane. of these, adduct of isocyanate and polyhydric alcohol improves adhesion between layers, exhibiting high capability of preventing layer peeling, image slippage or production of bubbles. These polyisocyanate compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus it may be incorporated into one or plurality of these layers.

The thioisocyanate type crosslinking agent usable in the invention is to be a compound having a thioisocyanate structure, corresponding to the isocyanates described above.

The crosslinking agents described above are used preferably in an amount of 0.001 to 2 mol, and more preferably 0.005 to 0.5 mol per mol of silver.

The isocyanate compounds and thioisocyanate compounds used in the invention are preferably those which are capable of functioning as a hardener. Even when "v" of formula (8) is zero, i.e., even a compound containing only one functional group provides favorable effects.

Examples of silane compounds used as a crosslinking agent include the compounds represented by the following formula (Si-1) or (Si-2):

$$(R^{11}O)_m{-}Si{-}(L_1{-}R^{12})_n \qquad \text{formula (Si-1)}$$

formula (Si-2)

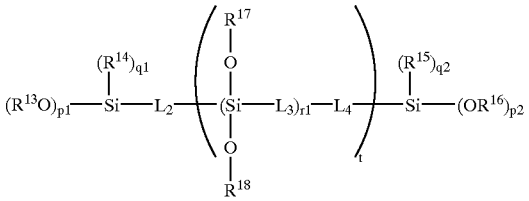

wherein $R^{11}$, $R^{12}$, $R^{13}$, $R^{14}$, $R^{15}$, $R^{16}$, $R^{17}$ and $R^{18}$ represent each an alkyl group, an alkenyl group, an alkynyl group, an aryl group or a heterocyclic group; $L_1$, $L_2$, $L_3$ and $L_4$ represent each a bivalent linkage group; m and n are each an integer of 1 to 3, provided that m+n is 4; p1 and p2 are each an integer of 1 to 3 and q1 and q2 are each 0, 1 or 2, provided that p1+q1 and p2+q2 are each 3; r1 and r2 are each 0 or an integer of 1 to 1000; and x is 0 or 1.

In the formulas, $R^{11}$, $R^{12}$, $R^{13}$, $R^{14}$, $R^{15}$, $R^{16}$, $R^{17}$ and $R^{18}$ are each a straight chain, branched or cyclic alkyl group having 1 to 30 carbon atoms (e.g., methyl, ethyl, butyl, octyl, dodecyl, cycloalkyl, alkenyl group (e.g., propenyl, butenyl, nonanyl), an alkynyl group (e.g., acetylene group, bisacetylene group, phenylacetylene group), an aryl group (e.g., phenyl, naphthyl) or a heterocyclic group (e.g., tetrahydropyran, pyridyl group, furyl, thiophenyl, imidazolyl, thiazolyl, thiazolyl, oxadiazolyl). These groups may be substituted and substituent groups include any one of electron-withdrawing and electron-donating groups. Examples of the substituent groups include an alkyl group having 1 to 25 carbon atoms (e.g., methyl, ethyl, propyl, isopropyl, tert-butyl, pentyl, hexyl, cyclohexyl), halogenated alkyl group (e.g., trifluoromethyl, perfluorooctyl), cycloalkyl group (e.g., cyclohexyl, cyclopentyl), alkynyl group (e.g., propargyl group), glycidyl group, acrylate group, methacrylate group, aryl group (e.g., phenyl), heterocyclic group (e.g., pyridyl, thiazolyl, oxazolyl, imidazolyl, furyl, pyrrolyl, pirazinyl, pyrimidinyl, pyridazinyl, selenazolyl, sulforanyl, piperidinyl, pyrazolyl, tetrazolyl), halogen atom (chlorine, brominem iodine, fluorine), alkoxy group (methoxy, ethoxy, propyloxy, pentyloxy, hexyloxy), aryloxy (e.g., phenoxy), alkoxycarbonyl group (e.g., methyloxycarbonyl, ethyloxycarbonyl, butyloxycarbonyl), aryloxycarbonyl (phenyloxycarbonyl), sulfonamido group (methanesulfonamido, ethanesulfonamido, butanesulfoneamido, hexanesulfonamido, cyclohexanesulfonamido, benzenesulfonamido), sulfamoyl group (e.g., aminosulfonyl, methylaminosulfonyl, dimethylaminosulfonyl, butylaminosulfonyl, hexylaminosulfonyl, cyclohexylaminosulfonyl, phenylaminosulfonyl, 2-pyridylaminosulfonyl), urethane group (e.g., methylureido, ethylureido, pentylureido, cyclohexylureido, phenylureido, 2-pyridylureido), acyl group (e.g., acetyl, propionyl, butanoyl, hexanoyl, cyclohexanoyl, benzoyl, pyridinoyl), carbamoyl group (e.g., amiocarbonyl, methylaminocarbonyl, dimethylaminocarbonyl, propylaminocarbonyl, pentylaminocarbonyl, cyclohexylaminocarbonyl, phenylaminocarbonyl, 2-pyridylamonpcarbonyl), amido group (acetoamide, propionamido, butaneamido, hexaneamido, benzamido), sulfonyl group (e.g., methylsulfinyl, ethylsulfinyl, butylsulfonyl, cyclohexylsulfonyl, phenylsulfinyl, 2-pyridylsulfonyl), amino group (e.g., amino, ethylamino, dimethylamino, butylamino, cyclopentylamino, anilino, 2-pyridylamino), cyano group, nitro group, sulfo group, carboxy group, hydroxy group and oxamoyl group. These substituent groups may be further substituted with the foregoing substituent groups. $L_1$, $L_2$, $L_3$ and $L_4$ are each a bivalent linkage group, including an alkylene group (e.g., ethylene, propylene, butylenes, hexamethylene), oxyalkylene group (e.g., oxyethylene, oxypropylene, oxybutylene, oxyhexamethylene, or group comprised of plural these repeating units), aminoalkylene group (e.g., aminoethylene, aminopropylene, aminohexamethylene, or a group comprised of plural these repeating units), and carboxyalkylene group (e.g., carboxyethylene, carboxypropylene, carboxybutylene), thioether group, oxyether group, sulfonamido group and carbamoyl group. At least one of $R^{11}$ and $R^{12}$ in formula (1), or at least one of $R^{13}$, $R^{14}$, $R^{15}$, $R^{16}$, $R^{17}$ and $R^{18}$ in formula (2) preferably is a ballast group (or a diffusion-proof group) or an adsorption-promoting group, and more preferably, $R^{12}$ is a ballast group or an adsorption-promoting group. The ballast group is preferably an aliphatic group having 6 or more carbon atoms or an aryl group substituted with an alkyl group having 3 or more carbon atoms. Introduction of the ballast group, depending on the amount of a binder or crosslinking agent, restrains diffusion at room temperature, preventing reaction during storage.

The epoxy compound usable in the invention may be any one containing at least one epoxy group and is not limited with respect to the number of the epoxy group, molecular weight and other parameters. The epoxy group is preferably contained in the form of a glycidyl group through an ether bond or an imino bond in the molecule. The epoxy compound may be any one of a monomer, oligomer and polymer, in which the number of the epoxy group in the molecule is preferably 1 to 10 and more preferably 2 to 4. In cases where the epoxy compound is a polymer, it may be either one of a homopolymer and a copolymer. The number-averaged molecular weight (Mn) thereof is preferably 2,000 to 20,000. The epoxy compound used in the invention is preferably a compound represented by the following formula (9):

Formula (9)

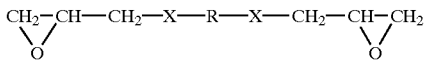

wherein an alkylene group represented by R in formula (9) may be substituted by a substituent selected from a halogen atom, a hydroxyalkyl group and an amino group; R in formula (9) preferably contains an amide linkage, ether linkage or thioether linkage; a bivalent linkage group represented by X is preferably —$SO_2$—, —$SO_2$NH—, —S—, —O— or —NR'—, in which R' is a univalent linkage group and preferably an electron-withdrawing group.

The epoxy compounds may be used alone or combination thereof. The amount to be added is not specifically limited, but preferably $1\times10^{-6}$ to $1\times10^{-2}$ mol/$m^2$, and more preferably $1\times10^{-5}$ to $1\times10^{-3}$ mol/$m^2$. The epoxy compound may be added to any layer of a photosensitive layer, surface protective layer, interlayer, antihalation layer and subbing layer provided on the photosensitive layer-side of the support and may be added to one or plurality of these layers. Further, it may be added to a layer provided on the opposite side of the support, in combination with the photosensitive layer-side. In the case of a photothermographic material having photosensitive layers on both sides of the support, it may be added to any one of the layers.

The acid anhydride used in the invention is preferably a compound containing at least an acid anhydride group represented as below:

—CO—O—CO—

The acid anhydride usable in the invention may be any compound containing one or more acid anhydride group, the number of the acid anhydride group, molecular weight or other parameters are not specifically limited, and a compound represented by the following formula [B] is preferred:

Formula [B]

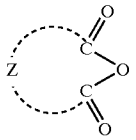

wherein Z is an atomic group necessary to form a monocyclic or polycyclic ring, which may be substituted. Examples of substituent include an alkyl group (e.g., methyl, ethyl, hexyl), an alkoxyl group (e.g., methoxy, ethoxy, octyloxy), an aryl group (e.g., phenyl, naphthyl, tolyl), hydroxy group, an aryloxy group (e.g., phenoxy), an alkylthio group (e.g., methylthio, butylthio), an arylthio group (e.g., phenylthio), an acyl group (e.g., acetyl, propionyl, butylyl), a sulfonyl group (e.g., methylsulfonyl, phenylsulfonyl), an acylamino group, a sulfonylamino group, an acyloxy group (e.g., acetoxy, benzoxy), carboxy group, cyano group, sulfo group and an amino group. It is preferred not to contain a halogen atom as a substituent.

Exemplary examples of the acid anhydride compound are shown below but are not limited to these.

B-1

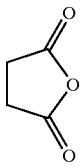

B-2

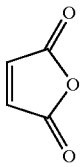

-continued
B-3
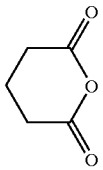
B-4
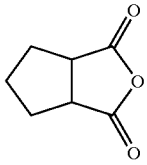
B-5
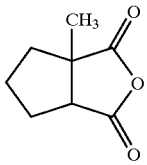
B-6
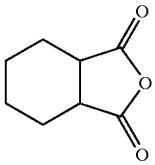
B-7
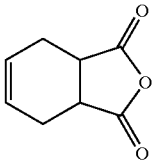
B-8
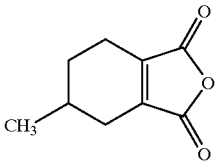
B-9
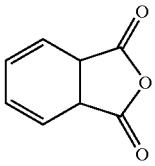
B-10
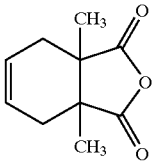
B-11
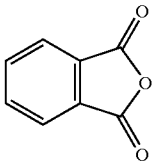
-continued
B-12
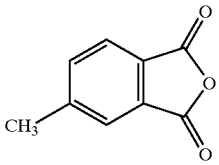
B-13
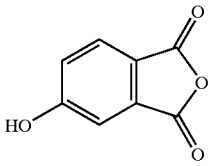
B-14
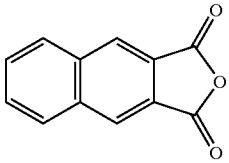
B-15
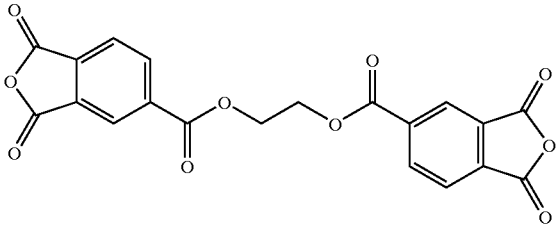
B-16
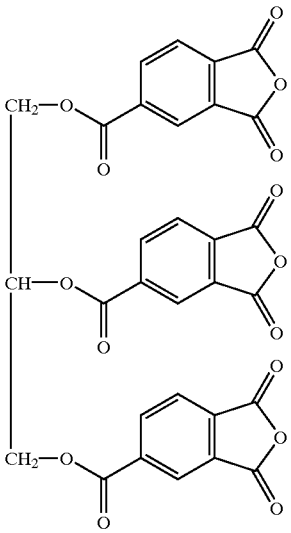

-continued

B-17

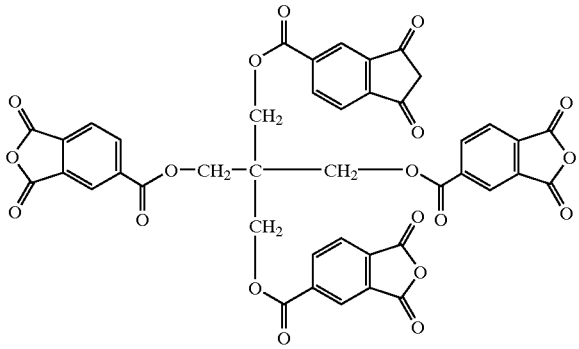

The acid anhydride compound may be used alone or combination thereof. The amount to be added is not specifically limited, but preferably $1\times10^{-6}$ to $1\times10^{-1}$ mol/m$^2$, and more preferably $1\times10^{-4}$ to $1\times10^{-2}$ mol/m$^2$. The acid anhydride compound may be added to any layer of a photosensitive layer, surface protective layer, interlayer, antihalation layer and subbing layer provided on the photosensitive layer-side of the support and may be added to one or plurality of these layers. Further, it may be added to a layer containing the foregoing epoxy compound.

Photothermographic imaging materials of the invention, which form photographic images on thermal development, comprises a reducible silver source (such as organic silver salts), light sensitive silver halide grains, a reducing agent, and optionally a color toning agent for adjusting silver image color tone, which are contained in the form of a dispersion in a binder matrix. Exemplary preferred toning agents are described in RD17029, U.S. Pat. Nos. 4,123,282, 3,994,732, 3,846,136 and, 4,021,249. Examples thereof include imides (succinimide, phthalimide, naphthalimide, N-hydroxy-1,8-naphthalimide, etc.); mercaptanes (e.g., 3-mercapto-1,2,4-triazole, etc.); phthalazinone derivatives and their metal salt [e.g., phthalazinone, 4-(1-naphthyl) phthalazinone, 6-chlorophthalazinone, 5,7-dimethyloxyphthalazinone, 2,3-dihydroxy-1,4-phthalzinedione, etc.]; combinations of phthalazine and phthalic acids (e.g., phthalic acid, 4-methylphthalic acid, 4-nitrophthalic acid, tetrachlorophthalic acid, etc.); and combinations of phthalazine and at least one selected from maleic acid anhydride, phthalic acid, 2,3,-naphthalenedicarboxylic acid, and o-phenylenic acid derivatives and their anhydrides (e.g., phthalic acid, 4-methyphthalic acid, 4-nitrophthalic acid, tetrachlorophthalic acid, etc.). Specifically preferred toning agents include phthalazinone, a combination of phthalazine, and phthalic acids or phthalic acid anhydrides.

With regard to image tone of the outputted image used for medical diagnosis, it has been supposed that more exact diagnostic observation results can be easily achieved with cold image tone. The cold image tone refers to pure black tone or bluish black tone and the warm image tone refers to a brownish black image exhibiting a warm tone.

The expression regarding to the tone, i.e., "colder tone" or "warmer tone can be determined based on a hue angle, $h_{ab}$ at a density of 1.0, as defined in JIS Z 8729. The hue angle, $h_{ab}$ can be represented as $h_{ab}=\tan^{-1}(b^*/a^*)$ obtained from a XYZ color system, or tristimulus values X, Y and Z or $X_{10}$, $Y_{10}$ and $Z_{10}$ defined in JIS Z 8701, using color coordinates a* and b* in L*a*b* color system defined in JIS Z 8729. In the invention the range of the $h_{ab}$ is $190°<h_{ab}<260°$, preferably $195°<h_{ab}<255°$, and more preferably $200°<h_{ab}<250°$.

In the present invention, a matting agent is preferably incorporated into the surface layer of the photothermographic imaging material (on the light sensitive layer side or even in cases where a light insensitive layer is provided on the opposite side of the support to the light sensitive layer). In order to minimize the image abrasion after thermal development, the matting agent is provided on the surface of a photosensitive material and the matting agent is preferably incorporated in an amount of 1 to 30% by weight of the binder.

Materials of the matting agent employed in the invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The matting agent used in the invention preferably has an average particle diameter of 0.5 to 10 $\mu$m, and more preferably of 1.0 to 8.0 $\mu$m. Furthermore, the variation coefficient of the size distribution is preferably not more than 50%, is more preferably not more than 40%, and is still more preferably not more than 30%. The variation coefficient of the grain size distribution as described herein is is a value represented by the following formula:

$$(\text{standard deviation of particle size}/\text{average particle size})\times100.$$

Addition methods of the matting agent include those in which a matting agent is previously dispersed into a coating composition and is then coated, and prior to the completion of drying, a matting agent is sprayed. When plural matting agents are added, both methods may be employed in combination.

Suitable supports used in the photothermographic imaging materials of the invention include various polymeric materials, glass, wool cloth, cotton cloth, paper, and metals (such as aluminum). Flexible sheets or roll-convertible one are preferred. Examples of preferred support used in the invention include plastic resin films such as cellulose acetate film, polyester film, polyethylene terephthalate film, polyethylene naphthalate film, polyamide film, polyimide film, cellulose triacetate film and polycarbonate film, and biaxially stretched polyethylene terephthalate (PET) film is specifically preferred. The support thickness is 50 to 300 $\mu$m, and preferably 70 to 180 $\mu$m.

To improve electrification properties of photothermographic imaging materials, metal oxides and/or conductive compounds such as conductive polymers may be incorporated into the constituent layer. These compounds may be incorporated into any layer and preferably into a sublayer, a backing layer, interlayer between the light sensitive layer and the sublayer. Conductive compounds described in U.S. Pat. No. 5,244,773, col. 14–20.

The photothermographic material of the invention comprises at least one light-sensitive layer on the support, and further thereon, preferably having a light-insensitive layer. For example, a protective layer is provided on the light-sensitive layer. On the opposite side of the support to the light-sensitive layer, a back coating layer is preferably provided to protect the light-sensitive layer or prevent adhesion. Binders used in the protective layer or back coating layer are preferably selected from polymers which have a glass transition point higher than that of the thermally developable layer and are hard to cause abrasion or deformation, such as cellulose acetate and cellulose acetate-butylate.

To adjust contrast, two or more light-sensitive layers may be provided on one side of the support, or one or more layers may be provided on both sides of the support.

It is preferred to form a filter layer on the same side as or on the opposite side to the light sensitive layer or to allow a dye or pigment to be contained in the light sensitive layer to control the amount of wavelength distribution of light transmitted through the light sensitive layer of photothermographic imaging materials relating to the invention. Commonly known compounds having absorptions in various wavelength regions can used as a dye, in response to spectral sensitivity of the photothermographic material.

In cases where the photothermographic imaging material relating to the invention are applied as a image recording material using infrared light is preferred the use of squarilium dye containing a thiopyrylium nucleus (also called as thiopyrylium squarilium dye), squarilium dye containing a pyrylium nucleus (also called as pyrylium squarilium dye), thiopyrylium chroconium dye similar to squarilium dye or pyrylium chroconium. The compound containing a squari-Lium nucleus is a compound having a 1-cyclobutene-2-hydroxy-4one in the molecular structure and the compound containing chroconium nucleus is a compound having a 1-cyclopentene-2-hydroxy,4,5-dione in the molecular structure, in which the hydroxy group may be dissociated. Hereinafter, these dyes are collectively called a squarilium dye.

In the invention, compounds represented by the following formula (1) are preferably employed.

formula (1)

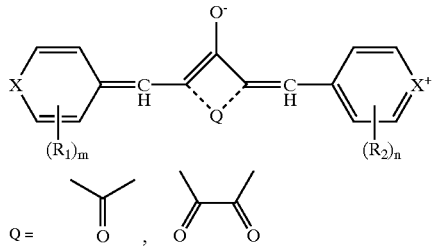

wherein X is a sulfur or oxygen atom; $R_1$ and $R_2$ are each a univalent substituent group; and m and n are each 0, 1, 2, 3 or 4. The substituent groups are not limited, and preferably an alkyl group (e.g., methyl, ethyl, isopropyl, tert-butyl, methoxyethyl, methoxyethoxyethyl,2-ethylhexyl, 2-hexyldecyl, benzyl, etc.) and an aryl group (e.g., phenyl, 4-chlorophenyl, 2,6-dimethylphenyl, etc.), more preferably an alkyl group, and still more preferably tert-butyl. $R_1$ and $R_2$ may combine with each other to form a ring; m and n are each an integer of 0 to 4, and preferably 0, 1 or 2.

Exemplary examples of the compound of formula (1) are shown below.

1-1

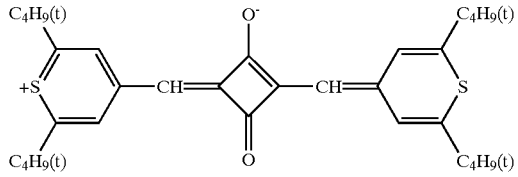

1-2

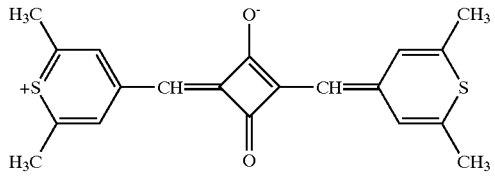

1-3

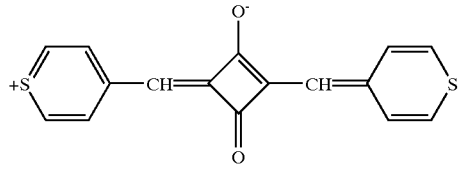

1-4

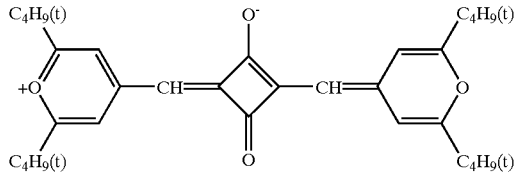

1-5

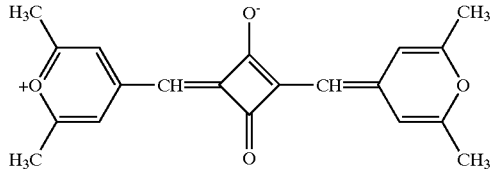

1-6

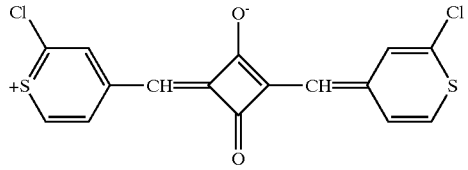

1-7

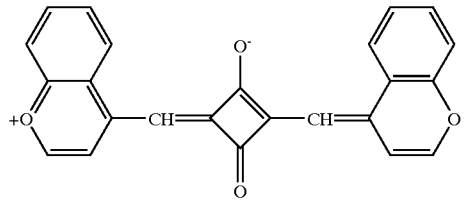

1-8

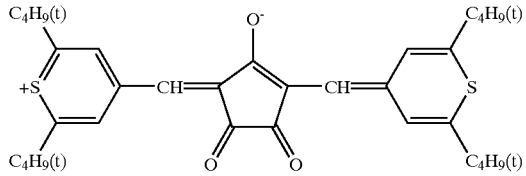

-continued 1-9

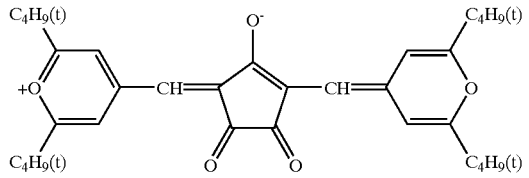

1-10

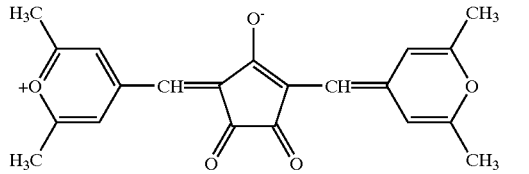

1-11

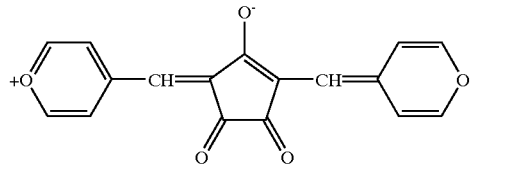

1-12

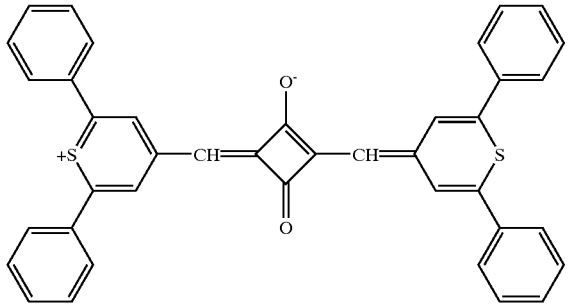

1-13

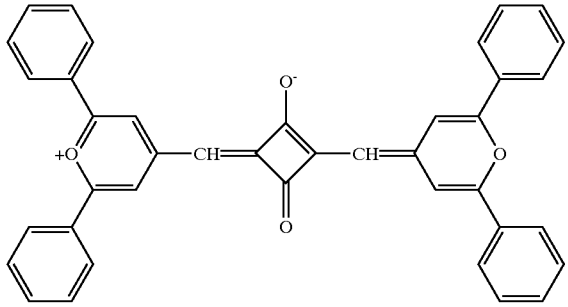

Compounds described in JP-A 8-201959 are also preferably usable as a dye.

Materials used in respective constituent layers are dissolved or dispersed in solvents to prepare coating solutions, which were coated on the support and further subjected to a heating treatment to form a photothermographic material. A coating solution for the light-sensitive layer preferably contains at least 30%, and more preferably at least 50% by weight of water. The amount of solvents are not specifically limited, but the less solvent is more preferred in terms of environment protection and it is preferred that all of solvents used are water. In one preferred embodiment of the invention, plural coating solutions are simultaneously coated to form multi-layers and then subjected to a heating treatment. Thus, coating solutions for respective constituent layers (for example, light-sensitive layer, protective layer) and coating and drying are not repeated for respective layers but plural layers are simultaneously coated and dried to form respective constituent layers. The upper layer is provided before the remaining amount of total solvents in the lower layer reaches 70% or less.

Methods for simultaneously coating plural constituent layers are not specifically limited and commonly known methods, such as a bar coating method, curtain coating method, air-knife method, hopper coating method and extrusion coating method are applicable. Of these, extrusion coating, that is, pre-measuring type coating is preferred. The extrusion coating is suitable for accurate coating or organic solvent coating since no evaporation occur on the slide surface, as in a slide coating system. This coating method is applicable not only to the light-sensitive layer side but also to the case when simultaneously coating a backing layer with the sublayer.

The developing conditions for photographic materials are variable, depending on the instruments or apparatuses used, or the applied means and typically accompany heating the imagewise exposed photothermographic imaging material at an optimal high temperature. Latent images formed upon exposure are developed by heating the photothermographic material at an intermediate high temperature (ca. 80 to 200° C., and preferably 100 to 200° C.) over a period of ample time (generally, ca. 1 sec. to ca. 2 min.). Sufficiently high image densities cannot be obtained at a temperature lower than 80° C. and at a temperature higher than 200° C., the binder melts and is transferred onto the rollers, adversely affecting not only images but also transportability or the thermal processor. An oxidation reduction reaction between an organic silver salt (functioning as an oxidant) and a reducing agent is caused upon heating to form silver images. The reaction process proceeds without supplying any processing solution such as water from the exterior.

Heating instruments, apparatuses and means include typical heating means such as a hot plate, hot iron, hot roller or a heat generator employing carbon or white titanium. In the case of a photothermographic imaging material provided with a protective layer, it is preferred to thermally process while bringing the protective layer side into contact with a heating means, in terms of homogeneous-heating, heat efficiency and working property. It is also preferred to conduct thermal processing while transporting, while bringing the protective layer side into contact with a heated roller.

Exposure of photothermographic imaging materials desirably uses a light source suitable to the spectral sensitivity of the photothermographic materials. An infrared-sensitive photothermographic material, for example, is applicable to any light source in the infrared light region but the use of an infrared semiconductor laser (780 nm, 820 nm) is preferred in terms of being relatively high power and transparent to the photothermographic material.

In the invention, exposure is preferably conducted by laser scanning exposure and various methods are applicable to its exposure. One of the preferred embodiments is the use of a laser scanning exposure apparatus, in which scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photosensitive material is preferably not more than 200 μm, and more preferably not more than 100μm. Thus, the smaller spot diameter preferably reduces the angle displaced from verticality of the laser incident angle. The lower limit of the beam spot diameter is 10 μm. The thus configured laser scanning exposure can reduce deterioration in image quality due to reflected light, such as occurrence of interference fringe-like unevenness.

In the second preferred embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

In the third preferred embodiment of the invention, it is preferred to form images by scanning exposure using at least two laser beams. The image recording method using such plural laser beams is a technique used in image-writing means of a laser printer or a digital copying machine for writing images with plural lines in a single scanning to meet requirements for higher definition and higher speed, as described in JP-A 60-166916. This is a method in which laser light emitted from a light source unit is deflection-scanned with a polygon mirror and an image is formed on the photoreceptor through an fθ lens, and a laser scanning optical apparatus similar in principle to an laser imager.

In the image-writing means of laser printers and digital copying machines, image formation with laser light on the photoreceptor is conducted in such a manner that displacing one line from the image forming position of the first laser light, the second laser light forms an image from the desire of writing images with plural lines in a single scanning. Concretely, two laser light beams are close to each other at a spacing of an order of some ten μm in the sub-scanning direction on the image surface; and the pitch of the two beams in the sub-scanning direction is 63.5 μm at a printing density of 400 dpi and 42.3 μm at 600 dpi (in which the printing density is represented by "dpi", i.e., the number of dots per inch). As is distinct from such a method of displacing one resolution in the sub-scanning direction, one feature of the invention is that at least two laser beams are converged on the exposed surface at different incident angles to form images. In this case, when exposed with N laser beams, the following requirement is preferably met: when the exposure energy of a single laser beam (of a wavelength of λ nm) is represented by E, writing with N laser beam preferably meets the following requirement:

$$0.9\times E \leqq En\times N \leqq 1.1\times E$$

in which E is the exposure energy of a laser beam of a wavelength of λ nm on the exposed surface when the laser beam is singly exposed, and N laser beams each are assumed to have an identical wavelength and an identical exposure energy (En). Thereby, the exposure energy on the exposed surface can be obtained and reflection of each laser light onto the image forming layer is reduced, minimizing occurrence of an interference fringe.

In the foregoing, plural laser beams having a single wavelength are employed but lasers having different wave lengths may also be employed. In such a case, the wavelengths preferably fall within the following range:

$(\lambda-30)<\lambda_1, \lambda_2, \ldots \lambda_n<(\lambda+30)$.

In the first, second and third preferred embodiments of the image recording method of the invention, lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGa laser, AlGaAs laser, GaAsP laser, InGaAs laser, InAsP laser, $CdSnP_2$ laser, and GSb laser; chemical lasers; and dye lasers. Of these, semiconductor lasers of wavelengths of 600 to 1200 nm are preferred in terms of maintenance and the size of the light source. When exposed onto the photothermographic imaging material in the laser imager or laser image-setter, the beam spot diameter on the exposed surface is 5 to 75 um as a minor axis diameter and 5 to 100 μm as a major axis diameter The laser scanning speed is set optimally for each photothermographic material, according to its sensitivity at the laser oscillation wavelength and the laser power.

It is preferred that when subjected to thermal development, the photothermographic imaging material contains an organic solvent of 5 to 100 mg/m$^2$. The organic solvent content is more preferably 100 to 500 mg/m$^2$. The solvent content within the range described above leads to a thermally developable photosensitive material with low fog density as well as high sensitivity. Examples of solvents include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, dimethylene glycol, triethylene glycol, propylene glycol and hexylene glycol; ether alcohols such as ethylene glycol monomethyl ether, and dimethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limiting these examples. These solvents may be used alone or in combination.

The solvent content in the photothermographic material can be adjusted by varying conditions such as temperature conditions at the drying stage, following the coating stage. The solvent content can be determined by means of gas chromatography under conditions suitable for detecting the solvent.

EXAMPLES

The present invention will be further described based on examples but embodiments of the invention are by no means limited to these examples.

Example 1

Preparation of Photographic Support

On one side of blue-tinted polyethylene terephthalate film (having a thickness of 175 μm) exhibiting a density of 0.170 which was previously subjected to a corona discharge treatment at 0.5 kV·A·min/m$^2$, sublayer A was coated using the following sublayer coating solution A-1 so as to have a dry layer thickness of 0.2 μm. After the other side of the film was also subjected to a corona discharge treatment at 0.5 kV·A·min/m$^2$, sublayers B and A were coated thereon using sublayer coating solutions B-1 and A-1 described below so as to have dry layer thickness of 0.1 and 0.2 $\mu$m, respectively. Thereafter, a heating treatment was conducted at 130° C. for 15 min in a heating treatment type oven having a film transport apparatus provided with plural rolls.

Sub-coating solution A-1

Copolymer latex solution (30% solids) of 270 g, comprised of 40% by weight of n-butyl acrylate, 10% by weight of t-butyl acrylate, 25% by weight of styrene and 25% by weight of 2-hydroxyethyl acrylate was mixed with 0.6 g of compound (UL-1) and 1 g of methyl cellulose. Further thereto a dispersion in which 1.3 g of silica particles (SILOID, available from FUJI SYLYSIA Co.) was previously dispersed in 100 g of water by a ultrasonic dispersing machine, Ultrasonic Generator (available from ALEX Corp.) at a frequency of 25 kHz and 600 W for 30 min., was added and finally water was added to make 100 ml to form sub-coating solution A-1.

UL-1

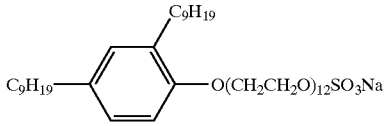

Synthesis of Colloidal Tin Oxide Dispersion

Stannic chloride hydrate of 65 g was dissolved in 2000 ml of water/ethanol solution. The prepared solution was boiled to obtain co-precipitates. The purified precipitate was taken out by decantation and washed a few times with distilled water. To the water used for washing, aqueous silver nitrate was added to confirm the presence of chloride ions. After confirming no chloride ion, distilled water was further added to the washed precipitate to make the total amount of 2000 ml. After adding 40 ml of 30% ammonia water was added and heated, heating was further continued and concentrated to 470 ml to obtain a colloidal tin oxide dispersion.

Sub-coating Solution B-1

The foregoing colloidal tin oxide dispersion of 37.5 g was mixed with 3.7 g of copolymer latex solution (30% solids) comprised of 10% by weight of n-butyl acrylate, 35% by weight of t-butyl acrylate, 27% by weight of styrene and 28% by weight of 2-hydroxyethyl acrylate, 14.8 g of copolymer latex solution (30% solids) comprised of 40% by weight of nobutyl acrylate, 20% by weight of styrene and 40% by weight of glycidyl methacrylate, and 0.1 g of surfactant UL-1 (as a coating aid) and water was further added to make 1000 ml to obtain sub-coating solution B-1.

Back Layer-side Coating

A back layer coating solution having a composition shown below was prepared. The coating solution was coated on the sublayer B of the support and dries so as to form a dry layer of 3 $\mu$m. Drying was conducted at a drying temperature of 100° C. and a dew point of 10° C. over a period of 5 min.

Back Layer Coating Solution 1

To 784 g of methyl ethyl ketone, 4.5 g of polyester resin (Vitel PE2200B, available from Bostic Corp.) and 84 g of cellulose acetate-butyrate (CAB381-20, available from Eastman Chemical Co.) were added and dissolved. To the resulting solution were added 0.50 g of infrared dye 1, 4.5 g fluorinated surfactant FS-1 and 1.79 g fluorinated surfactant (EF-105, available from TOCHEM PRODUCT Co.) were further added with sufficiently stirring until being dissolved. To the resulting solution was added 57 g of silica particles (SILOID, available from FUJI SYLYSIA Co.), which were previously added to methyl ethyl ketone in a concentration of 2% by weight and dispersed for a period of 45 min. Finally, compounds relating to the invention, as shown in Table 1 were added and methyl ethyl ketone was further added to make a total weight of 1000 g. Thus, back layer coating solutions 101 through 109 were obtained. Further, a dispersion, in which 2.0 g of a solid lubricant shown in Table 1 and 2.0 g of powdery polyvinyl butyral (EL-5, available from Sekisui Chemical Co., Ltd.) shown in Table 1 were previously dispersed in 100 g of methyl ethyl ketone by a ultrasonic dispersing machine, Ultrasonic Generator (available from ALEX Corp.) at a frequency of 25 kHz and 600 W for 30 min., was added in an amount, as shown in Table 1.

The thus prepared coating solutions were each coated on the support using an extrusion coater and dries so as to form a dry layer of 3.5 $\mu$m. Drying was conducted at a dry bulb temperature of 100° C. and a dew point of 10° C. over a period of 5 min. to obtain backing side-coated samples 101 through 109.

Evaluation

Spectral Absorption

The backing side-coated samples were each measured with respect to spectral absorption at the wavelength of 400 nm, using a spectrometer (HITACHI Spectrometer, U-3300).

Coefficient of dynamic friction

Using Surface Tester, HEIDON-14 (available form SHINTOH KAGAKU Co., Ltd.), a coefficient of dynamic friction between the back surface of each sample and stainless steel. The measurement was made with maintaining the measured surface at a temperature of 110° C. on a hot plate.

Haze

Haze was measured using turbidimeter Model T-2600DA, available from TOKYO DENSHOKU Co., Ltd., which was represented in terms od percentage.

Infared dye-1 (IR-1)

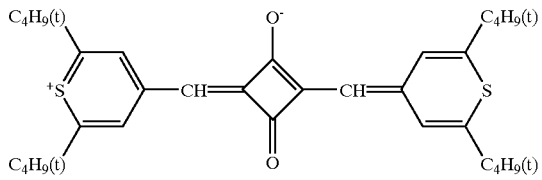

FS-1

$C_9H_{17}-O(CH_2CH_2O)_{22}-C_9F_{17}$

FS-2

$(i)C_9F_{19}-CH_2CHCH_2O-(CH_2CH_2O)_{22}-CH_2CHCH_2-C_9F_{19}(i)$
OH OH

FS-3

$C_7F_{15}SO_3^{-+}NH_3(CH_2CH_2O)_{12}CH_2CH_2NH_3^{+-}O_3SC_7F_{15}$

Desmodur N3300 (isocyanate compound)

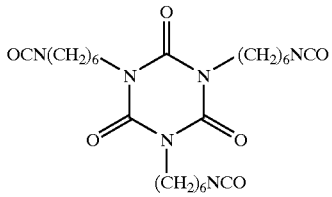

-continued

KBM-573 (silane coupling agent)

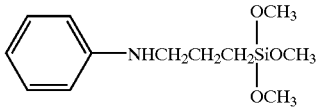

TABLE 1

| Back-coated Sample | Compound: Infrared Dye (mg/m$^2$) | Compound: Solid Lubricant (mg/m$^2$) | Compound: Sur-factant | Compound: Compound Reactive with Hydroxy Group (mg/m$^2$) | Absorb-ance (400 nm) | Coeffi-cient of Kinetic Friction ($\mu$k) | Haze (%) | Re-mark |
|---|---|---|---|---|---|---|---|---|
| 101 | IR-1 (30) | None | FS-3 | None | 0.087 | 0.63 | 8.5 | Comp. |
| 102 | IR-1 (30) | BN (50) | FS-3 | None | 0.085 | 0.35 | 9.3 | Inv. |
| 103 | 1-1 (10) | BN (50) | FS-2 | None | 0.046 | 0.36 | 8.6 | Inv. |
| 104 | 1-1 (10) | BN (100) | FS-2 | None | 0.053 | 0.22 | 8.4 | Inv. |
| 105 | 1-1 (10) | BN (75) | FS-1 | None | 0.035 | 0.25 | 8.3 | Inv. |
| 106 | 1-1 (10) | BN (75) | FS-1 | Desmodur N3300 (100) | 0.032 | 0.23 | 7.5 | Inv. |
| 107 | 1-1 (10) | BN (75) | FS-1 | KBM-573 (100) | 0.025 | 0.30 | 7.6 | Inv. |
| 108 | IR-1 (30) | Comp-1 (75) | FS-3 | None | 0.082 | 0.65 | 10.5 | Comp. |
| 109 | IR-1 (30) | Comp-2 (75) | FS-3 | None | 0.085 | 0.56 | 11.6 | Comp. |

Comp-1: SILDEX H51 (silica particles having an average size of 5 $\mu$m, available from DOKAI KAGAKU Co., Ltd.)
Comp-2: MX-500 (PMMA particles having an average size of 5 $\mu$m, available from SOKEN KAGAKU Co., Ltd.)
BN: boron nitride (DENKA BORON NITRIDE SG-2)

As shown in Table 1, back-coated samples (support) exhibiting a lowering of a coefficient of dynamic friction, minimized coloring and haze, and enhanced transparency were obtained by the use of compounds relating to the invention.

Example 2

Preparation of Light Sensitive Silver Halide Emulsion A-2

In 900 ml of deionized water were dissolved 7.5 g of gelatin having an average molecular weight of 100,000 and 10 mg of potassium bromide. After adjusting the temperature and the pH to 35° C. and 3.0, respectively, 370 ml of an aqueous solution containing 74 g silver nitrate and an equimolar aqueous halide solution containing potassium bromide, potassium iodide (in a molar ratio of 98 to 2) were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 $\mu$m, a variation coefficient of the projection area equivalent diameter of 10 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion A-2. The thus obtained photosensitive emulsion grains were measured with respect to the average iodide content in the vicinity of the grain surface and it was proved to be 4.0 mol %.

Preparation of Powdery Organic Silver Salt A-2

In 4720 ml water were dissolved 324 g of behenic acid, 99 g of arachidic acid and 56 g of stearic acid at 80° C. Then, after adding 980 ml of 1.5M aqueous sodium hydroxide solution with stirring and further adding 9.3 ml of concentrated nitric acid, the solution was cooled to a temperature of 55° C. to obtain an aqueous organic acid sodium salt solution. To the solution were added the silver halide emulsion A obtained above (containing equivalent to 0.09 mol silver and 1400 g water) and stirring further continued for 5 min., while maintained at a temperature of 55° C. Subsequently, 1470 ml of 1 M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 $\mu$S/cm, and after subjecting to centrifugal dehydration, the reaction product was dried with heated air at 37° C. until no reduction in weight was detected to obtain powdery organic silver salt A.

Preparation of Light Sensitive Emulsion Dispersing Solution A-2

In 1457 g methyl ethyl ketone was dissolved 14.57 g of polyvinyl butyral powder (Eslex BL-5, available from Sekisui Kagaku Co., Ltd.) and further thereto was gradually added 500 g of the powdery organic silver salt A-2 with stirring by a dissolver type homogenizer. Thereafter, the mixture was dispersed using a media type dispersion machine (available from Gettzmann Corp.), which was packed 1 mm Zr beads (available from Toray Co. Ltd.) by 80%, at a circumferential speed of 13 m and for 3 min. of a retention time with a mill to obtain photosensitive emulsion dispersing solution A.

Preparation of Infrared Sensitizing Dye Solution

Infrared sensitizing dye 1 of 350 mg, 13.96 g of 2-chlorobebzoic acid and 2.14 g of 5-methyl-2-mercaptobenzimidazole were dissolved in 73.4 g of methanol in a dark room to obtain an infrared sensitizing dye solution.

Preparation of Stabilizer Solution

Stabilizer 1 of 1.0 g and 0.5 g of potassium acetate were dissolved in 8.5 g of methanol to obtain a stabilizer solution.

Preparation of Developer Solution

Developing agent 1 of 17.74 g was dissolved in methyl ethyl ketone to make 100 ml of a developer solution.

Preparation of Antifoggant Solution

Antifoggant 1 of 5.81 g was dissolved in methyl ethyl ketone to make 100 ml of a stabilizer solution.

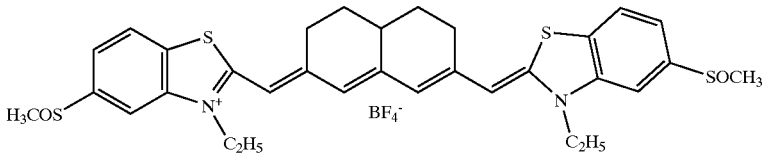

Infrared sensitizing dye 1

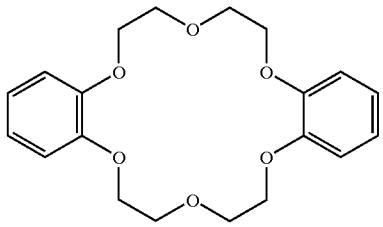

Stabilizer 1

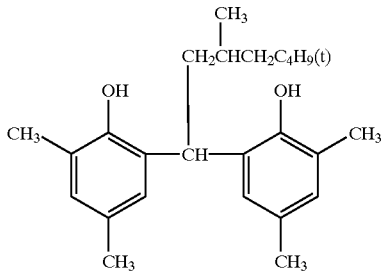

Developing agent 1

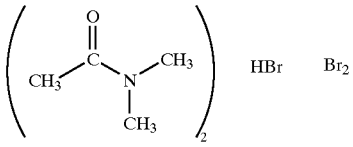

Antifoggant 1

Preparation of Image forming Layer Coating solution A-2

Light sensitive emulsion dispersing solution A-2 of 50 g and 15.11 g of methyl ethyl ketone were mixed and maintained at 21° C., and 390 μl of 10% antifoggant 1 methanol solution was added thereto and stirred for 1 hr. Further thereto, 889 μm of 10% calcium bromide methanol solution of calcium bromide was added and stirred for 30 min. Subsequently, 1.416 ml of infrared sensitizing dye solution and 667 μl of stabilizer solution were added thereto and stirred for 1 hr. and then cooled to a temperature of 13° C. and further stirred for 30 min. Further, 13.31 g of polyvinyl butyral (BL-5, available from Sekisui Kagaku Co., Ltd.) was added thereto and sufficiently dissolved with stirring for 30 min., while maintaining the temperature at 13° C.; then, the following additives were added at intervals of 15 min.

| | |
|---|---|
| Phthalazine | 305 mg |
| Tetrachlorophthalic acid | 102 mg |
| 4-Methylphthalic acid | 137 mg |

Then, after stirring for 15 min., the following additives were successively added with stirring to obtain an image forming layer coating solution:

| | |
|---|---|
| Antifoggant solution (above-described) | 5.47 ml |
| Developer solution (above-described) | 14.06 ml |

Finally, compounds relating to the invention, as shown in Table 2 were added thereto to obtain image forming layer coating solutions 201 through 211.

Preparation of Surface Protective Layer Coating Solution

There was prepared a surface protective layer coating solution having the following composition.

Fine Particle Dispersing Solution

To 96 g of methyl ethyl ketone, 1 g of cellulose acetate-butyrate (CAB171-15, available from Eastman Chemical Co.) was added with stirring and stirring further continued by a dissolver type stirrer until being completely dissolved. Further thereto, 2.9 g of Silica particles (SYLOID 320 , available from FUJI SYLYSIA Co.) was added and stirred at 8000 rpm for 45 min.

Surface Protective Layer Coating Solution

To 750 g of methyl ethyl ketone, 15 g of polymethyl methacrylate (Paraloid A-21, available from Rohm & Haas Corp.) was added stirred for 10 min. Then, 100 g of cellulose acetate-butyrate (CAB171-15, available from Eastman Chemical Co.) was divided into four portions, each of them was separately added and stirred for 1 hr. Further thereto, 8.9 g of phthalazine, 1.5 g of 1,3 vinylsilfone compound (HD-1), 0.1 g of triazine, and 0.2 g of fluorinated surfactant (EF-105, available from TOCHEM PRODUCT Co.) were added and dissolved for 30 min. Further thereto, the foregoing dispersing solution of 85 g was added with stirring. Finally, compounds relating to the invention, as shown in Table 2 was further added thereto and methyl ethyl ketone was added to make a total amount of 1000 g to obtain surface protective coating solutions 201 through 211.

Further, a dispersion, in which 2.0 g of a solid lubricant shown in Table 21 and 2.0 g of powdery polyvinyl butyral (BL-5, available from Sekisui Chemical Co., Ltd.) shown in Table 2 were previously dispersed in 100 g of methyl ethyl ketone by a ultrasonic dispersing machine, Ultrasonic Generator (available from ALEX Corp.) at a frequency of 25 kHz and 600 W for 30 min., was added in an amount, as shown in Table 1.

Vinylsulfone compound (HD-1)

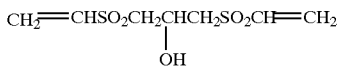

Image Forming Layer-side Coating

On back coat sample 101 of Example 1, the image forming layer coating solution and surface protective layer coating solution were successively coated on the sublayer A of the support using an extrusion coater. Coating was conducted at a coating speed of 30 m/min so as to form an image forming layer having a silver coverage of 2.0 g/m$^2$ and drying was conducted for 5 min with hot air of a dry bulb temperature of 50° C. and a dew point of 10° C. Similarly, the protective layer was coated and dried with hot air of a dry bulb temperature of 55° C. and a dew point of 10° C. for 15 min.

As shown in Table 2, silver salt photothermographic imaging material Sample Nos. 201 through 211 were thus obtained.

Exposure and Thermal Processing

Samples each were subjected to laser scanning exposure from the emulsion side using an exposure apparatus having a light source of 800 to 820 nm semiconductor laser of longitudinal multi-mode, which was made by means of high frequency overlapping. In this case, exposure was conducted at an angle of 70°, between the exposed surface and exposing laser light and as a result, images with superior sharpness were unexpectedly obtained, as compared to exposure at an angle of 90°. Subsequently, using an automatic processor provided with a heated drum, exposed samples were subjected to thermal development at 123° C. for 13.5 sec., while bringing the protective layer surface of the photothermographic material into contact with the drum surface. Thermal development was conducted in an atmosphere at 23° C. and 50% RH.

Transport Test 100 identical size sheets of each sample were continuously subjected to thermal processing and the number of transport troubles occurred were counted.

Abrasion Mark

Further, samples were tested with respect to abrasion resistance according to the following manner. Thus, photothermographic material samples, immediately after being subjected to thermal processing, were measured with respect to hardness, according to the pencil hardness measuring method described in JIS K 5200. Each sample was placed on a sample table and scratched for a length of 1 cm by a pencil with pressing the top of pencil onto the surface of the sample at an angle of 45°. The scratching was repeated five times using pencils having identical density term (such as HB, F, B, 2B, H, 2H, etc.) at the time when two or more times produced abrasion marks was designated as the pencil hardness.

Silver Image Tone

Photothermographic material samples were exposed and thermally developed so as to have a density of 1.0±0.05. The thus processed samples were placed on a light source plate and exposed to light having a color temperature of 7700° K. and an illumination intensity of 11600 lux. for a period of 10 or 100 hrs. Samples were evaluated with respect to silver image tone, based on the following criteria, in which ranks of 4 or 5 are acceptable levels in practical use quality assurance:

5: neutral black tone and no yellowish tone,

4: not neutral black tone but substantially no yellowish tone observed,

3: slightly yellowish tone was partially observed,

2: slightly yellowish tone was overall observed,

1: yellowish tone was apparent.

Development Uniformity

Samples were entirely exposed to white light for 20 sec. and developed. The thus processed samples were visually evaluated with respect to uniformity of development uniformity on the sample surface, based on the following criteria:

5: Uniform surface and no problem,

4: Protrusion slightly observed but no problem in practical use,

3: Protrusion partially observed and slight problem in practical use,

2: Protrusion entirely observed,

1: marked protrusion observed.

TABLE 2

| | Protective Layer Coating Solution | | | | Emulsion Layer Coating Solution | | |
|---|---|---|---|---|---|---|---|
| Sample No. | Solid Lubricant (mg/m$^2$) | Silane Coupling Agent (mg/m$^2$) | Isocyanate Compound (mg/m$^2$) | Sur-factant | Infrared Dye (mg/m$^2$) | Silane Coupling Agent (mg/m$^2$) | Remark |
| 201 | None | None | None | FS-3 | IR-1 (35) | None | Comp. |
| 202 | BN (50) | None | None | FS-3 | IR-1 (30) | None | Inv. |
| 203 | BN (50) | None | None | FS-2 | 1-1 (11) | None | Inv. |
| 204 | BN (100) | None | None | FS-2 | 1-1 (11) | None | Inv. |
| 205 | BN (75) | None | Desmodur N3300 (100) | FS-1 | 1-1 (11) | None | Inv. |
| 206 | BN (75) | KBM-573 (50) | Desmodur N3300 (100) | FS-1 | 1-1 (11) | None | Inv. |
| 207 | BN (75) | KBM-573 (50) | None | FS-1 | 1-1 (11) | KBM-573 (100) | Inv. |
| 208 | BN (75) | None | None | FS-2 | 1-1 (11) | KBM-573 (200) | Inv. |
| 209 | Comp-1 (75) | None | None | FS-3 | IR-1 (33) | None | Comp. |
| 210 | Comp-1 (75) | None | Desmodur N3300 (100) | FS-1 | IR-1 (33) | None | Comp. |
| 211 | Comp-2 (75) | KBM-573 (50) | | FS-1 | IR-1 (33) | KBM-573 (200) | Comp. |

TABLE 3

| Sample No. | Haze (%) | Transportability | Abrasion Mark | Development Uniformity | Silver Tone 10 hr. | Silver Tone 100 hr. | Remark |
|---|---|---|---|---|---|---|---|
| 201 | 24.7 | 11 | 3B | 2 | 4 | 2 | Comp. |
| 202 | 25.0 | 0 | B | 4 | 4 | 4 | Inv. |
| 203 | 24.6 | 1 | B | 4 | 5 | 4 | Inv |
| 204 | 24.9 | 0 | B | 4 | 5 | 4 | Inv. |
| 205 | 24.2 | 1 | HB | 5 | 5 | 5 | Inv. |
| 206 | 23.4 | 0 | HB | 5 | 5 | 5 | Inv. |
| 207 | 23.5 | 0 | HB | 5 | 5 | 5 | Inv. |
| 208 | 24.3 | 0 | B | 4 | 5 | 4 | Inv. |
| 209 | 27.8 | 9 | 3B | 2 | 4 | 2 | Comp. |
| 210 | 27.9 | 11 | 4B | 2 | 4 | 2 | Comp. |
| 211 | 28.2 | 10 | 3B | 2 | 4 | 2 | Comp. |

As shown in Tables 2 and 3, the use of compounds relating to the invention led to silver salt photothermographic dry imaging materials exhibiting minimized coefficient of dynamic friction, enhanced abrasion resistance, minimized unevenness in development, superior silver image tone and little variation in image tone even when exposed to light for a long period of time.

Example 3

Preparation of Light-sensitive Silver Halide Emulsion B-3

| | |
|---|---|
| Solution A1 | |
| Phenylcarbamoyl gelatin | 88.8 g |
| Compound (A) (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Water to make | 1982 ml |
| Solution E1 | |
| 0.4 mol/l aqueous potassium bromide solution | |
| Amount necessary to adjust silver potential | |
| Solution F1 | |
| Potassium hydroxide | 0.71 g |
| Water to make | 20 ml |
| Solution G1 | |
| Aqueous 56% acetic acid solution | 18 ml |
| Solution H1 | |
| Anhydrous sodium carbonate | 1.72 g |

Compound A: $HO(CH_2CH_2O)_n—(CH(CH_3)CH_2O)_mH$
(m + n = 5 to 7)

Using a stirring mixer described in JP-B Nos. 58-58288 and 58-58289, ¼ of solution B1, the total amount of solution C1 were added to solution A1 by the double jet addition for 4 min 45 sec. to form nucleus grain, while maintaining a temperature of 45° C. and a pAg of 8.09. After 1 min., the total amount of solution F1 was added thereto, while the pAg was adjusted using solution E1. After 6 min, ¾ of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution G1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution Hl was added. The temperature was raised to 60° C. and stirring continued for 120 min. Finally, the pH was adjusted to 5.8 and water was added there to so that the weight per mol of silver was 1161 g, and light-sensitive silver halide emulsion B-3 was thus obtained. It was proved that the resulting emulsion was comprised of monodisperse silver iodobromide cubic grains having an average grain size of 0.058 μm, a coefficient of variation of grain size of 12% and a [100] face ratio of 92%.

Preparation of Powdery Organic Silver Salt B-3

Behenic acid of 130.8 g, arachidic acid of 67.7 g, stearic acid of 43.6 g and palmitic acid of 2.3 g were dissolved in 4720 ml of water at 90° C. Then, 540.2 ml of aqueous 1.4 mol/l NaOH was added, and after further adding 6.9 ml of concentrated nitric acid, the mixture was cooled to 55° C. to obtain a fatty acid sodium salt solution. To the thus obtained fatty acid sodium salt solution, 45.3 g of light-sensitive silver halide emulsion B-3 obtained above and 450 ml of water were added and stirred for 5 min., while being maintained at 55° C. Subsequently, 760 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm. Using a flush jet dryer (produced by Seishin Kigyo Co., Ltd.), the thus obtained cake-like organic silver salt was dried under an atmosphere of inert gas (i.e., nitrogen gas) having a volume ratio shown in Table 1, according to the operation condition of a hot air temperature at the inlet of the dryer until reached a moisture content of 0.1%. The moisture content was measured by an infrared ray aquameter.

Preparation of Pre-dispersion B-3

In 1457 g MEK was dissolved 14.57 g of polyvinyl butyral powder (BL-5, available from Sekisui Kagaku Kogyo Co., Ltd.) and further thereto was gradually added 500 g of the powdery organic silver salt B-3 to obtain pre-dispersion B-3, while stirring by a dissolver type homogenizer (DISPERMAT Type CA-40, available from VMA-GETZMANN).

Preparation of Light-sensitive Emulsion B-3

Thereafter, using a pump, the pre-dispersion A was transferred to a media type dispersion machine (DISPERMAT Type SL-C12 EX, available from VMA-GETZMANN), which was packed 1 mm Zirconia beads (TORAY-SELAM, available from Toray Co. Ltd.) by 80%, and dispersed at a circumferential speed of 8 m/s and for 1.5 min. of a retention time with a mill to obtain light-sensitive emulsion B-3.

Preparation of Stabilizer Solution

In 4.97 g methanol were dissolved 1.0 g of Stabilizer-1 and 0.31 g of potassium acetate to obtain stabilizer solution.

Preparation of Infrared Sensitizing Dye Solution A

In 31.3 ml MEK were dissolved 19.2 mg of infrared sensitizing dye (SD-1), 1.488 g of 2-chlorobenzoic acid, 2.779 g of Stabilizer-2 and 365 mg of 5-methyl-2-mercaptobenzimidazole in a dark room to obtain an infrared sensitizing dye solution A.

Preparation of Additive Solution a

In 110 g MEK were dissolved 27.98 g of developer 1,1-bis (2-hydroxy-3, 5-dimethylphenyl)-2-methylpropane, 1.54 g of 4-methylphthalic acid and 0.48 g of the infrared dye-1 to obtain additive solution a.

Preparation of Additive Solution b

Antifoggants-1 and -2, each of 1.78 g were dissolved in 40.9 g MEK to obtain additive solution b.

Preparation of Additive Solution c

Silver-saving agent H-38 of 5.0 g was dissolved in 45.0 g MEK to obtain additive solution c.

Preparation of Light-sensitive Layer Coating Solution B-3

Under inert gas atmosphere (97% nitrogen), 50 g of the light-sensitive emulsion B-3 and 15.11 g MEK were maintained at 21° C. with stirring, 1000 μl of chemical sensitizer S-5 (0.5% methanol solution) was added thereto and after 2 min., 390 μm of antifoggant-2 (10% methanol solution) was added and stirred for 1 hr. Further thereto, 494 μl of calcium bromide (10% methanol solution) was added and after stirring for 10 min., gold sensitizer Au-5 of 1/20 equimolar amount of the chemical sensitizer was added and stirred for 20 min. Subsequently, 167 ml of the stabilizer solution was added and after stirring for 10 min., 1.32 g of infrared sensitizing dye solution A was added and stirred for 1 hr. Then, the mixture was cooled to 13° C. and stirred for 30 min. Further thereto, 13.31 g of polyvinyl butyral (BL-5, available from Sekisui Kagaku Co., Ltd.) was added and stirred for 30 min, while maintaining the temperature at 13° C., and 1.084 g of tetrachlorophthalic acid (9.4% MEK solution) and stirred for 15 min. Then, 12.43 g of additive solution a, 1.6 ml of 10% MEK solution of Desmodur N3300 (aliphatic isocyanate, product by Movey Co.) and 4.27 g of additive solution b were successively added with stirring to obtain coating solution C-3 of the light-sensitive layer.

Preparation of Light-sensitive Layer Coating Solution C-3

Under inert gas atmosphere (97% nitrogen), 50 g of the light-sensitive emulsion 1 and 15.11 g MEK were maintained at 21° C. with stirring, 1000 μl of chemical sensitizer S-5 (10% methanol solution) was added thereto and after 2 min., 390 μm of antifoggant-2 (10% methanol solution) was added and stirred for 1 hr. Further thereto, 494 μm of calcium bromide (10% methanol solution) was added and after stirring for 10 min., gold sensitizer Au-5 of 1/20 equimolar amount of the chemical sensitizer was added and stirred for 20 min. Subsequently, 167 ml of the stabilizer solution was added and after stirring for 10 min., 1.32 g of the infrared sensitizing dye solution A was added and stirred for 1 hr. Then, the mixture was cooled to 13° C. and stirred for 30 min. Further thereto, 13.31 g of polyvinyl butyral (Bl-5, available from Sekisui Chemical Co., Ltd.) was added and stirred for 30 min, while maintaining the temperature at 13° C., and 1.084 g of tetrachlorophthalic acid (9.4% MEK solution) and stirred for 15 min. Then, 12.43 g of additive solution a, 1.6 ml of 10% MEK solution of Desmodur N3300 (aliphatic isocyanate, product by Movey Co.) and 4.27 g of additive solution b were successively added with stirring to obtain coating solution C-3 of the light-sensitive layer.

Preparation of Silver Salt Photothermographic Imaging Material

FIG. 1 illustrates a coating apparatus used in the invention, wherein "1" represents a support, "2" represents a back-up roll, "3" represents a coating die for use in a single layer coating, "4" represents a coating solution, and two layer can be simultaneously coated using two coating dies.

Figure 2:
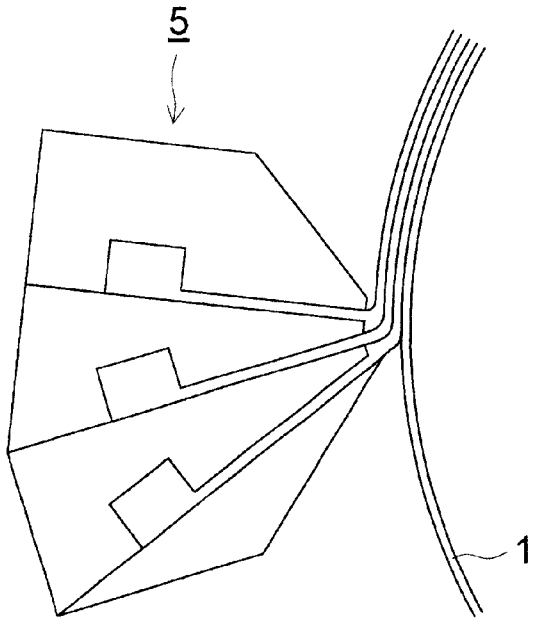
FIG. 2 illustrates an extrusion type die coater used in the invention.

FIG. 2 illustrated an extrusion type die coater, in which coating solution ejected from three slits are simultaneously coated on a support backed-up from the rear side. In FIG. 2, "5" represents a coating die to simultaneously coat three layers.

The foregoing light-sensitive layer coating solution (B-3) and light-sensitive layer coating solution (C-3) and protective layer coating solution No. 201, 203, 205 or 206 were simultaneously coated on the back-coated support sample 101 or 106 of Example 1 to form light-sensitive layer B and light-sensitive layer C and a surface protective layer, using the extrusion type coated shown in FIG. 1. Photothermographic material samples No. 302 through 309 were thus prepared so that the silver coverage of light-sensitive layers B and C were 0.7 and 0.3 g/m$^2$, respectively, and the dry layer thickness of the protective layer was 2.5 μm. Drying was conducted at a dry bulb temperature of 50° C. and a dew point of 10° C. for a period of 10 min. Comparative sample No. 301 was prepared by coating light-sensitive layer coating solution (B-3) and protective layer coating solution No. 201 in accordance with the method of Example 2 so as to have a silver coverage of 2 g/m$^2$.

Exposure and Processing

The thus prepared photothermographic material samples Nos. 301 through 309 were each subjected to semiconductor laser scanning exposure. In this case, exposure was conducted at 75° of an angle between the exposed surface and exposing laser light and as a result, images with superior sharpness were unexpectedly obtained, as compared to exposure at an angle of 90°. The exposed photothermographic material was subjected to thermal development at 123° C. for 13.5 sec., using a modified Dry Pro 722 (available from Konica Corp.), while bringing the protective layer surface of the photothermographic material into contact with the heated drum surface. Exposure and thermal development were carried out in an atmosphere of 23° C and 50% RH.

The thus obtained images were evaluated according to the following procedure.

Evaluation of Photographic Performance

Each sample was processed and subjected to sensitometry. Thus, Samples 100 through 108 were each allowed to stand at 25° C. and 55% RH for 10 days and using Dry Pro 722 at room temperature, samples were stepwise exposed with decreasing the exposure energy by log E of 0.5, step by step from the maximum output and automatically developed at 123° C. for 13.5 sec. The thus processed samples were subjected to sensitometry using transmission densitometer PDM65 (available from Konica Corp.) and the obtained results were subjected to computer processing to obtain characteristic curves. From the obtained characteristic curve, a mean gradation, Ga between densities of 0.25 and 2.5 was determined. Sensitivity was represented by a relative value of the reciprocal of exposure giving a density of 1.0 plus the minimum density (Dmin), based on the sensitivity of Sample No. 301 being 100. Results are shown in Table 4.

The hue angle ($h_{ab}$) was determined in such a manner that processed samples were measured with respect to areas corresponding to the minimum density and an optical density (D) of 1.0, using an ordinary light source, D65 of JIS Z 8720 and a spectral colormeter CM-508d (available from Minolta Co., Ltd.) at a visual field of 2°.

The color temperature was measured in such a manner that each film sample having an optical density of 1.0 was placed on a viewing box (using a white fluorescent lamp and a diffusion plate) and measured using a spectral radiation luminance meter (SR-1, available from TOPCON Co., Ltd.).

Evaluation of Storage Stability

Samples 301 through 309 were aged for 10 days under the following condition A or B, exposed and processed, and obtained images were subjected to densitometry, then, the difference between densities under the conditions A and B, i.e., Dmin(B)-Dmin(A) was determined as a measure of storage stability:

Condition A: 25° C. and 55% RH

Condition B: 40° C. and 80% RH.

Evaluation of Image Storage Stability

Similarly to the evaluation of photographic performance, after allowed to stand for 10 days under condition, samples were each exposed and processed and after allowed to stand for 7 days at 25° C. and 55% RH under a fluorescent lamp, each sample was evaluated with respect to image color tone, based on the following criteria:

5: No problem in image tone,

4: Substantially no problem in image to for practice,

3: Slightly yellowish but acceptable levels to practice

2: Unpleasant image tone and possibly problem in practice,

1: Marked changes in image tone and unacceptable levels to practice.

Transportability and haze were each evaluated similarly to Example 2. Results are shown in Table 4.

-continued

S-5

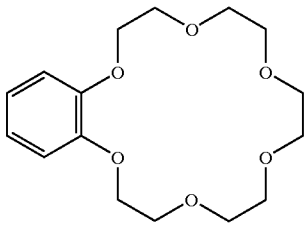

Au-5

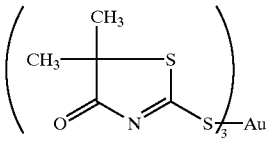

I-1

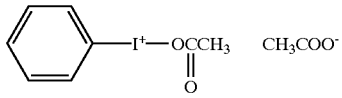

TABLE 4

| Sample No. | Back Coat Support Sample | Protective Layer Solution | Anti-fog-gant | Haze (%) | Transportability | Silver Tone Fresh | Silver Tone Aging | Average Contrast (Ga) | Sensitivity | Hue Angle $h_{ab}$ Dmin | Hue Angle $h_{ab}$ D-1.0 | Remark |
|---|---|---|---|---|---|---|---|---|---|---|---|---|
| 301 | 101 | 201 | — | 24.8 | 11 | 4 | 2 | 2.5 | 100 | 185 | 265 | Comp. |
| 302 | 101 | 201 | — | 18.8 | 26 | 4 | 2 | 3.1 | 95 | 200 | 240 | Comp. |
| 303 | 101 | 203 | — | 16.8 | 0 | 4 | 4 | 3.3 | 104 | 205 | 242 | Inv. |
| 304 | 101 | 203 | I-1 | 16.6 | 1 | 5 | 5 | 3.4 | 103 | 206 | 246 | Inv. |
| 305 | 101 | 205 | I-1 | 17.7 | 0 | 5 | 5 | 3.5 | 103 | 205 | 246 | Inv. |
| 306 | 106 | 201 | I-1 | 17.8 | 1 | 5 | 4 | 3.1 | 105 | 201 | 240 | Inv. |
| 307 | 106 | 203 | I-1 | 17.3 | 0 | 5 | 5 | 3.2 | 102 | 204 | 243 | Inv. |
| 308 | 106 | 205 | I-1 | 16.7 | 0 | 5 | 5 | 3.1 | 103 | 202 | 241 | Inv. |
| 309 | 106 | 206 | I-1 | 17.9 | 0 | 5 | 4 | 3.1 | 102 | 201 | 245 | Inv. |

Anti-foggant 2

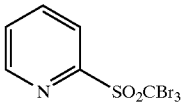

Silver-saving agent H-38

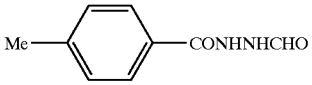

Stabilizer-2

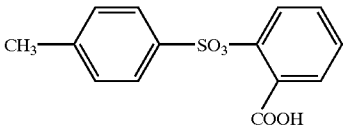

As shown in Table 4, the use of compounds relating to the invention led to silver salt photothermographic dry imaging material exhibiting minimized coefficient of dynamic friction, enhanced abrasion resistance, minimized unevenness in development, superior silver image tone and little variation in image tone even when exposed to light for a long period of time.

What is claimed is:

1. A photothermographic material comprising a support provided thereon at least one light-sensitive layer containing an organic silver salt, light-sensitive silver halide grains and a reducing agent, and a layer provided on at least one side of the support contains solid lubricant particles, and a fluorinated nonionic surfactant, wherein the surface of at least one side of the photothermographic material exhibits a coefficient of dynamic friction of 0.1 to 0.4 when being in contact with a stainless steel plate heated at a temperature of 100° C.

2. The photothermographic material of claim 1, wherein the surface of the light-sensitive layer side exhibits a coefficient of dynamic friction of 0.1 to 0.4 when being in contact with a stainless steel plate heated at a temperature of 100° C.

3. The photothermographic material of claim 1, wherein the surface of the opposite side of the light-sensitive layer exhibits a coefficient of dynamic friction of 0.1 to 0.4 when being in contact with a stainless steel plate heated at a temperature of 100° C.

4. The photothermographic material of claim 1, wherein the solid lubricant particles is selected from the group consisting of dichalcogenides, graphite, boron nitride, $CdCl_2$, $PbCl_2$ and phthalocyanine, Au, Ag, Pb, Ba, oxides of Cd, Co or Zn, sulfides of Bi or Cd, and fluorides of Ca, Li and Ba.

5. The photothermographic material of claim 4, wherein the solid lubricant particles is selected from the group consisting of $MOS_2$, $WS_2$, $WSe_2$, graphite, boron nitride, $CdCl_2$, $PbCl_2$ and phthalocyanine.

6. The photothermographic material of claim 5, wherein the solid lubricant particles is boron nitride.

7. The photothermographic material of claim 1, wherein the solid lubricant particles have a particle size of 1 to 10 μm.

8. The photothermographic material of claim 1, wherein the photothermographic material comprises on one side of the support plural layers including the light-sensitive layer and an outermost layer and further comprising on the other side of the support a backing layer, at least one of the outermost layer and backing layer contains the solid lubricant particles.

9. The photothermographic material of claim 8, wherein the backing layer contains the solid lubricant particles.

10. The photothermographic material of claim 8, wherein the outermost layer contains the solid lubricant particles.

11. The photothermographic material of claim 1, wherein the solid lubricant particles-containing layer further contains a hydroxy group-reactive compound.

12. The photothermographic material of claim 11, wherein the hydroxy group-reactive compound is a compound represented by formula (8), (Si-1) or (Si-2), (9), or (B):

$$X{=}C{=}N{-}L{-}(N{=}C{=}X)v \qquad \text{formula (8)}$$

wherein v is 1 or 2; L is an alkylene group, an alkenylene group, an arylenes group or an alkylarylene group; and X is an oxygen atom or a sulfur atom;

$$(R^{11}O)_m{-}Si{-}(L_1{-}R^{12})_n \qquad \text{formula (Si-1)}$$

formula (Si-2)

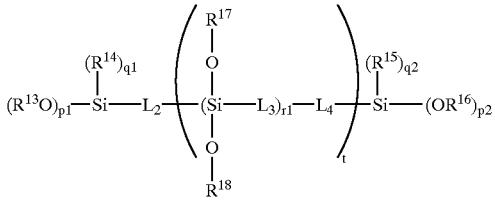

wherein $R^{11}$, $R^{12}$, $R^{13}$, $R^{14}$, $R^{15}$, $R^{16}$, $R^{17}$ and $R^{18}$ each represent an alkyl group, an alkenyl group, an alkynyl group, an aryl group or a heterocyclic group; $L_1$, $L_2$, $L_3$ and $L_4$ each represent a bivalent linkage group; m and n are each an integer of 1 to 3, provided that m+n is 4; p1 and p2 are each an integer of 1 to 3 and q1 and q2 are each 0, 1 or 2, provided that p1+q1 and p2+q2 are each 3; r1 and r2 are each 0 or an integer of 1 to 1000; and x is 0 or 1;

formula (9)

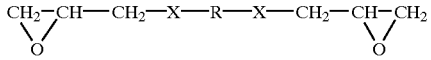

wherein R represents an alkylene group; and X represents —$SO_2$—, —$SO_2NH$—, —S—, —O— or —NR'—, in which R' is a univalent linkage group;

formula (B)

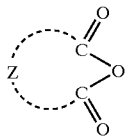

wherein Z is an atomic group necessary to form a ring.

13. The photothermographic material of claim 12, wherein the hydroxy group-reactive compound is a compound represented by formula (8), (Si-1) or (Si-2).) or (Si-2).

14. A photothermographic material comprising a support provided thereon at least one light-sensitive layer containing an organic silver salt, light-sensitive silver halide grains and a reducing agent, a layer provided on at least one side of the support contains solid lubricant particles, and a hydroxy group-reactive compound represented by formula (8), (Si-1) or (Si-2):

formula (8)

$$X{=}C{=}N{-}L{-}(N{=}C{=}X)v$$

wherein v is 1 or 2; L is an alkylene group, an alkenylene group, an arylenes group or an alkylarylene group; and X is an oxygen atom or a sulfur atom;

formula (Si-1)

$$(R^{11}O)_m{-}Si{-}(L_1{-}R^{12})_n$$

formula (Si-2)

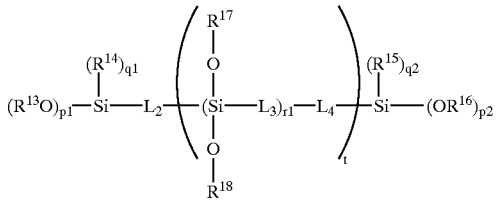

wherein $R^{11}$, $R^{12}$, $R^{13}$, $R^{14}$, $R^{15}$, $R^{16}$, $R^{17}$, and $R^{18}$ each represent an alkyl group, an alkenyl group, an alkynyl group, an aryl group or a heterocyclic group; $L_1$, $L_2$, $L_3$ and $L_4$ each represent a bivalent linkage group; m and n are each an integer of 1 to 3, provided that m+n is 4; p1 and p2 are each an integer of 1 to 3 and q1 and q2 are each 0, 1 or 2, provided that p1+q1 and p2+q2 are each 3; r1 and r2 are each 0 or an integer of 1 to 1000; and x is 0 or 1; wherein the surface of at least one side of the photothermographic material exhibits a coefficient of dynamic friction of 0.1 to 0.4 when being in contact with a stainless steel plate heated at a temperature of 100° C.

15. Photothermographic material of claim 14, wherein the surface of the light-sensitive layer side exhibits a coefficient of dynamic friction of 0.1 to 0.4 whein being in contact with a stainless steel plate heated at a temperature of 100° C.

16. The photothermographic material of claim 14, wherein the surface of the opposite side to the light-sensitive layer exhibits a coefficient of dynamic friction of 0.1 to 0.4 when being in contact with a stainless steel plate heated at a temperature of 100° C.

17. The photothermographic material of claim 14, wherein the solid lubricant particles is selected for the group consisting of dichalcogenides, graphite, boron nitride, $CdCl_2$, $PbCl_2$ and phthalocyanine, Au, Ag, Pb, Ba, oxides of Cd, Co or Zn, sulfides of Bi or Cd, and fluorides of Ca, Li and Ba.

18. The photothermographic material of claim 17, wherein the solid lubricant particles is selected from the group consisting of $MoS_2$, $WS_2$, $WSe_2$, graphite, boron nitride, $CdCl_2$, $PbCl_2$, and phthalocyanine.

19. The photothermographic material of claim 18, wherein the solid lubricant particles is boron nitride.

20. The photothermographic material of claim 14, wherein the solid lubricant particles have a particle size of 1 to 10 $\mu$m.

21. The photothermographic material of claim 14, wherein the photothermographic material comprises on one side of the support plural layers including the light-sensitive layer and an outermost layer and further comprising on the other side of the support a backing layer, at least one of the outermost layer and backing layer contains the solid lubricant particles.

22. The photothermographic material of claim 21, wherein the backing layer contains the solid lubricant particles.

23. The photothermographic material of claim 21, wherein the outermost layer contains the solid lubricant particles.

24. The photothermographic material of claim 14, wherein the solid lubricant particles-containing layer further contains a fluorinated nonionic surfactant.

* * * * *